US009804523B2

(12) United States Patent
Mochizuki et al.

(10) Patent No.: US 9,804,523 B2
(45) Date of Patent: Oct. 31, 2017

(54) IMAGE FORMING APPARATUS

(71) Applicant: CANON KABUSHIKI KAISHA, Tokyo (JP)

(72) Inventors: Jun Mochizuki, Abiko (JP); Osamu Ariizumi, Matsudo (JP); Shota Soda, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/133,300

(22) Filed: Apr. 20, 2016

(65) Prior Publication Data

US 2016/0320747 A1 Nov. 3, 2016

(30) Foreign Application Priority Data

Apr. 28, 2015 (JP) ..... 2015-091669
Apr. 28, 2015 (JP) ..... 2015-091670
Apr. 28, 2015 (JP) ..... 2015-091672

(51) Int. Cl.
*G03G 15/06* (2006.01)
*G03G 15/09* (2006.01)
*G03G 15/00* (2006.01)

(52) U.S. Cl.
CPC ..... *G03G 15/065* (2013.01); *G03G 15/0907* (2013.01); *G03G 15/50* (2013.01)

(58) Field of Classification Search
None
See application file for complete search history.

(56) References Cited

U.S. PATENT DOCUMENTS 6,904,245 B2 6/2005 Mochizuki et al.
6,990,300 B2 1/2006 Saito et al.
7,130,550 B2 10/2006 Mochizuki
7,848,671 B2 12/2010 Mochizuki
8,615,178 B2 12/2013 Mochizuki
8,737,881 B2 5/2014 Soda et al.
8,768,184 B2 7/2014 Ishida
8,831,480 B2 9/2014 Soda et al.
(Continued)

FOREIGN PATENT DOCUMENTS

JP 60249171 A * 12/1985 ..... G03G 15/065
JP 08211730 A * 8/1996
(Continued)

*Primary Examiner* — Sevan A Aydin
(74) *Attorney, Agent, or Firm* — Fitzpatrick, Cella, Harper & Scinto

(57) ABSTRACT

A control portion switches first and second modes based on information which influences a toner charging amount. In the first mode, a driving input to the developer bearing member is stopped in response to image formation completion before or at the same time when a trailing end of a charging area reaches the development position, and an application of the development voltage is stopped after the trailing end reaches the development position. In the second mode, The driving input to the developer bearing member is stopped in response to image formation completion before or at the same time when the trailing end reaches the development position, and the application of the development voltage is stopped at a timing after the trailing end reaches the development position and earlier than that in the first mode, or at the same time when the trailing end reaches the development position.

10 Claims, 26 Drawing Sheets

(56) References Cited

U.S. PATENT DOCUMENTS

| | | | | |
|---|---|---|---|---|
| 2006/0083527 | A1* | 4/2006 | Sakamaki | G03G 15/0121 399/50 |
| 2006/0222400 | A1* | 10/2006 | Matsuguma | G03G 15/0225 399/100 |
| 2008/0080885 | A1* | 4/2008 | Kidaka | G03G 15/0131 399/66 |
| 2009/0066982 | A1* | 3/2009 | Sakamaki | G03G 15/0121 358/1.9 |
| 2012/0002985 | A1* | 1/2012 | Katayama | G03G 15/161 399/21 |

FOREIGN PATENT DOCUMENTS

| | | | |
|---|---|---|---|
| JP | 2001-194909 | A | 7/2001 |
| JP | 2010-134205 | A | 6/2010 |
| JP | 2010-156911 | A | 7/2010 |
| JP | 2012-128320 | A | 7/2012 |

* cited by examiner

IMAGE FORMING APPARATUS

BACKGROUND OF THE INVENTION

Field of the Invention

This disclosure relates to an image forming apparatus such as a copier, a printer, a facsimile, or multi-function printer having the plurality of functions, in which an electro-photographic system or an electrostatic recording system is used.

Description of the Related Art

Hitherto, in an image forming apparatus which forms a toner image by using an electro-photographic system, a two-component developing system which uses a two-component developer that is made by mainly mixing a toner and a carrier is widely used. In the image forming apparatus, the two-component developer is borne onto a developing sleeve which is a developer bearing member, and the toner in the two-component developer is supplied to a photoconductive drum which is an image bearing member. A surface of the photoconductive drum is charged to a predetermined charge potential, and an electrostatic latent image is formed by exposing the surface. In addition, by applying a predetermined development voltage to the developing sleeve, the toner which is charged to the same polarity as charge polarity of the photoconductive drum is adhered to the electrostatic latent image, and the toner image is formed.

Here, it is desirable that a difference (Vback) between a potential (Vd) on the photoconductive drum of a non-image portion in which the electrostatic latent image is not formed, and a value (Vdc) of a DC component of the development voltage applied to the developing sleeve, is controlled to be within a predetermined range. In other words, "carrier adhesion" in which the carrier in the two-component developer, which is borne on the developing sleeve, is adhered to the photoconductive drum when Vback is large occurs, and on the contrary, a so-called "fogging" in which the toner is adhered to the non-image portion of the photoconductive drum when Vback is small occurs. In particular, since there is a possibility that the surface of the photoconductive drum is damaged when the carrier adhesion occurs, hitherto, Vback is controlled to prevent the occurrence of the carrier adhesion.

It is desirable that the relationship of Vback is maintained when application of each voltage is stopped in response to image formation completion, i.e., in a case of executing a voltage falling control, and when application of each voltage is started in response to an image formation start, i.e., in a case of executing a voltage rising control. In particular, in the case where the voltage falls, in order to reduce the carrier adhesion to the photoconductive drum, a development voltage and a charge voltage are lowered after rotation drive of the developing sleeve is stopped. Here, after the developing sleeve is stopped, when Vback is applied between the developing sleeve and the photoconductive drum, there is a case where a phenomenon occurs in which the toner in the developer on the developing sleeve is adhered to the developing sleeve due to the influence of an electric field. When the toner adhesion to the developing sleeve occurs, a belt-like image is generated at a sleeve pitch in the next output image. Therefore, JP-A-2010-134205 suggests controlling Vback in order to reduce the toner adhesion to the developing sleeve.

SUMMARY OF THE INVENTION

This disclosure is to provide a configuration in which generation of a belt-like image due to toner adhesion to a developer bearing member is suppressed, and unnecessary consumption of a toner is suppressed.

According to a first aspect of the present invention, an image forming apparatus includes an image bearing member configured to rotate, a charging unit configured to charge a surface of the image bearing member at a charging position, a developing unit configured to develop an electrostatic latent image formed on the image bearing member at a development position, and a control portion configured to perform a first mode and a second mode. The developing unit includes a developer bearing member configured to rotate while bearing a developer containing a toner and a carrier thereon and configured to be applied a development voltage. The first mode is a mode in which a driving input to the developer bearing member is stopped in response to image formation completion before or at the same time when a trailing end of a charging area of the image bearing member charged by the charging unit reaches the development position, and an application of the development voltage is stopped after the trailing end of the charging area reaches the development position. The second mode is a mode in which the driving input to the developer bearing member is stopped in response to image formation completion before or at the same time when the trailing end of the charging area reaches the development position, and the application of the development voltage is stopped at a timing after the trailing end of the charging area reaches the development position and earlier than that in the first mode, or at the same time when the trailing end of the charging area reaches the development position. The control portion is configured to switch the first mode and the second mode based on information which influences a toner charging amount.

According to a second aspect of the present invention, an image forming apparatus includes an image bearing member configured to rotate, a charging unit configured to charge a surface of the image bearing member at a charging position, a developing unit configured to develop an electrostatic latent image formed on the image bearing member by the toner by applying a development voltage to the developer bearing member at a development position, and a control portion configured to perform a first mode and a second mode. The developing unit includes a developer bearing member configured to rotate while bearing a developer containing a toner and a carrier thereon and configured to be applied a development voltage. The first mode is a mode in which a driving input to the developer bearing member is started in response to image formation after a leading end of a charging area of the image bearing member charged by the charging unit reaches the development position, and an application of the development voltage is started before the leading end of the charged area reaches the development position. The second mode is a mode in which the driving input to the developer bearing member is started in response to image formation after the leading end of the charging area reaches the development position, and the application of the development voltage is started at a timing before the leading end of the charging area reaches the development position and later than that in the first mode, or at the same time when the leading end of the charging area reaches the development position. The control portion is configured to switch the first mode and the second mode based on information which influences a toner charging amount.

According to a third aspect of the present invention, an image forming apparatus includes an image bearing member configured to rotate, a charging unit configured to charge a surface of the image bearing member by applying only a DC charge voltage, a developing unit configured to develop an electrostatic latent image formed on the image bearing member at a development position, a neutralizing unit configured to be provided downstream of the charging unit and upstream of the developing unit in a rotation direction of the image bearing member, and to neutralize the charged surface of the image bearing member, and a control portion configured to perform a first mode and a second mode. The developing unit includes a developer bearing member configured to rotate while bearing a developer containing a toner and a carrier thereon and configured to be applied a development voltage. The first mode is a mode in which a driving input to the developer bearing member is stopped in response to image formation completion before or at the same time when a leading end of a neutralization area of the image bearing member which is neutralized by the neutralizing unit reaches the development position, and an application of the development voltage is stopped after the leading end of a neutralization area reaches the development position. The second mode is a mode in which the driving input to the developer bearing member is stopped in response to image formation completion before or at the same time when the leading end of a neutralization area reaches the development position, and the application of the development voltage is stopped at a timing after the leading end of a neutralization area reaches the development position and earlier than that in the first mode, or at the same time when the leading end of the neutralization area reaches the development position. The control portion is configured to switch the first mode and the second mode based on information which influences a toner charging amount.

According to a fourth aspect of the present invention, an image forming apparatus includes a photoconductive member configured to rotate, a charging unit configured to charge a surface of the photoconductive member to a predetermined charge potential by applying only a DC charge voltage, a developing unit configured to develop an electrostatic latent image formed on the image bearing member at a development position, an exposing unit provided downstream of the charge unit and upstream of the developing unit in a rotation direction of the photoconductive member, and to lower an absolute value of a charge potential by exposing the charged surface of the photoconductive member, and a control portion configured to perform a first mode and a second mode. The developing unit includes a developer bearing member configured to rotate while bearing a developer containing a toner and a carrier thereon and configured to be applied a development voltage. The first mode is a mode in which a driving input to the developer bearing member is stopped in response to image formation completion before or at the same time a leading end of an exposed area of the photoconductive member which is exposed by the exposing unit reaches the development position, and an application of the development voltage is stopped after the leading end of the exposed area reaches the development position. The second mode is a mode in which the driving input to the developer bearing member is stopped in response to image formation completion before or at the same time when the leading end of the exposed area reaches the development position, and the application of the development voltage is stopped at a timing after the leading end of the exposed area reaches the development position and earlier than that in the first mode, or at the same time when the leading end of the exposed area reaches the development position. The control portion is configured to switch the first mode and the second mode based on information which influences a toner charging amount.

Further features of the present invention will become apparent from the following description of exemplary embodiments with reference to the attached drawings.

DESCRIPTION OF THE EMBODIMENTS

First Embodiment

A first embodiment will be described by using FIGS. 1 to 8B. First, a schematic configuration of an image forming apparatus according to the embodiment will be described by using FIGS. 1 to 3.

Image Forming Apparatus

An image forming apparatus 100 according to the embodiment is a color laser printer in which a transfer type electro-photographic process, a contact charge type, and a reverse developing type are used, and the maximum paper size is an A3 size. The image forming apparatus 100 forms and outputs a color image to a recording medium (for example, a sheet material, such as a paper sheet or an OHP sheet) in accordance with image information from an external host apparatus, such as a personal computer or an image reading apparatus which is connected to be communicable with an apparatus body.

Figure 1:
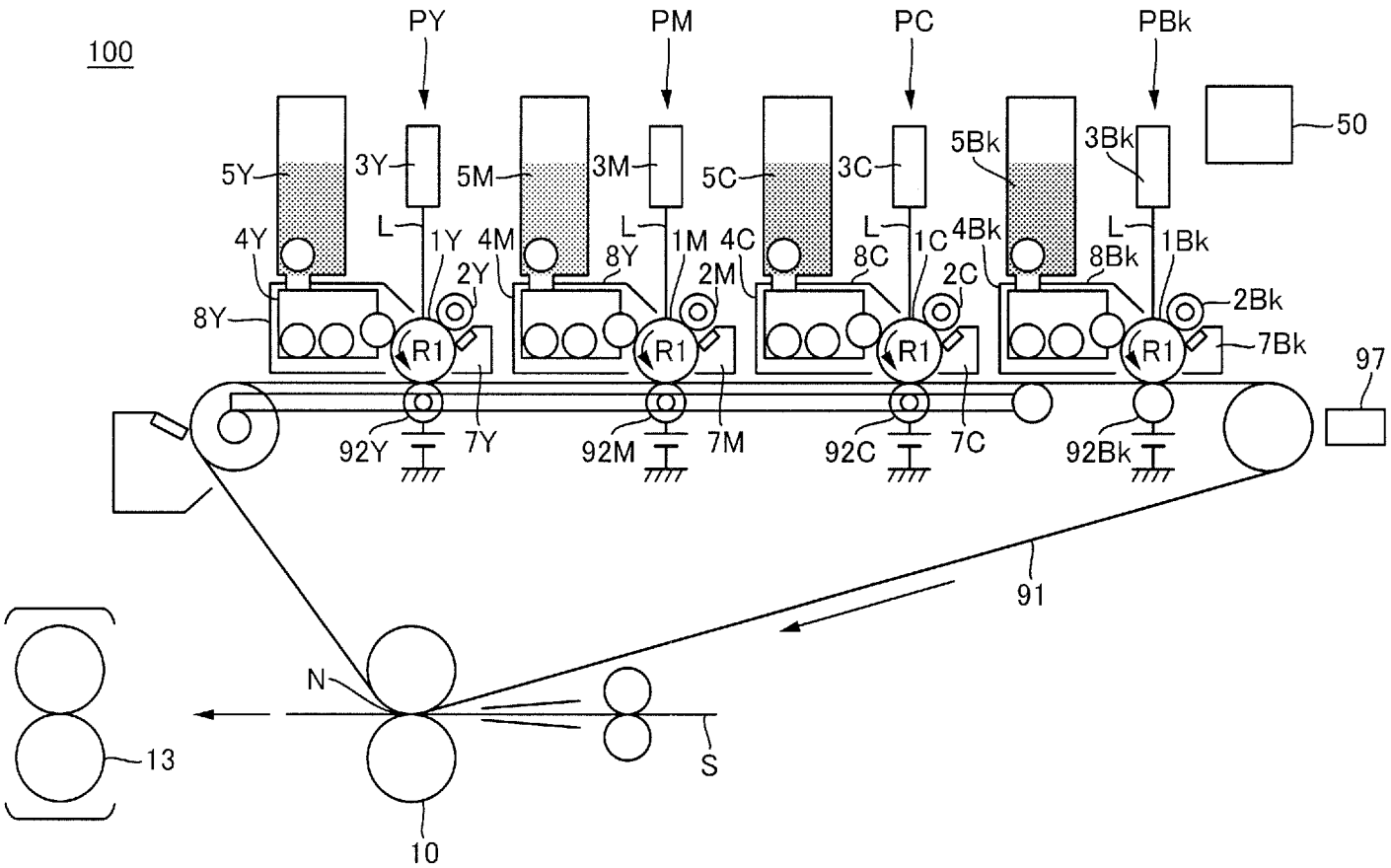
FIG. 1 is a schematic configuration sectional view of an image forming apparatus according to a first embodiment.

As illustrated in FIG. 1, the image forming apparatus 100 is a so-called tandem type image forming apparatus in which a plurality of image forming portions are disposed to be aligned along the direction of movement of an intermediate transfer belt (intermediate transfer body) 91. In other words, the image forming apparatus 100 includes a plurality of process cartridges 8, and continuously transfers toner images multiple times to the movable intermediate transfer belt 91 by each process cartridge 8. After this, a color image is formed by transferring the toner images at the same time to a recording medium S from the intermediate transfer belt 91. In the embodiment, four process cartridges 8 are disposed in an order of yellow, magenta, cyan, and black in series in the direction of movement of the intermediate transfer belt 91. Hereinafter, this will be described in more detail.

The image forming apparatus 100 includes first, second, third, and fourth image forming portions PY, PM, PC, and PBk for forming images having each of the colors, such as yellow (Y), magenta (M), cyan (C), and black (Bk). Since four image forming portions PY, PM, PC, and PBk have the same configuration, except that the colors of used developers are different from each other, hereinafter, a first image forming portion PY will be mainly described, and overlapped description regarding other image forming portions PM, PC, and PBk will be omitted.

For example, when describing the entire operation of a case where images of four colors are formed, according to a signal from the external host apparatus which is connected to be communicable with the image forming apparatus 100, a color-separated image signal is generated. In accordance with the signal, toner images of each color are formed in each of process cartridges 8Y, 8M, 8C, and 8BK of each of the image forming portions PY, PM, PC, and PBk.

The process cartridge 8Y includes a rotatable drum type electro-photographic photoconductive member (photoconductive member) which has an organic material photoconductive layer on a conductive supporting body as an image bearing member, that is, a photoconductive drum 1Y. A surface of the photoconductive drum 1Y is charged to a charge potential as a predetermined charge voltage is applied to a charging roller 2Y which serves as a charging apparatus. By scanning and exposing one charged surface by an exposing unit (for example, a laser beam scanner) 3Y which serves as a latent image forming apparatus, an electrostatic latent image (electrostatic image) is formed on the photoconductive drum 1Y. In addition, by supplying a toner which is a developer by a developing unit 4Y to the electrostatic latent image, a toner image is formed on the photoconductive drum 1Y.

Figure 2:
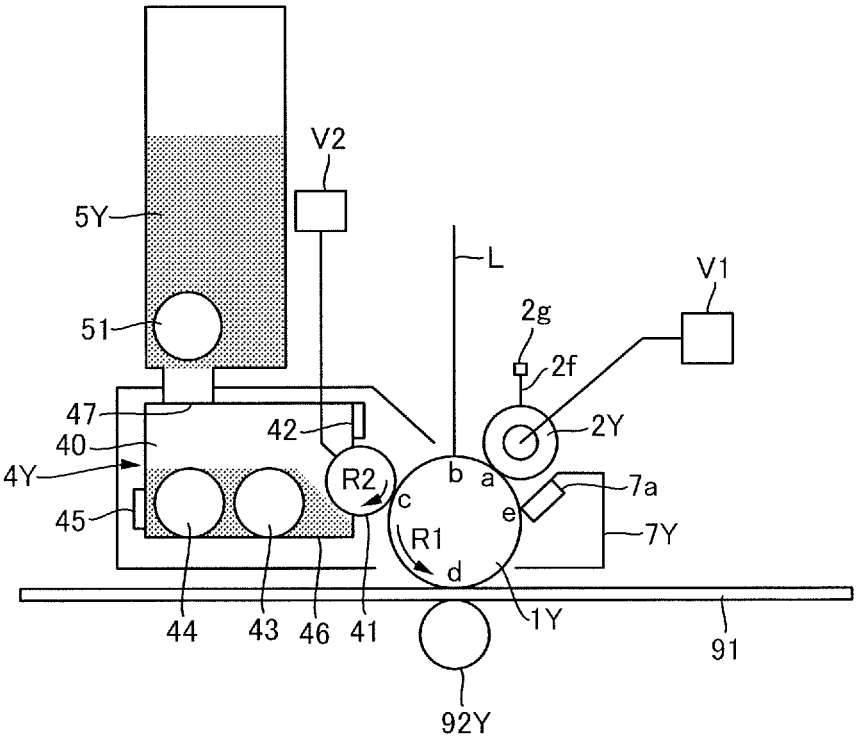
FIG. 2 is a schematic configuration sectional view which enlarges and illustrates an image forming portion of FIG. 1.

The toner image formed on the photoconductive drum 1Y is transferred (primary transfer) onto the intermediate transfer belt 91 which is an endless belt-like intermediate transfer body, in a primary transfer unit d (FIG. 2). On an inner circumferential surface side of the intermediate transfer belt 91, a primary transfer roller 92Y which is a primary transfer member is provided to oppose the photoconductive drum 1Y. The toner image is transferred (primary transfer) to the intermediate transfer belt 91 from the photoconductive drum 1Y by the operation of the primary transfer roller 92Y. Similarly, the toner images having each color of the photoconductive drums 1M, 1C, and 1Bk are transferred being consecutively superposed on the intermediate transfer belt 91, and color toner images are formed on the intermediate transfer belt 91. In addition, the color toner images formed on the intermediate transfer belt 91 are transferred (secondary transfer) at the same time onto the recording medium (for example, a sheet, such as a paper sheet) S which is conveyed to a secondary transfer unit N in which the intermediate transfer belt 91 and a secondary transfer roller 10 which is a secondary transfer member oppose each other. Next, the recording medium S to which the toner image is transferred is conveyed to a fixing unit 13, and is discharged to the outside of the apparatus after the toner image is fixed here. The fixing unit 13 employs heat and pressure to the recording medium S by a pair of fixing rollers, and melts and fixes the toner image to the recording medium S.

Next, each element of the image forming portion PY will be described in more detail with reference to FIG. 2.

In the embodiment, the photoconductive drum 1Y is an organic photoconductor (OPC) drum, and an outer diameter thereof is 30 mm. In addition, the photoconductive drum 1Y is driven to be rotated in the arrow R1 direction (direction of counterclockwise) in the drawing at the predetermined process speed (circumferential speed) of 240 mm/sec around a center supporting shaft.

The charging roller 2Y is a contact charge member which is formed in a shape of a roller. By applying a predetermined charge voltage to the charging roller 2Y, the photoconductive drum 1Y is uniformly charged to a charge potential of negative polarity. In the embodiment, the length of the charging roller 2Y in the longitudinal direction (direction of rotational axis) is 320 mm, and a surface layer on a base layer is coated around the outside of a core metal (support member). When being further described, in the charging roller 2Y, a stainless round rod having a diameter of 6 mm is used as the core metal, a layer which is made by dispersing carbon to a fluororesin is used as the surface layer, the outer diameter of a roller is 14 mm, and electric resistance as a roller is $10^4\Omega$ to $10^7\Omega$. Both end portions of the core metal of the charging roller 2Y are respectively held to be rotatable by a bearing member, and the charging roller 2Y is biased in the direction of the photoconductive drum 1Y by a pressing spring, and is in pressure contact with the surface of the photoconductive drum 1Y by a predetermined pressing force. In addition, the charging roller 2Y rotates being driven by the rotation of the photoconductive drum 1Y.

In addition, a predetermined oscillation voltage (Vdc+Vac) which is made by superposing an AC voltage (Vac) having a predetermined frequency onto a DC voltage (Vdc), is applied to the charging roller 2Y via the core metal, from a charge power source (high voltage power source) V1 which serves as a charge voltage applying apparatus. Accordingly, a circumferential surface of the rotating photoconductive drum 1Y is charged to a predetermined potential (charge potential). A contact portion of the charging roller 2Y and the photoconductive drum 1Y is a charge position (a) where the charging roller 2Y as a charging unit charging the surface of the photoconductive drum 1Y as the image bearing member. In the embodiment, when forming an image, the voltage (charge bias) applied to the charging roller 2Y is an oscillation voltage which is made by superposing a DC voltage of −500 V, and a sine wave AC voltage in which a frequency is 1,500 Hz and a peak-to-peak voltage Vpp is 1,700 V. By the charge voltage, the circumferential surface of the photoconductive drum 1Y is uniformly contact-charged to −500 V (charge voltage, dark potential Vd). Here, the time when the image is formed is the time when the toner image is formed on the photoconductive drum based on the image information input from an external terminal, such as a scanner or a personal computer, which is provided in the image forming apparatus.

In addition, a charging roller cleaning member 2*f* is provided with respect to the charging roller 2Y. In the embodiment, the charging roller cleaning member 2*f* is a cleaning film having flexibility. The charging roller cleaning member 2*f* is disposed parallel to the longitudinal direction (direction of rotational axis) of the charging roller 2Y. In addition, one end of the charging roller cleaning member 2*f* is fixed to a support member 2*g* which reciprocates by a constant amount with respect to the longitudinal direction, and the charging roller cleaning member 2*f* is disposed to come into contact with the charging roller 2Y on a surface in the vicinity of a free end side. The support member 2*g* is driven via a gear train by a drive motor of the image forming apparatus 100, and reciprocates by a constant amount in the longitudinal direction, and accordingly, the surface layer of the charging roller 2Y is rubbed by the charging roller cleaning member 2*f*. According to this, adhered contaminants (fine powder toner, external additive, or the like) on the surface of the charging roller 2Y are removed.

The photoconductive drum 1Y receives an image exposing light (laser light L) by the exposing unit 3 after being uniformly charged to predetermined polarity and potential by the charging roller 2Y. In the embodiment, the exposing unit 3Y includes a color separation and imaging exposure optical system of a color document image, or a scanning exposure system by a laser scanner which outputs a laser beam modulated corresponding to a time series electric digital pixel signal of image information. The electrostatic latent images of color components which correspond to each of the image forming portions PY, PM, PC, and PBk of a target color image are formed on each of the photoconductive drums 1Y, 1M, 1C, and 1Bk by each of the exposing units 3Y, 3M, 3C, and 3Bk.

In addition, in the embodiment, a laser beam scanner which uses a semiconductor laser is employed as the exposing unit 3Y. The laser beam scanner outputs the laser light modulated corresponding to the image signal sent to the image forming apparatus 100 side from the external host apparatus, and performs laser scanning exposure (image exposure) with respect to the uniformly charged surface of the rotating photoconductive drum 1Y. By lowering the potential at a portion which is irradiated with the laser light L on the photoconductive drum 1Y by the laser scanning exposure, the electrostatic latent image in which the scanning exposure is performed and which corresponds to the image information is formed on the rotating photoconductive drum 1Y. In the embodiment, an exposed zone potential V1 is −150 V. An irradiation position of the image exposing light (laser light L) in a photoconductive drum 1 is an exposure position (b). It is noted that the exposure position (b) is a neutralization position where a neutralizing unit neutralizes the charged surface of the image bearing member.

The electrostatic latent image formed on the photoconductive drum. 1Y is developed by the toner in the developing unit 4Y. In the embodiment, the developing unit 4Y is a two-component contact developing unit (two-component magnetic brush developing unit). The developing unit 4Y includes a development container 40, a developing sleeve 41 which serves as a developer bearing member that includes a magnet roller disposed to be fixed to the inside thereof, a developer regulating blade 42, and screws 43 and 44 which serve as developer stirring members installed on a bottom portion side in the development container 40. In the development container 40, a two-component developer (developer) 46 which is mainly a mixture of resin toner particles (toner) and magnetic carrier particles (carrier) is accommodated.

A portion of an outer circumferential surface of the developing sleeve 41 is exposed to the outside of the development container 40, and the developing sleeve 41 is rotatably installed in the development container 40. In addition, the developing sleeve 41 carries the conveyed developer and rotates while performing the stirring by the screws 43 and 44. As the developer is stirred by the screws 43 and 44, respectively, the toner is charged to negative polarity and the carrier is charged to positive polarity.

The developer regulating blade 42 which has a predetermined void opposes the developing sleeve 41, and a developer thin layer is formed on the developing sleeve 41 according to the rotation of the developing sleeve 41 in the arrow R2 direction (direction of clockwise) in the drawing. In the embodiment, the developing sleeve 41 holds the closest distance (S-Dgap) to the photoconductive drum 1Y to be 350 μm, and is installed to oppose the photoconductive drum 1Y being close to the photoconductive drum 1Y. A position where the photoconductive drum 1Y and the developing sleeve 41 oppose each other is a development position (c). In addition, the developing sleeve 41 is driven to be rotated so that the surface thereof at the development position (c) moves in the same direction as the direction of advance of the surface of the photoconductive drum 1Y.

The developer thin layer on the developing sleeve 41 comes into contact with the surface of the photoconductive drum 1Y at the development position (c), and appropriately rubs the photoconductive drum 1Y. A predetermined development voltage (development bias) having a DC component is applied to the developing sleeve 41 from a development power source (high voltage power source) V2 which serves as a development voltage applying apparatus. In the embodiment, the development voltage applied to the developing sleeve 41 is a voltage which is made by superposing the DC voltage (Vdc) and the AC voltage (Vac). More specifically, the development voltage is an oscillation voltage which is made by superposing a DC voltage of −350 V and an AC voltage in which the peak-to-peak voltage Vpp is 1,800 V and the frequency is 11 kHz.

Coating is performed on the rotating developing sleeve 41 as the thin layer, and the toner in the developer conveyed to the development position (c) is selectively adhered thereto corresponding to the electrostatic latent image formed on the photoconductive drum 1Y by the electric field by the development voltage. Accordingly, the electrostatic latent image on the photoconductive drum 1Y is developed as the toner image. In the embodiment, the toner is adhered to the exposed portion on the photoconductive drum 1Y and the electrostatic latent image is reverse-developed.

The developer thin layer on the developing sleeve 41, which passes the development position (c), returns to a developer reservoir portion in the development container 40 according to the continuous rotation of the developing sleeve 41. The screws 43 and 44 are provided in the developing unit 4Y. The screws 43 and 44 rotate in synchronization with the rotation of the developing sleeve 41, and have a function of stirring and mixing the replenished toner and carrier, and giving a predetermined electric charge to the toner. In addition, the screws 43 and 44 respectively convey the developer in the direction opposite to the longitudinal direction, and supply the developer to the developing sleeve 41. At the same time, the screws 43 and 44 have a function of conveying the developer which has a low toner concentration (ratio of the toner in the developer) by a developing process to a toner replenishing portion, and circulating the developer in the development container 40.

On a wall surface on the upstream side wall of screw 44 of the developing unit 4Y, a concentration sensor 45 which serves as a concentration detection portion that detects changes in magnetic permeability in the developer and detects the toner concentration in the developer, is provided. On a slightly downstream side of the concentration sensor 45 in the circulating direction of the developer, a toner replenishing opening 47 is provided. After performing a developing operation, the developer is transported to a detection portion of the concentration sensor 45, and here, the toner concentration is detected. In accordance with the detection result, the toner replenishment is appropriately performed through the toner replenishing opening 47 of a developing unit 4 from a toner replenishing unit 5Y by the rotation of a replenishing screw 51 provided with the toner replenishing unit (replenishing unit) 5Y which is connected to the developing unit 4. Accordingly, the toner concentration in the developer is maintained.

The replenished toner is conveyed by the screw 44, and is mixed with the carrier, and an appropriate electric charge is applied. After this, the replenished toner is transported to the vicinity of the developing sleeve 41, is formed as the thin layer on the developing sleeve 41, and is used in development. In the embodiment, a negatively charged toner having an average particle diameter of 5.5 μm is used as the toner, and a magnetic carrier having saturation magnetization of 205 emu/cm$^3$ and an average particle diameter of 35 μm is used as the carrier. In addition, in the embodiment, a developer which is made by mixing the toner and the carrier at the weight ratio of 10:90 is used.

The toner (residual toner) which is not transferred to the intermediate transfer belt 91 by the primary transfer unit d and remains on the photoconductive drum 1 is removed from the photoconductive drum 1Y by a cleaning unit 7Y which serves as a photoconductor cleaning member. The cleaning unit 7Y removes the transfer residual toner on the photoconductive drum 1Y by using a cleaning blade 7*a*, which serves as a cleaning member provided to abut against the photoconductive drum 1Y. The photoconductive drum 1Y of which the surface is cleaned is used in the next image making process. As a material of the cleaning blade 7*a*, a urethane rubber-based material is widely used.

It is noted that, in the embodiment, by using the exposing unit 3Y and the developing unit 4Y, a toner imaging forming portion which forms the toner image on the photoconductive drum 1Y charged by the charging roller 2Y is configured. In addition, the photoconductive drum 1Y, and the charging roller 2Y, the developing unit 4Y, and the cleaning unit 7Y are integrally made as a cartridge, and configure the process cartridge 8Y which is attachable to and detachable from the apparatus body.

Figure 3:
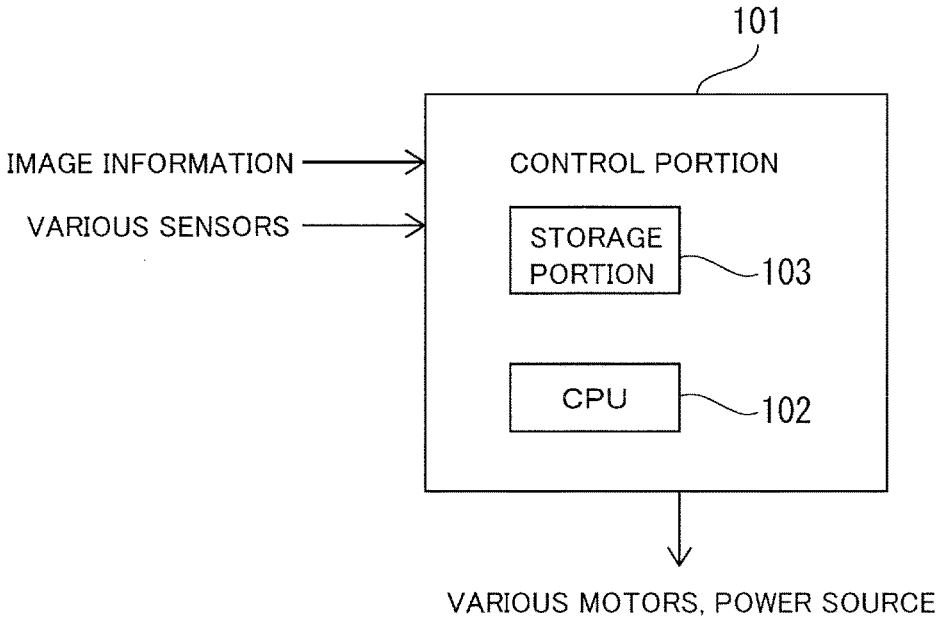
FIG. 3 is a control block diagram of the image forming apparatus according to the first embodiment.

As illustrated in FIG. 3, the image forming apparatus 100 configured in this manner includes a control portion 101 which controls an image forming operation. The control portion 101 includes a CPU 102 and a storage portion 103, and controls various motors or power sources based on the image information and the input of various sensors. In other words, the control portion 101 generally controls the operation of the image forming apparatus 100 including instruction of an operation of drive and stopping a driving unit of the photoconductive drums 1Y, 1M, 1C, and 1Bk or the intermediate transfer belt 91, instruction of starting and stopping voltage application of the charge power source V1 or the development power source V2, and setting of a voltage application condition.

In addition, as described above, the developer of a two-component developing system is configured of the toner and the carrier, and the toner and the carrier can obtain the charging amount by frictional charging. Here, a change in the charging amount of the toner in the case where the apparatus is used for a long period of time, that is, after predetermined time elapses after the use of the developer in the developing unit is started (for example, a case where the image formation is performed more than 100,000 to 200,000 sheets), will be described. The charging amount of the toner and the carrier is charged by the frictional charging, but the toner or the external additive which is a component of the toner is adhered to the surface of the carrier in the developer due to the use for a long period of time, or the surface of the carrier is shaved. Accordingly, charging performance of the carrier deteriorates.

In this manner, in the case where the charging performance of the carrier deteriorates, there is a method of maintaining the charging amount of the toner by reducing the toner concentration with respect to the carrier, and by raising the contact ratio of the toner with respect to the carrier. However, in the embodiment, it is assumed that the toner concentration with respect to the carrier is controlled to be fixed to be constant. It is noted that a case where the toner concentration with respect to the carrier is controlled to be changed, for example, a case where the toner concentration is set to be a predetermined lower limit value by reducing the toner concentration in a state where the apparatus is used for a long period of time, is included in the assumption. The predetermined lower limit value is regulated by other factors, such as the carrier adhesion.

In any cases, in the case where the charging amount of the toner in the developing unit is decreased, a developing contrast which is a difference between the development voltage and a potential (exposed zone potential) of the surface of the photoconductive drum exposed by the exposing unit, is set to be low. Meanwhile, in the case where the charging amount of the toner is increased, the developing contrast is set to be high. Accordingly, the developed toner amount is maintained.

In this manner, in the image forming apparatus 100 according to the embodiment, a predetermined toner image (test pattern) is formed on the intermediate transfer belt 91 at a predetermined interval (for example, every predetermined number sheet of image formation) by the command of the control portion 101. In addition, by detecting the toner mounting amount of the test pattern, the charging amount of the toner is detected. In other words, as illustrated in FIG. 1, on the downstream side of each image forming portion P of the intermediate transfer belt 91, a toner mounting amount detection sensor 97 which serves as a charging amount detection portion that detects the toner mounting amount is disposed. The toner mounting amount detection sensor 97 is an optical reflection type sensor. In addition, the control portion 101 calculates the toner mounting amount on the intermediate transfer belt 91 from a difference between a reflected light amount of the intermediate transfer belt 91 in an area where the toner is not present, and a reflected light amount in the case where the toner is present, which are detected by the toner mounting amount detection sensor 97.

In addition, the control portion 101 acquires the charging amount of the toner in the developing unit (in the development container 40) from the toner mounting amount, for example, by a relationship (relational expression or table) between the toner mounting amount stored in the storage portion 103 and the charging amount of the toner. Here, the charging amount of the toner is low in a case (a case where the toner mounting amount is large) where a large amount of toner is mounted on the intermediate transfer belt 91, and on the contrary, the charging amount of the toner is high in a case (a case where the toner mounting amount is small) where the toner amount mounted on the intermediate transfer belt 91 is small.

Toner Adhesion to Developing Sleeve

Here, a mechanism of the toner adhesion to the developing sleeve described above will be described in detail by using FIG. 4A. The toner adhesion to the developing sleeve occurs due to the potential difference between the developing sleeve and the photoconductive drum when the voltage falls (when the application of the voltage is stopped) according to the image formation completion, but the occurrence situation is largely caused by a state of the developer, and particularly by the toner charging amount.

Figure 4A:
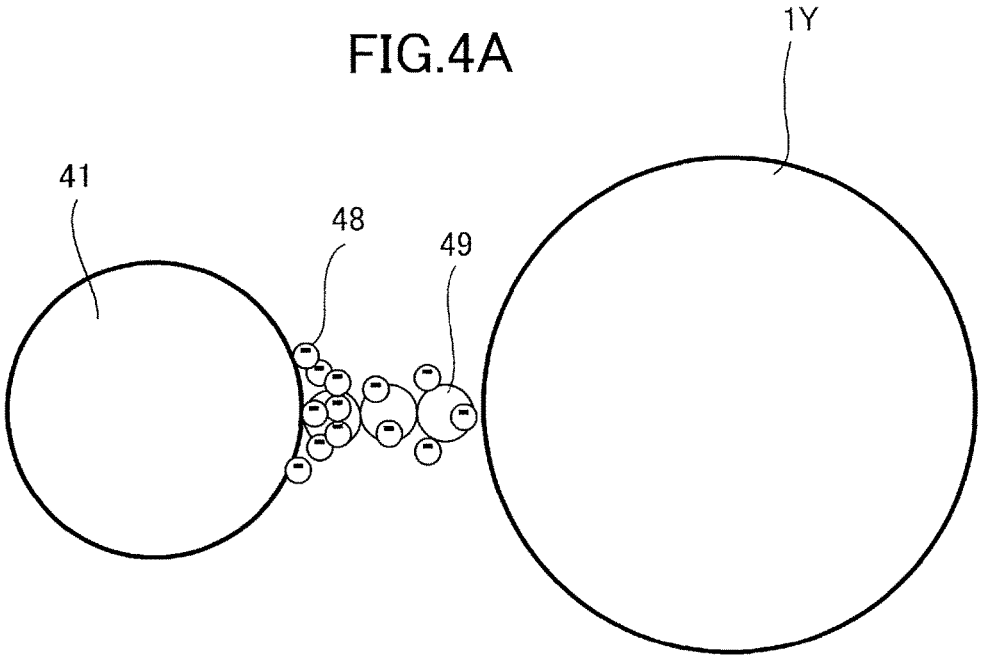
FIG. 4A is a schematic view illustrating a state where Vback is applied between a developing sleeve and a photoconductive drum.

Here, since an electrostatic force which attracts the carrier is small in the case where the charging amount of the toner is low, the toner is separated from the carrier surface, and is likely to move by the electric field between the developing sleeve 41 and the photoconductive drum 1Y. In addition, as illustrated in FIG. 4A, when the electric field which attracts a toner 48 to the developing sleeve 41 side, that is, Vback, is applied, a phenomenon (sleeve adhesion) in which the toner 48 having a low charging amount is adhered to the surface of the developing sleeve 41 is likely to occur. In other words, among the toners 48 which are borne to the surface of the developing sleeve 41, and are adhered to the surface of a carrier 49 that comes into contact with the photoconductive drum 1Y, in particular, the toner 48 having a low charging amount is adhered to the surface of the developing sleeve 41 by Vback.

For example, in the case where a surface potential (charging potential) of the photoconductive drum 1Y is −500 V, and the development voltage of −350 V is applied to the developing sleeve 41, in particular, the toner having a low charging amount is drawn toward the surface of the developing sleeve 41 by Vback of 150 V. In addition, the toner adhesion to the developing sleeve 41 is performed. In particular, in a post rotation process according to the image formation completion, if Vback is applied when the rotation of the developing sleeve 41 is stopped, the toner adhesion particularly remarkably occurs at a portion of the surface of the developing sleeve 41 which opposes the photoconductive drum 1Y.

After this, in the next image forming operation, at a location at which the toner adhesion occurs on the surface of the developing sleeve 41, a phenomenon occurs in which the electric field between the developing sleeve 41 and the photoconductive drum 1Y becomes different by the charge of the adhered toner, and the image concentration becomes high only in the area. For example, in the case where an exposed zone potential V1 of the photoconductive drum 1Y is −150 V and −350V is applied to the developing sleeve 41, the toner which is negatively charged by 200 V of potential difference, is developed. However, the location where the toner adhesion occurs on the surface of the developing sleeve 41 becomes in a state where the potential difference is slightly higher than 200 V by the charge of the toner, and the concentration only in the area becomes high. As described above, in a state where the charging amount of the toner is low, the toner adhesion to the developing sleeve 41 is likely to occur. On the contrary, in a state where the charging amount of the toner is high, the toner adhesion to the developing sleeve 41 is unlikely to occur.

Here, in order to reduce the toner adhesion to the developing sleeve, it is considered to set the potential relationship between the developing sleeve and the photoconductive drum to be a "fogging" side by making the development voltage fall after the charge voltage falls at a timing when the developing sleeve is stopped. Accordingly, when the voltage falls, the toner adhesion to the developing sleeve can be suppressed.

However, since the "fogging" is generated every time when the voltage falls, the toner is consumed more than necessary. In addition, by discharging the toner when the voltage falls, there is a possibility that the toner is scattered in the apparatus body. In addition, there is a possibility that various sensors installed in the apparatus body have soiling, the service life of the component in the apparatus body deteriorates, and further, soiling occurs in the output material.

Voltage Falling Control

Figure 4B:
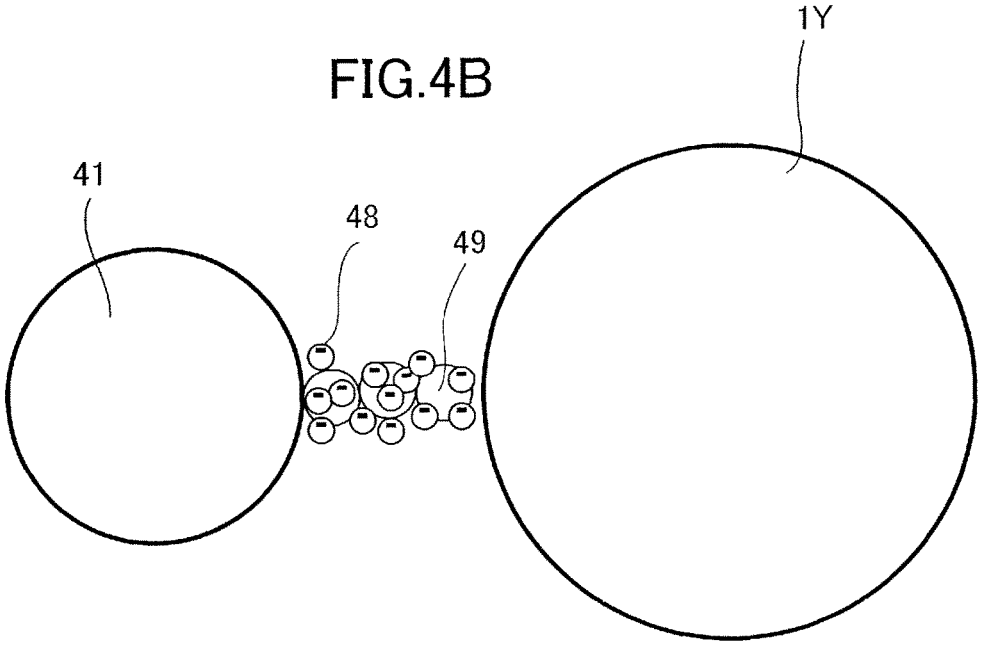
FIG. 4B is a schematic view illustrating a state where voltage on a fogging side is applied between the developing sleeve and the photoconductive drum.

As described above, in the embodiment, the charging amount of the toner is detected as information which influences the toner charging amount, and in accordance with this, the charging and the voltage falling control of the development voltage are switched. In addition, while suppressing the toner adhesion to the developing sleeve 41, unnecessary consumption of the toner is suppressed. In other words, under a condition that the charging amount of the toner is low and the toner adhesion to the developing sleeve 41 is likely to occur, at a timing when the developing sleeve 41 is stopped, the charge voltage falls in advance, and after this, the development voltage falls. Accordingly, the potential relationship between Vd and Vdc is reversed to that in the image formation, and the potential between the developing sleeve 41 and the photoconductive drum 1 is set to be the potential on the fogging side. By performing the voltage falling control, as illustrated in FIG. 4B, it is possible to hold a state where the toner 48 is uniformly adhered to the carrier 49 while the toner 48 does not adhere to the surface of the developing sleeve 41 when the developing sleeve 41 is stopped. Meanwhile, under a condition that the charging amount of the toner is high, and the toner adhesion to the developing sleeve 41 occurs, at the timing when the developing sleeve 41 is stopped, the charge voltage (drum potential) and the development voltage fall at substantially the same time at the development position (c). By performing the voltage falling control, it is possible to suppress generation of fogging toner, to suppress unnecessary consumption of the toner, and to avoid a phenomenon, such as toner scattering.

The voltage falling control in the embodiment will be specifically described by using FIGS. 5 to 8B. In the embodiment, by detecting the charging amount of the toner in the development container 40 as described above, in accordance with this, a method of stopping (falling) the application of the development voltage and the charge voltage in the operation (post rotation) from the time when the image forming operation is completed to the time when the main body is stopped (operations of each portion are stopped), is changed.

Figure 5:
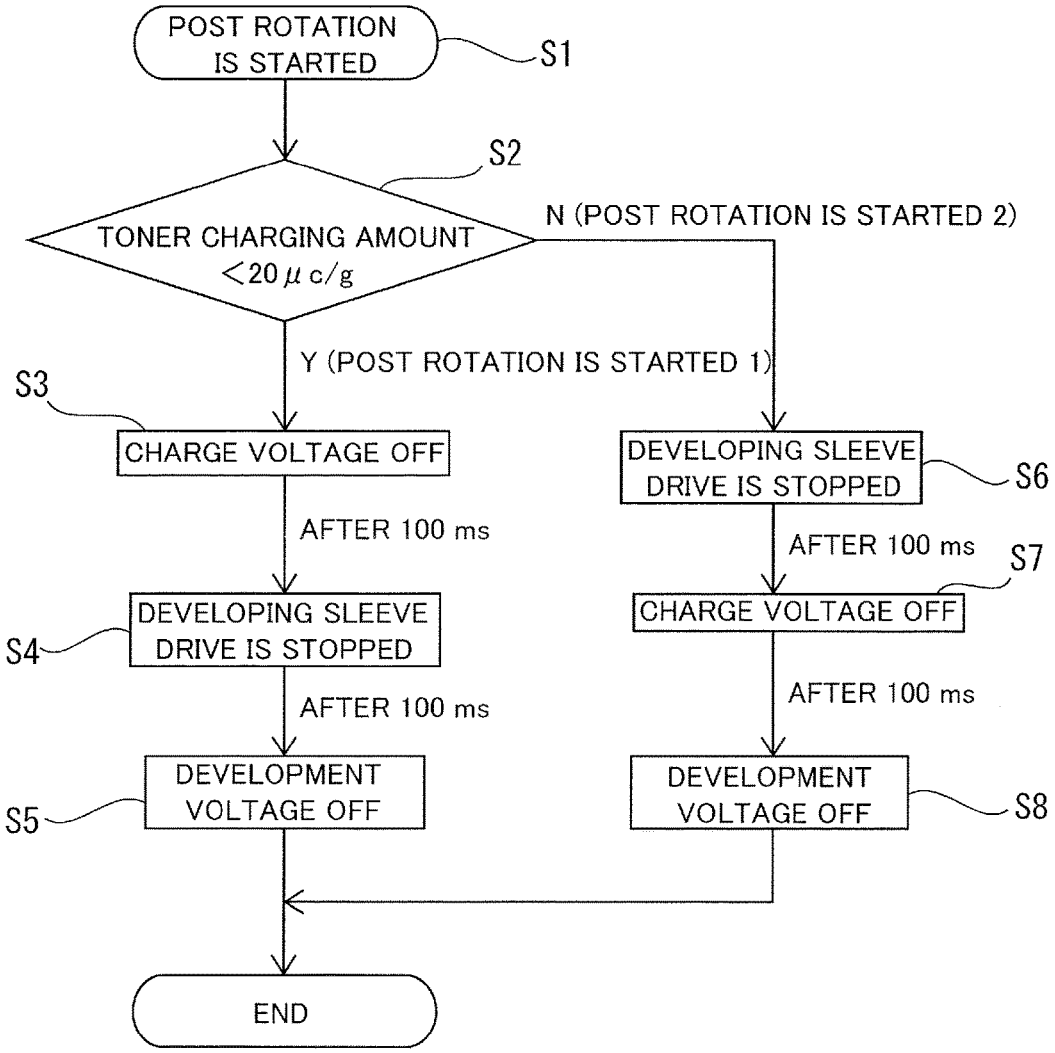
FIG. 5 is a flow chart of voltage falling control according to the first embodiment.

As illustrated in FIG. 5, when the operation of the post rotation is started according to the image formation completion (S1), the control portion 101 determines whether or not the charging amount of the toner is smaller than a predetermined charging amount (in the embodiment, 20 μc/g) (S2). The charging amount of the toner is, for example, the charging amount which is most recently detected. In addition, the post rotation mode is determined by comparing the detected charging amount of the toner and the predetermined charging amount which is stored in the storage portion 103 in advance. In other words, the control portion 101 can perform the post rotation mode 1 which is the first mode, and the post rotation mode 2 which is the second mode. In addition, the post rotation mode 1 and the post rotation mode 2 are switched in accordance with the toner charging amount.

In the embodiment, in a case (Y in S2) where the detected charging amount of the toner is smaller than the predetermined charging amount (smaller than 20 μc/g), it is determined that the sleeve adhesion of the toner is likely to occur, and the process moves to S3 (post rotation mode 1). On the contrary, in the case where the detected charging amount of the toner is equal to or greater than the predetermined charging amount (equal to or greater than 20 μc/g) (N in S2), it is determined that the sleeve adhesion of the toner is unlikely to occur, and the process moves to S6 (post rotation mode 2). It is noted that since the above-described predetermined charging amount is a value which is determined by the used developer, the value itself changes in accordance with a performing machine.

Next, a setting method of the electric field in the post rotation after S3 and S6 will be described. In the embodiment, in accordance with the state of the toner identified in S2 as described above, after S3 and S6, the timing when the development voltage and the charge voltage fall in the post rotation is changed.

Post Rotation Mode 1

Figure 6A:
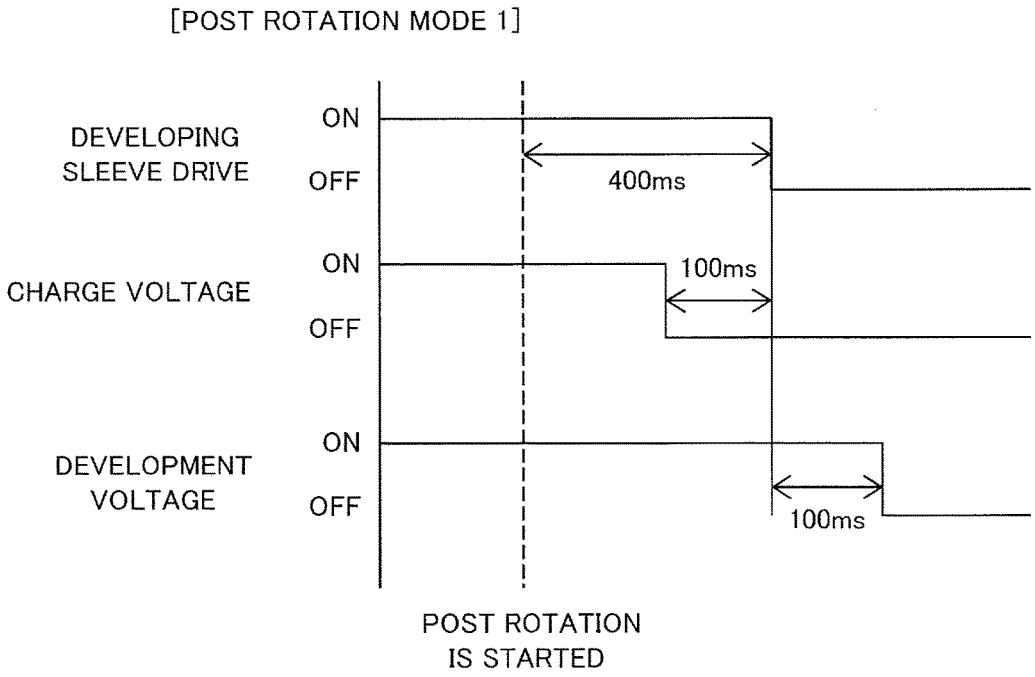
FIG. 6A is a timing chart of a post rotation mode 1 in the voltage falling control according to the first embodiment.
Figure 6B:
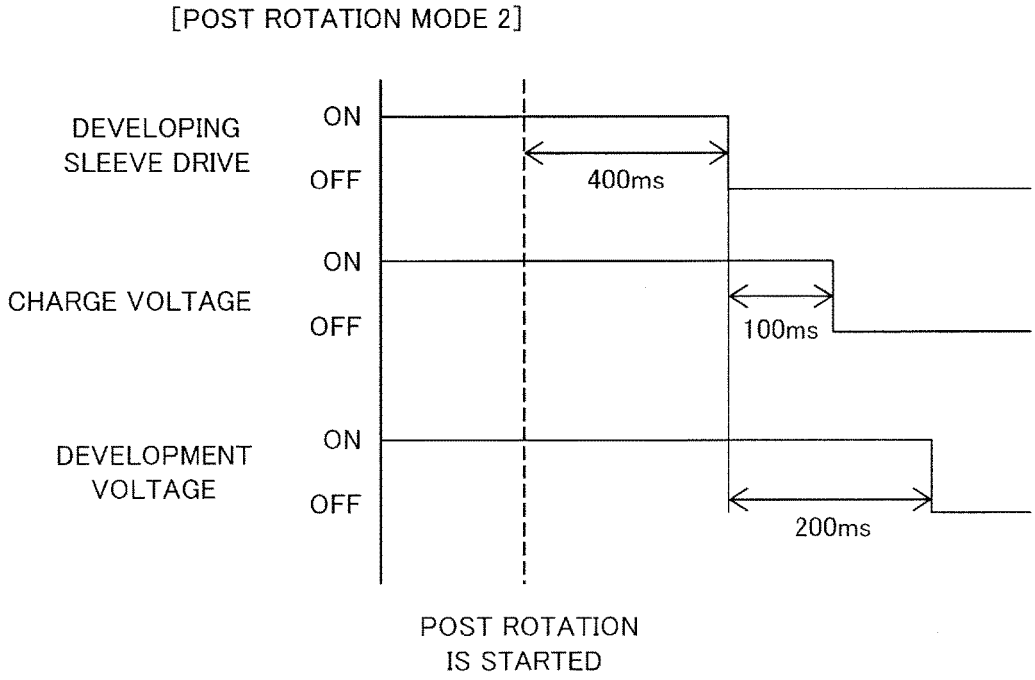
FIG. 6B is a timing chart of a post rotation mode 2 in the voltage falling control according to the first embodiment.
Figure 7A:
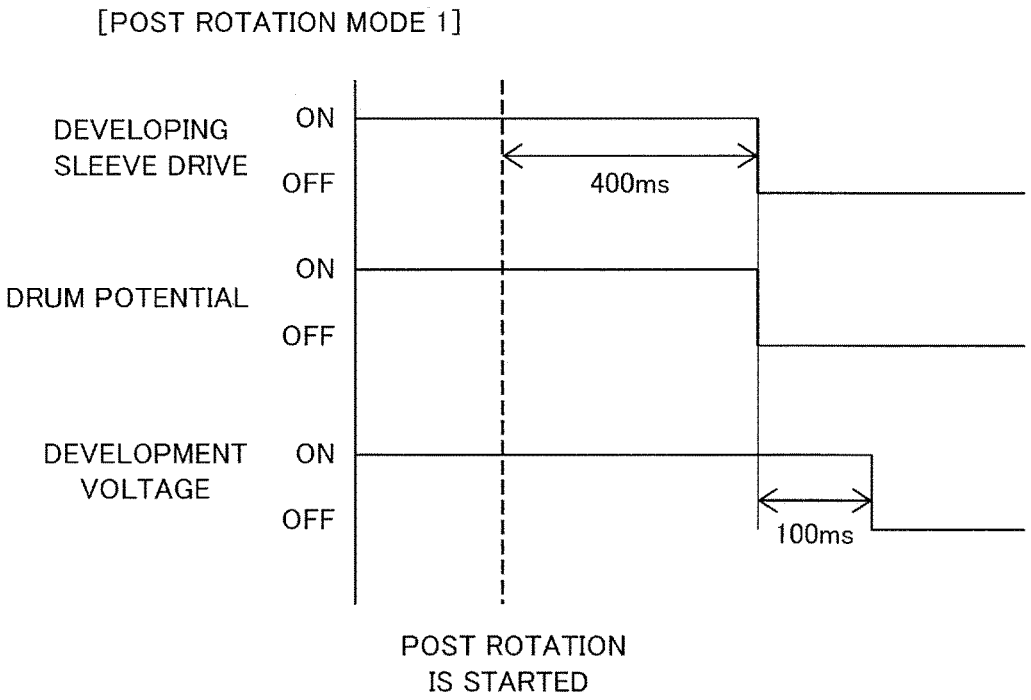
FIG. 7A is a timing chart of the post rotation mode 1 at a development position in the voltage falling control according to the first embodiment.
Figure 7B:
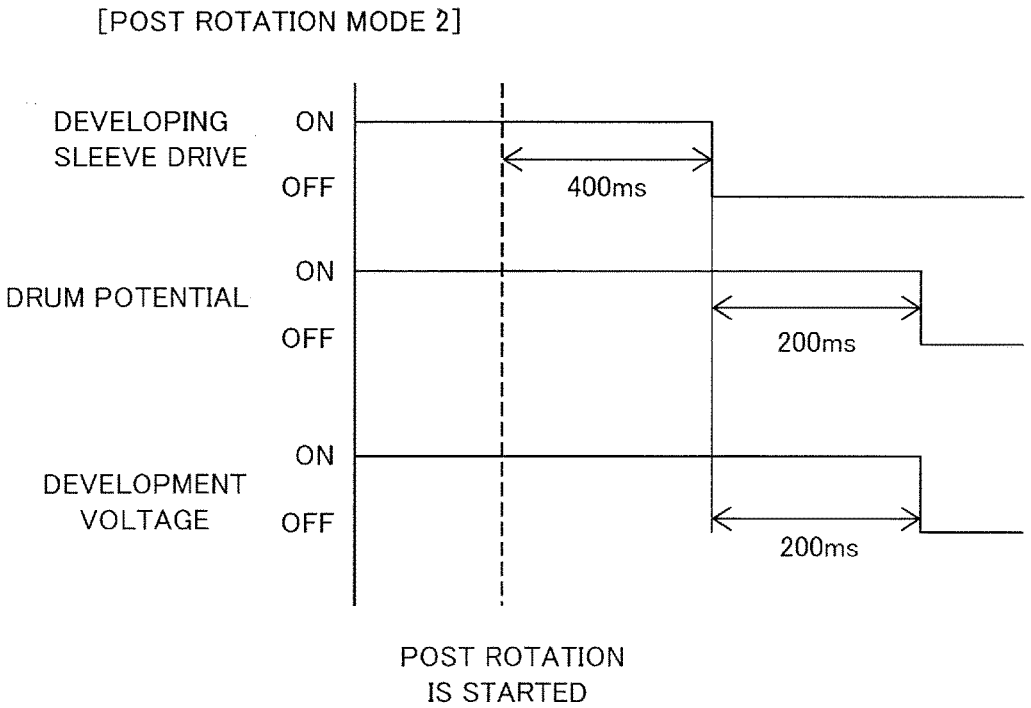
FIG. 7B is a timing chart of the post rotation mode 2 at the development position in the voltage falling control according to the first embodiment.

First, the post rotation mode 1 (after S3) which is the first mode will be described with reference to FIGS. 6A and 7A. It is noted that FIGS. 6A and 6B are timing charts of the stop of the rotation drive of the developing sleeve 41 (developing sleeve drive OFF), the application stop of the charge voltage by the charging roller 2Y (charge voltage OFF), and the application stop of the development voltage by the developing unit 4 (development voltage OFF). In other words, FIGS. 6A and 6B are timing charts of voltage falling of each portion. In addition, FIGS. 7A and 7B are timing charts illustrating that the timing of voltage falling of each portion at the development position (c) (FIG. 2). It is noted that since FIGS. 7A and 7B illustrate the states at the development position, the charge voltages of FIGS. 6A and 6B are replaced to the drum potential (charge potential). In other words, the states of the charge potential of the photoconductive drum 1Y at the development position are illustrated in FIGS. 7A and 7B.

In the post rotation mode 1, the rotation of the developing sleeve 41 is stopped (driving input is stopped) before or at the same time when a charging end portion (a trailing end of a charging area) on the photoconductive drum 1Y (on the image bearing member) at which the charging by the charging roller 2Y is stopped, i.e., a portion on the image bearing member which is located at the charging position when the charging by the charging unit is stopped, reaches the development position (c) that opposes the developing sleeve 41. In addition, after this, the application of the development voltage is stopped. In other words, in the post rotation mode 1, the driving input to the developer bearing member 41 is stopped in response to image formation completion before or at the same time when a trailing end of a charging area of the image bearing member 1Y charged by the charging unit 2Y reaches the development position (c), and an application of the development voltage is stopped after the trailing end of the charging area reaches the development position (c). In the embodiment, as illustrated in FIGS. 5 and 6A, first, the application of the charge voltage is stopped (S3), the drive of the developing sleeve 41 is stopped after 100 msec (S4), and finally, the application of the development voltage is stopped (S5). It is noted that, as illustrated in FIG. 6A, the drive of the developing sleeve 41 is stopped after 400 msec after the post rotation operation is started.

Here, since the distance from the charge position (a) to the development position (c) illustrated in FIG. 2 is 24 mm, and the rotational speed of the photoconductive drum 1Y is 240 mm/sec, the time lag corresponds to 100 msec. In other words, the time for moving from the charge position (a) on the photoconductive drum 1Y to the development position (c) becomes 100 msec. Therefore, the voltage fall timing as illustrated in FIG. 6A is shifted as illustrated in FIG. 7A at the development position. In other words, at the development position, the timing when the charging end portion (position of charge voltage OFF) which is located at the charging position (a) when the charging by the charging roller 2Y is stopped reaches the development position (drum potential OFF), and the timing when the developing sleeve 41 is stopped, become the same as each other. In addition, the development voltage after a predetermined time (here, 100 msec) of the timing becomes OFF. In other words, in the post rotation mode 1, the application of the development voltage is stopped at the timing when the predetermined time elapses after the charging end portion reaches the development position.

In this manner, in the post rotation mode 1, the drum potential at the development position becomes OFF at the timing when the rotation drive of the developing sleeve 41 is stopped, and the development voltage after this becomes OFF. Therefore, during the predetermined time (100 msec) from the drum potential OFF until the development voltage becomes OFF, the electric field (that is, voltage on the fogging side) is applied to move the toner on the developing sleeve 41 to the photoconductive drum 1Y. Then, as illustrated in FIG. 4B, the toner 48 does not adhere to the surface of the developing sleeve 41 when the developing sleeve is stopped, a state where the toner 48 is uniformly adhered to the carrier 49 can be held, and occurrence of the toner adhesion onto the developing sleeve 41 can be suppressed.

It is noted that, in the embodiment, an example in which the timing when the drum potential becomes OFF and the timing when the developing sleeve 41 is stopped become the same as each other at the development position, is illustrated. However, it is not necessary that the timings are the same as each other, and the timing when the developing sleeve 41 is stopped can be set before the drum potential becomes OFF. In other words, the rotation of the developing sleeve 41 may be stopped before the charging end portion reaches the development position. In addition, the timing when the developing sleeve 41 is stopped may be the time when the image formation is completed (time when the post rotation is started). Therefore, the stop timing of the developing sleeve 41 may be within a time period from the time when the image formation is completed to the time when the drum potential becomes OFF.

In this case, from the time when the developing sleeve 41 is stopped to the time when the drum potential becomes OFF, Vback is applied to a certain position of the developing sleeve 41. Therefore, the toner adhesion slightly occurs in the developing sleeve 41. However, after this, as the positional relationship between the drum potential and the development voltage is reversed (potential is applied to the fogging side), the toner adhesion to the developing sleeve 41 is eliminated. On the contrary, a case where the developing sleeve 41 is also rotated after the drum potential becomes OFF is not preferable since the potential is applied to the fogging side while the developing sleeve 41 rotates, and a large amount of toner is consumed.

Post Rotation Mode 2

Next, the post rotation mode 2 (after S6) which is the second mode will be described with reference to FIGS. 6B and 7B. In the post rotation mode 2, the application of the development voltage is stopped at substantially the same time when the charging end portion on the photoconductive drum 1Y (on the image bearing member) at which the charging by a charging roller 2 is stopped reaches the development position (c) that opposes the developing sleeve 41. In addition, the rotation of the developing sleeve 41 is stopped before or at the same time when the charging end portion reaches the development position (c) (driving input is stopped). In other words, in the post Rotation mode 2, the driving input to the developer bearing member 41 is stopped in response to image formation completion before or at the same time when the trailing end of the charging area reaches the development position 1Y, and the application of the development voltage is stopped at a timing after the trailing end of the charging area reaches the development position (c) and earlier than that in the post Rotation mode 1, or at the same time when the trailing end of the charging area reaches the development position (c). In the embodiment, as illustrated in FIGS. 5 and 6B, the drive of the developing sleeve 41 is stopped after 400 msec from starting the post rotation operation (S6), and the application of the charge voltage is stopped after 100 msec (S7). Furthermore, the application of the development voltage is stopped after further 100 msec (S8). A case where the timing of FIG. 6B is illustrated at the development position is illustrated in FIG. 7B. In other words, at the development position, after 200 msec after the drive of the developing sleeve 41 is stopped, the drum potential and the development voltage become OFF at substantially the same time.

In the post rotation mode 2, during a time period from the time when the rotation drive of the developing sleeve 41 is stopped to the time when the charge voltage and the development voltage become OFF, the electric field is applied to move the toner on the developing sleeve 41 to the developing sleeve 41 side by Vback. Therefore, it is possible to suppress consumption of the toner.

It is noted that preferably, the timings when the drum potential and the development voltage become OFF become completely the same as each other at the development position (c) in order to avoid the carrier adhesion or the fogging. However, when considering irregularity of a control signal or irregularity of characteristics of high voltage output of a high voltage power source, it is preferable that the control timing is set to slightly (for example, approximately equal to or less than 50 msec) delay setting the development voltage to be OFF. Accordingly, it is possible to avoid the carrier adhesion which largely influences transferring or cleaning. In this case, slight fogging occurs, but since the extent of the fogging occurred is extremely slight when the time is extremely short, there is not a problem when the timings are set to be substantially the same as each other. However, in the post rotation mode 2, the application of the development voltage is stopped at the timing (within a predetermined time) which is earlier than that in the post rotation mode 1 after the charging end portion reaches the development position, and the toner consumption is suppressed compared to the post rotation mode 1.

In addition, in the description above, a case where the drum potential and the development voltage become OFF at the same time after the rotation drive of the developing sleeve 41 is stopped at the development position (c), is illustrated. However, at the development position (c), the rotation drive of the developing sleeve 41 may be stopped and the drum potential and the development voltage may become OFF at the same time. Furthermore, the timing when the rotation drive of the developing sleeve 41 is stopped may be a timing after the drum potential and the development voltage become OFF at substantially the same time at the development position (c). This is because the fogging does not occur even when the developing sleeve 41 is rotated since the electric field does not act between the developing sleeve 41 and the photoconductive drum 1Y in a state where the drum potential and the development voltage are OFF. However, in the case where the timing when the development voltage becomes OFF is controlled to be slightly later than the timing when the drum potential becomes OFF at the development position (c), it is preferable that the drive of the developing sleeve 41 is stopped before the development voltage and the drum potential become OFF.

Figure 8A:
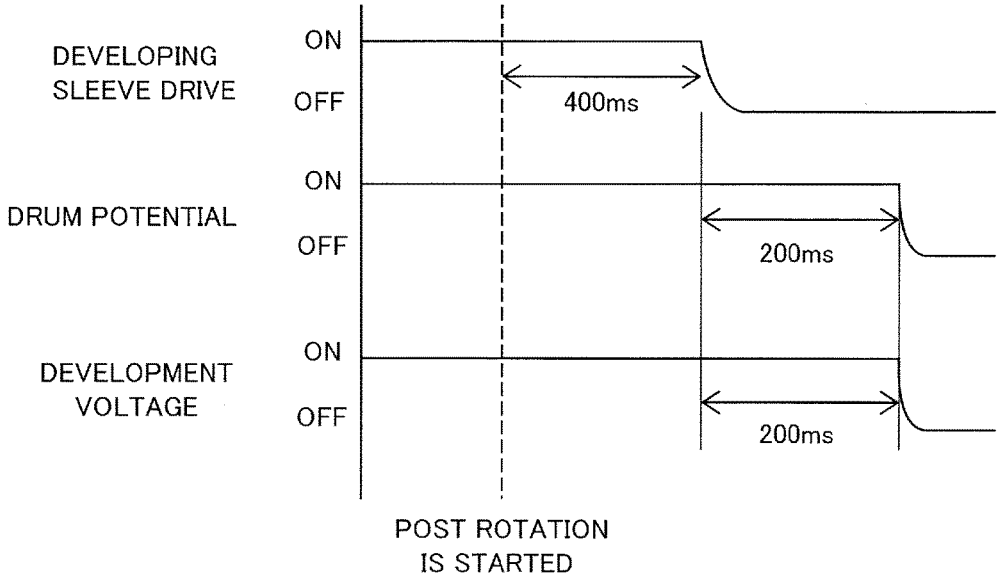
FIG. 8A is a timing chart at the development position illustrating that the falling of each portion takes time in the post rotation mode 2.

In addition, as illustrated in FIG. 8A, as an operation of the apparatus in reality, a phenomenon occurs in which the developing sleeve 41 slightly continuously rotates by inertia even when the drive is stopped. In addition, a phenomenon occurs in which the falling of the charge voltage (drum potential) or the development voltage takes time due to the influence of electrostatic capacity of the high voltage power source even when the application of the voltage is stopped. In particular, regarding the falling of the high voltage power source, stability of the relationship between the drum potential and the development voltage cannot be ensured.

Figure 8B:
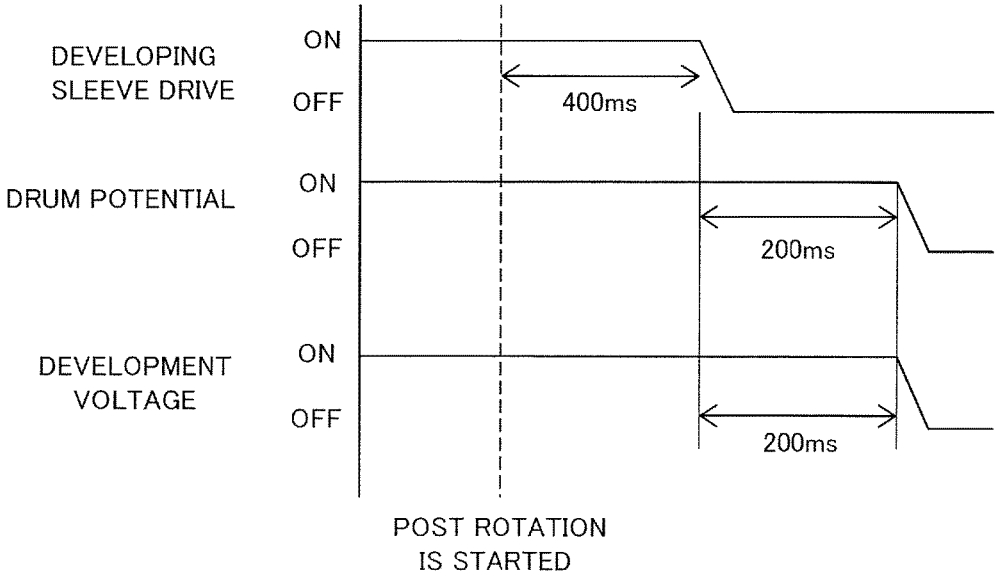
FIG. 8B is a timing chart at the development position in the case where the voltage falling control is performed with respect to each portion in the post rotation mode 2.

Here, as illustrated in FIG. 8B, a voltage falling method while controlling the charge voltage (drum potential), the development voltage, and the drive of the developing sleeve, can be employed. For example, the control of falling by a predetermined potential (for example, by 5 V) is performed while maintaining a state where the relationship between the drum potential and the development voltage is similar to the description above. In addition, regarding the driving stop of the developing sleeve, the control of electrically applying a brake by applying a reverse current to a circuit of a motor, or by making the circuit short, is performed. By using the control, since the potential difference Vback between the drum potential and the development voltage is particularly stabilized, it is possible to avoid the carrier adhesion when the voltage falls, and to stably perform the control of the fogging amount. It is noted that, in FIGS. 8A and 8B, the post rotation mode 2 is illustrated, but the post rotation mode 1 is also similar to the post rotation mode 2.

In the embodiment, the post rotation mode 1 in which the toner adhesion to the developing sleeve 41 is unlikely to occur, and the post rotation mode 2 in which unnecessary consumption of the toner due to the fogging can be suppressed, are switched based on the information which influences the toner charging amount. Specifically, the operation of the post rotation is changed in accordance with the charging amount of the toner in the development container 40. Therefore, both the suppression of generation of the belt-like image due to the toner adhesion to the developing sleeve 41, and the suppression of unnecessary consumption of the toner, can be achieved.

Second Embodiment

A second embodiment will be described by using FIG. 9 with reference to FIGS. 1 to 3. In the above-described first embodiment, the post rotation mode 1 and the post rotation mode 2 are switched in accordance with the charging amount of the toner, but in the embodiment, the switching is performed in accordance with the rotation amount of the developing sleeve 41 which is the information which influences the toner charging amount. In particular, in the embodiment, the switching is performed in accordance with the number of rotations of the developing sleeve 41. It is noted that other than the number of rotations, for example, rotation time may be employed as the rotation amount of the developing sleeve 41. In addition, since any factor may be employed if the deterioration situation of the carrier can be determined, the switching may be performed in accordance with the rotation amount (the number of rotations, rotation time) of the screws 43 and 44 in the developing unit 4. In any cases, a method of stopping (voltage falling) the development voltage and the charge voltage by the operation (post rotation) from the time when the image forming operation is completed to the time when the main body is stopped, is changed in accordance with the rotation amount of the developing sleeve 41.

As described above, the charging amount of the toner and the carrier is charged by the frictional charge, but by the use for a long period of time, the charging performance of the carrier deteriorates. Here, in the embodiment, the timing when the development voltage and the charge voltage fall is changed based on the use state of the developer. The deterioration situation of the carrier due to the use for a long period of time can be ascertained from the rotation amount (here, the total number of rotations) of the developing sleeve 41. In other words, since the charging characteristics of the developer deteriorate in the case where the rotation amount (total number of rotations) of the developing sleeve 41 is greater than a predetermined upper limit rotation amount (predetermined upper limit number of rotations), it is determined that the toner adhesion to the developing sleeve 41 is likely to occur. Meanwhile, in the case where the rotation amount (total number of rotations) of the developing sleeve 41 is equal to or smaller than the predetermined upper limit rotation amount (equal to or smaller than the predetermined upper limit number of rotations), the charging characteristics of the developer are maintained, and it is determined that the toner adhesion to the developing sleeve 41 is unlikely to occur.

Therefore, in the embodiment, the storage portion 103 which is illustrated in FIG. 3 and serves as a storage portion, integrally stores, i.e., integrates and stores, the rotation amount (the total number of rotations) of the developing sleeve 41. In addition, the control portion 101 switches the post rotation mode 1 and the post rotation mode 2 in accordance with the total number of rotations stored in the storage portion 103. In other words, the control portion 101 performs the post rotation mode 1 in the case where the total number of rotations of the developing sleeve 41 is greater than the predetermined upper limit number of rotations, and the post rotation mode 2 in the case where the total number of rotations of the developing sleeve 41 is equal to or less than the predetermined upper limit number of rotations.

Hereinafter, the voltage falling control in the embodiment will be specifically described. In the embodiment, the deterioration situation of the developer in the development container 40 is assumed from the rotation amount of the developing sleeve 41, and in accordance with this, the voltage falling method of the development voltage and the charge voltage by the operation (post rotation) from the time when the image forming operation is completed to the time when the main body is stopped, is changed.

Figure 9:
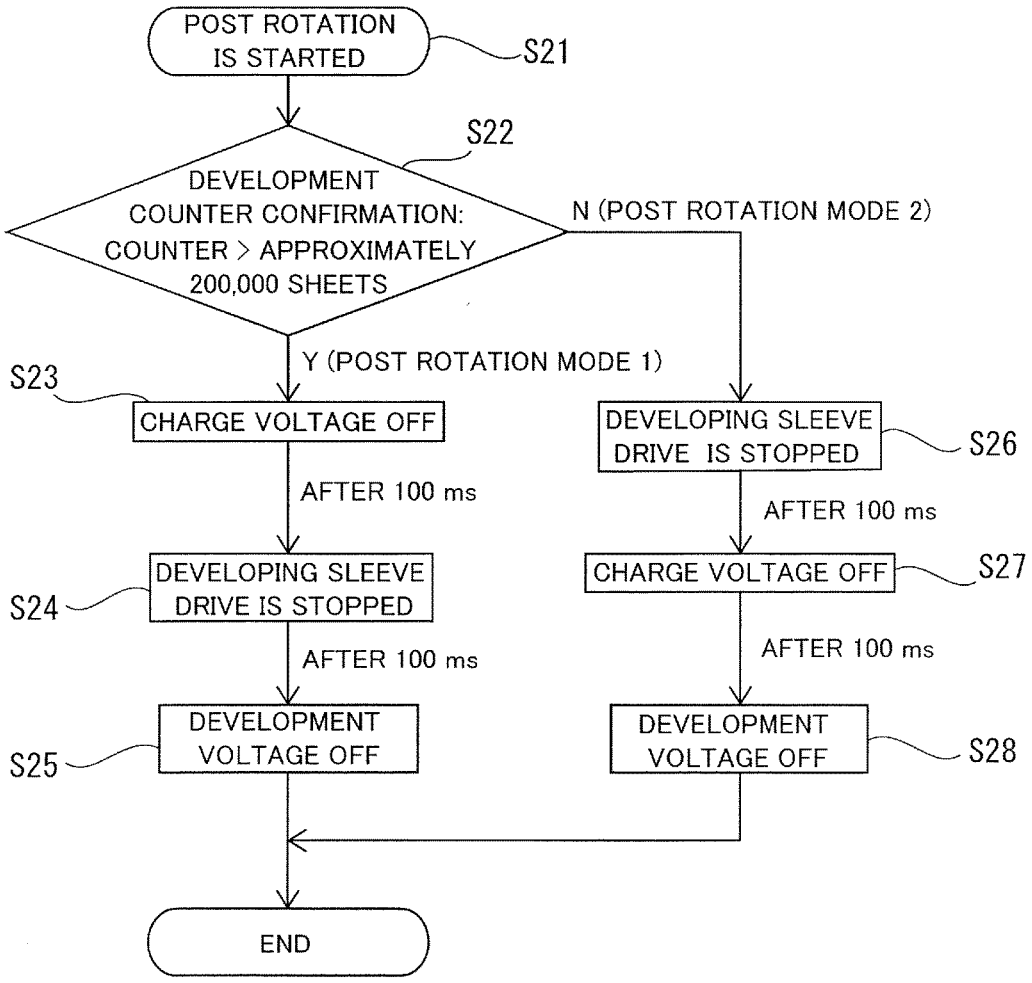
FIG. 9 is a flow chart of voltage falling control according to a second embodiment.

As illustrated in FIG. 9, when the operation of the post rotation is started according to the image formation completion (S21), the control portion 101 obtains the total number (counter) of rotations of the developing sleeve 41 from the storage portion 103 (development counter confirmation). In addition, it is determined whether or not the counter is greater than the predetermined upper limit number of rotations stored in the storage portion 103 in advance, and the mode of the post rotation is determined (S22). In the embodiment, for example, the predetermined upper limit number of rotations is set to be a case where the image formation is performed on approximately 200,000 sheets on a paper sheet having a longitudinal size of A4. Next, in a case (Y in S22) where the counter is greater than the predetermined upper limit number of rotations (greater than approximately 200,000 sheets), it is determined that the sleeve adhesion of the toner is likely to occur, and the process moves to S23 (post rotation mode 1). On the contrary, in the case (N in S22) where the counter is equal to or less than the predetermined upper limit rotation amount (equal to or less than approximately 200,000 sheets), it is determined that the sleeve adhesion of the toner is unlikely to occur, and the process moves to S26 (post rotation mode 2).

It is noted that since a value which corresponds to approximately 200,000 sheets which is a developer deterioration standard used here, is a value which is determined by the used developer, the value itself changes in accordance with a performing machine. In addition, the detailed description of the control after S23 and S26 will be omitted since the processes after S23 and S26 are respectively similar to those after S3 and S6 illustrated in FIG. 5 of the first embodiment.

In the embodiment, the post rotation mode 1 and the post rotation mode 2 are switched in accordance with the total number of rotations of the developing sleeve 41. Therefore, similar to the first embodiment, both the suppression of generation of the belt-like image due to the toner adhesion to the developing sleeve 41, and the suppression of unnecessary consumption of the toner, can be achieved. Other configuration elements and effects are similar to those in the first embodiment.

Third Embodiment

A third embodiment will be described by using FIG. 10 with reference to FIGS. 1 to 3. In the above-described first embodiment, the post rotation mode 1 and the post rotation mode 2 are switched in accordance with the charging amount of the toner, but in the embodiment, the switching is performed in accordance with humidity or moisture content in the periphery of the developing unit 4Y as the information which influences the toner charging amount. In particular, in the embodiment, the switching is performed in accordance with relative humidity in the periphery of the developing unit 4Y.

The toner adhesion to the developing sleeve 41 receives the influence on the charging amount of the toner as described above, but the charging amount of the toner receives the influence of the relative humidity of the environment where the developing unit 4Y is installed. Since the charging of the toner is performed by the frictional charging of the carrier and the toner, there is a tendency that the charging amount of the toner decreases when the humidity is high. Therefore, in the embodiment, by detecting the relative humidity in the periphery of the developing unit 4, in accordance with this, the falling of the development voltage and the charge voltage is changed. In addition, in the environment of high humidity where the sleeve adhesion is likely to occur, the voltage on the fogging side is changed when the voltage falls. On the contrary, in the environment of low humidity where the sleeve adhesion is unlikely to occur, unnecessary consumption of the toner is suppressed by setting the falling condition in which the fogging is unlikely to occur.

In this manner, in the embodiment, as illustrated in FIG. 1, a temperature and humidity sensor 50 which serves as a humidity detection portion is disposed in the apparatus body of the image forming apparatus 100. In addition, the control portion 101 switches the post rotation mode 1 and the post rotation mode 2 in accordance with the relative humidity detected by the temperature and humidity sensor 50. In other words, the post rotation mode 1 is performed in the case where the relative humidity (humidity or moisture content) is higher than predetermined upper limit relative humidity (predetermined upper limit humidity or moisture content), and the post rotation mode 2 is performed in the case where the relative humidity is equal to or lower than the predetermined upper limit relative humidity (equal to or lower than predetermined upper limit humidity or moisture content).

Hereinafter, the voltage falling control in the embodiment will be specifically described. In the embodiment, the charging amount of the toner in the developing unit 4 is assumed by detecting the relative humidity in the periphery of the developing unit 4, and in accordance with this, the voltage falling method of the development voltage and the charge voltage by the operation (post rotation) from the time when the image forming operation is completed to the time when the main body is stopped, is changed.

Figure 10:
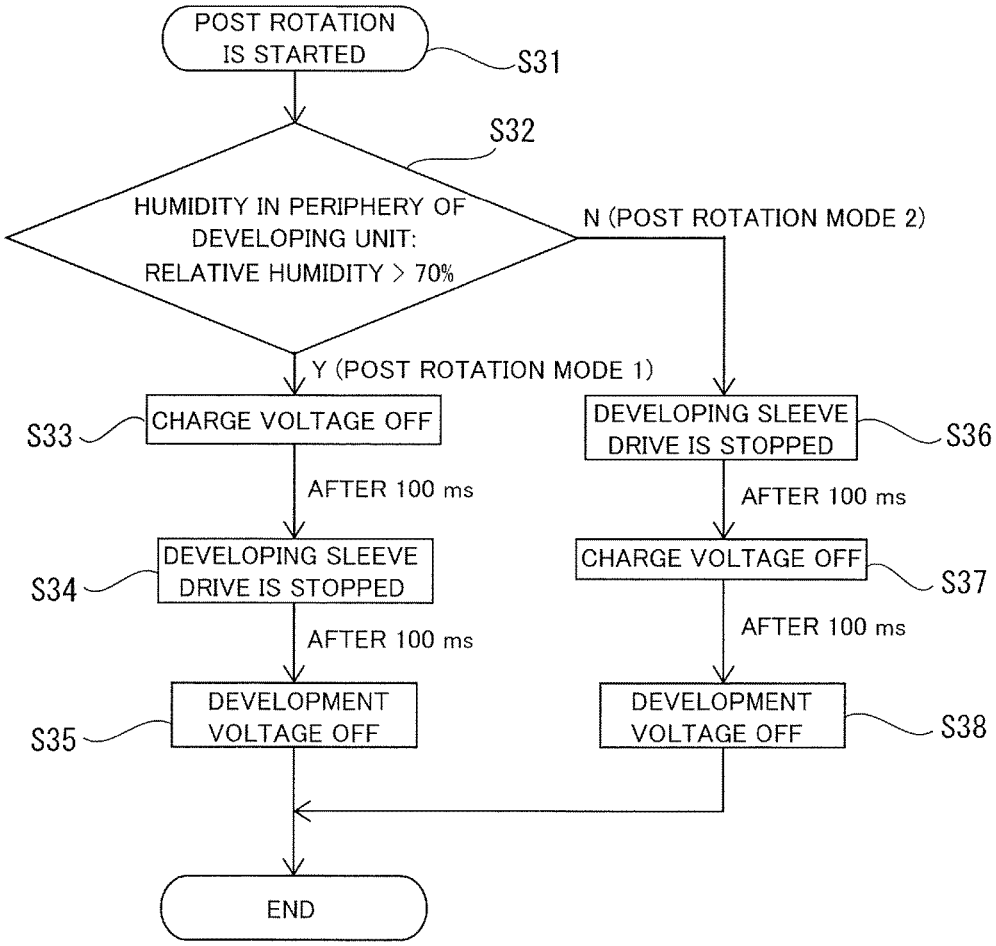
FIG. 10 is a flow chart of voltage falling control according to a third embodiment.

As illustrated in FIG. 10, when the operation of the post rotation is started according to the image formation completion (S31), the control portion 101 detects the relative humidity in the periphery of the developing unit 4 by the temperature and humidity sensor 50. In addition, it is determined whether or not the detected relative humidity is higher than the predetermined upper limit relative humidity (70% in the embodiment), and the mode of the post rotation is determined (S32). Next, in a case (Y in S32) where the detected relative humidity is higher than the predetermined upper limit relative humidity (higher than 700), it is determined that the sleeve adhesion of the toner is likely to occur, and the process moves to S33 (post rotation mode 1). On the contrary, in the case (N in S32) where the detected relative humidity is equal to or lower than the predetermined upper limit relative humidity (equal to or lower than 700), it is determined that the sleeve adhesion of the toner is unlikely to occur, and the process moves to S36 (post rotation mode 2).

It is noted that, in the embodiment, the operation of the post rotation is switched by using the relative humidity, which is set to be 70%, as a boundary, but since the value of the humidity of switching changes according to the used developer, the most appropriate value changes in accordance with the developer. In addition, there is a developer in which the charging amount changes in accordance with not the relative humidity but the moisture content in the environment, and at this time, it is possible to obtain similar effects by the switching in accordance with not the relative humidity but the moisture content. In addition, the description of the control after S33 and S36 will be omitted since the processes after S33 and S36 are respectively similar to those after S3 and S6 illustrated in FIG. 5 of the first embodiment.

In the embodiment, the post rotation mode 1 and the post rotation mode 2 are switched in accordance with the environment in the periphery of the developing unit 4Y. Therefore, similar to the first embodiment, both the suppression of generation of the belt-like image due to the toner adhesion to the developing sleeve 41, and the suppression of unnecessary consumption of the toner, can be achieved. Other configuration elements and effects are similar to those in the first embodiment.

Fourth Embodiment

Figure 11:
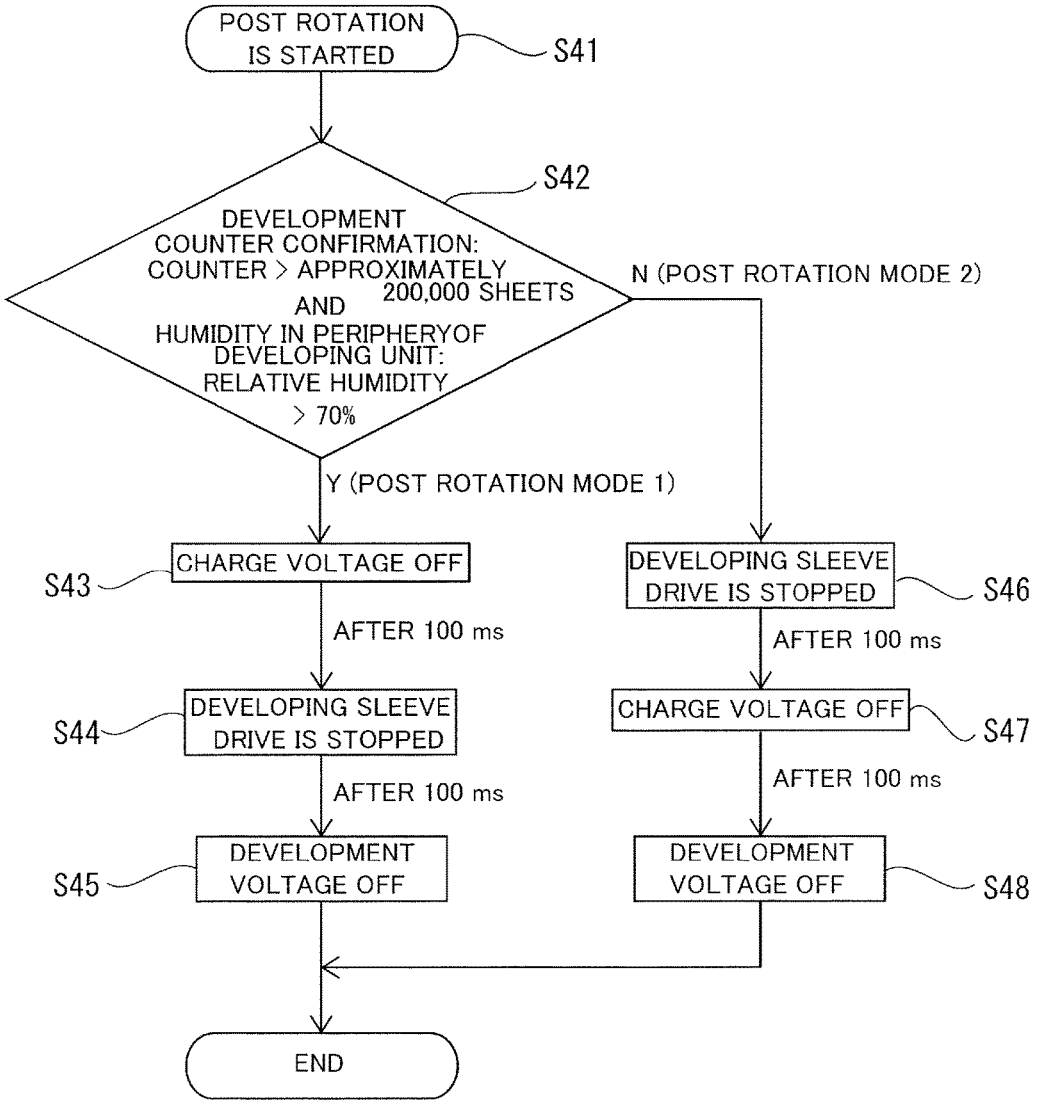
FIG. 11 is a flow chart of voltage falling control according to a fourth embodiment.

A fourth embodiment will be described by using FIG. 11 with reference to FIGS. 1 to 3. An example in which the post rotation mode 1 and the post rotation mode 2 are switched in accordance with the rotation amount of the developing sleeve 41 is illustrated in the above-described second embodiment, and an example in which the post rotation mode 1 and the post rotation mode 2 are switched in accordance with the humidity or the moisture content in the periphery of the developing unit 4Y is illustrated in the above-described third embodiment, respectively. Meanwhile, in the embodiment, the switching is performed in accordance with both the rotation amount of the developing sleeve 41 and the humidity or the moisture content in the periphery of the developing unit 4Y.

Therefore, in the embodiment, similar to the second embodiment, the storage portion 103 integrally stores the rotation amount (the total number of rotations) of the developing sleeve 41. In addition, similar to the third embodiment, the temperature and humidity sensor 50 which serves as the humidity detection portion is disposed in the apparatus body of the image forming apparatus 100. In addition, the control portion 101 switches the post rotation mode 1 and the post rotation mode 2 in accordance with the rotation amount (total number of rotations) stored in the storage portion 103, and the humidity or the moisture content (relative humidity) detected by the temperature and humidity sensor 50. In other words, the post rotation mode 1 is performed in the case where the rotation amount stored in the storage portion 103 is greater than the predetermined upper limit rotation amount, and the humidity or the moisture content detected by the temperature and humidity sensor 50 is higher than the predetermined upper limit humidity or moisture content. Meanwhile, the post rotation mode 2 is performed in other cases.

Hereinafter, the voltage falling control in the embodiment will be specifically described. As illustrated in FIG. 11, when the operation of the post rotation is started according to the image formation completion (S41), the control portion 101 obtains the total number of rotations (counter) of the developing sleeve 41 from the storage portion 103 (development counter confirmation). In addition, the control portion 101 detects the relative humidity in the periphery of the developing unit 4 by the temperature and humidity sensor 50. In addition, it is determined whether or not the counter (rotation amount) is greater than the predetermined upper limit number of rotations (predetermined upper limit rotation amount) stored in the storage portion 103 in advance. In addition, at the same time, it is determined whether or not the detected relative humidity (humidity or moisture content) is higher than the predetermined upper limit relative humidity (the predetermined upper limit humidity or moisture content), and the mode of the post rotation is determined (S42). In the embodiment, for example, the predetermined upper limit number of rotations is also set to be a case where the image formation is performed on approximately 200,000 sheets on a paper sheet having a longitudinal size of A4. In addition, the predetermined upper limit relative humidity is set to be 70%.

Next, in a case (Y in S42) where the counter is greater than the predetermined upper limit number of rotations (greater than approximately 200,000 sheets), and the detected relative humidity is higher than the predetermined upper limit relative humidity (higher than 70%), the process moves to S43 (post rotation mode 1). In the case where any one of the conditions is not satisfied (N in S42), the process moves to S46 (post rotation mode 2). It is noted that the detailed description of the control after S43 and S46 will be omitted since the processes after S43 and S46 are respectively similar to those after S3 and S6 illustrated in FIG. 5 of the first embodiment.

In the embodiment, it is possible to further limit a state where the sleeve adhesion of the toner occurs by the total number of rotations of the developing sleeve 41 and the environment in the periphery of the developing unit 4. As a result, since frequency of performing the post rotation mode 1 in which the toner is discharged is decreased, it is possible to further suppress consumption of the toner. Other configuration elements and effects are similar to those in the second and the third embodiments.

Fifth Embodiment

A fifth embodiment will be described by using FIGS. 12 to 14B with reference to FIGS. 1 to 3. In the above-described first to fourth embodiments, by changing the voltage falling method in the post rotation, both the suppression of the sleeve adhesion of the toner and the suppression of unnecessary consumption of the toner, can be achieved. Meanwhile, in the embodiment, it is possible to obtain similar effects by changing the rising method of the charge voltage and the development voltage in the pre-rotation.

In other words, the toner adhesion to the developing sleeve also occurs due to the potential difference between the developing sleeve and the photoconductive drum when the voltage rises (when the application of the voltage is started) according to the image formation start. In addition, the occurrence situation is largely caused by the toner charging amount at this time. Therefore, the control portion 101 can perform the pre-rotation mode 1 which is the first mode and the pre-rotation mode 2 which is the second mode. In addition, the pre-rotation mode 1 and the pre-rotation mode 2 are switched based on the information which influences the toner charging amount.

Specifically, under a condition that the toner adhesion to the developing sleeve 41 is likely to occur, the pre-rotation mode 1 in which the development voltage rises in advance, and then, the charge voltage (drum potential) rises at the development position (c) when the rotation of the developing sleeve 41 is started, is performed. Accordingly, the potential relationship between Vd and Vdc is reversed to that in the image formation, and the potential between the developing sleeve 41 and the photoconductive drum 1 is set to be the potential on the fogging side. By performing the voltage rising control, as illustrated in FIG. 4B, the toner 48 does not adhere to the surface of the developing sleeve 41 when the rotation of the developing sleeve 41 is started, and a state where the toner 48 is uniformly adhered to the carrier 49 can be maintained.

Meanwhile, under a condition that the toner adhesion to the developing sleeve 41 is unlikely to occur, the pre-rotation mode 2 in which the charge voltage (drum potential) and the development voltage rise at substantially the same time at the development position (c) when the rotation of the developing sleeve 41 is started, is performed. By performing the voltage rising control, it is possible to suppress occurrence of the fogging toner, to suppress unnecessary consumption of the toner, and to avoid a phenomenon, such as toner scattering.

The voltage rising control in the embodiment will be specifically described. In the embodiment, in accordance with both the rotation amount of the developing sleeve 41 and the humidity or the moisture content in the periphery of the developing unit 4Y, a method of starting (rising) the application of the development voltage and the charge voltage by the operation (pre-rotation) from the operation start of each portion to the image formation start, is changed.

Therefore, in the embodiment, similar to the second embodiment, the storage portion 103 integrally stores the rotation amount (the total number of rotations) of the developing sleeve 41. In addition, similar to the third embodiment, the temperature and humidity sensor 50 which serves as the humidity detection portion is disposed in the apparatus body of the image forming apparatus 100. In addition, the control portion 101 switches the pre-rotation mode 1 and the pre-rotation mode 2 in accordance with the rotation amount (total number of rotations) stored in the storage portion 103, and the humidity or the moisture content (relative humidity) detected by the temperature and humidity sensor 50 when the image formation is started. In other words, the pre-rotation mode 1 is performed in the case where the rotation amount stored in the storage portion 103 is greater than the predetermined upper limit rotation amount, and the humidity or the moisture content detected by the temperature and humidity sensor 50 is higher than the predetermined upper limit humidity or moisture content. Meanwhile, the pre-rotation mode 2 is performed in other cases.

Figure 12:
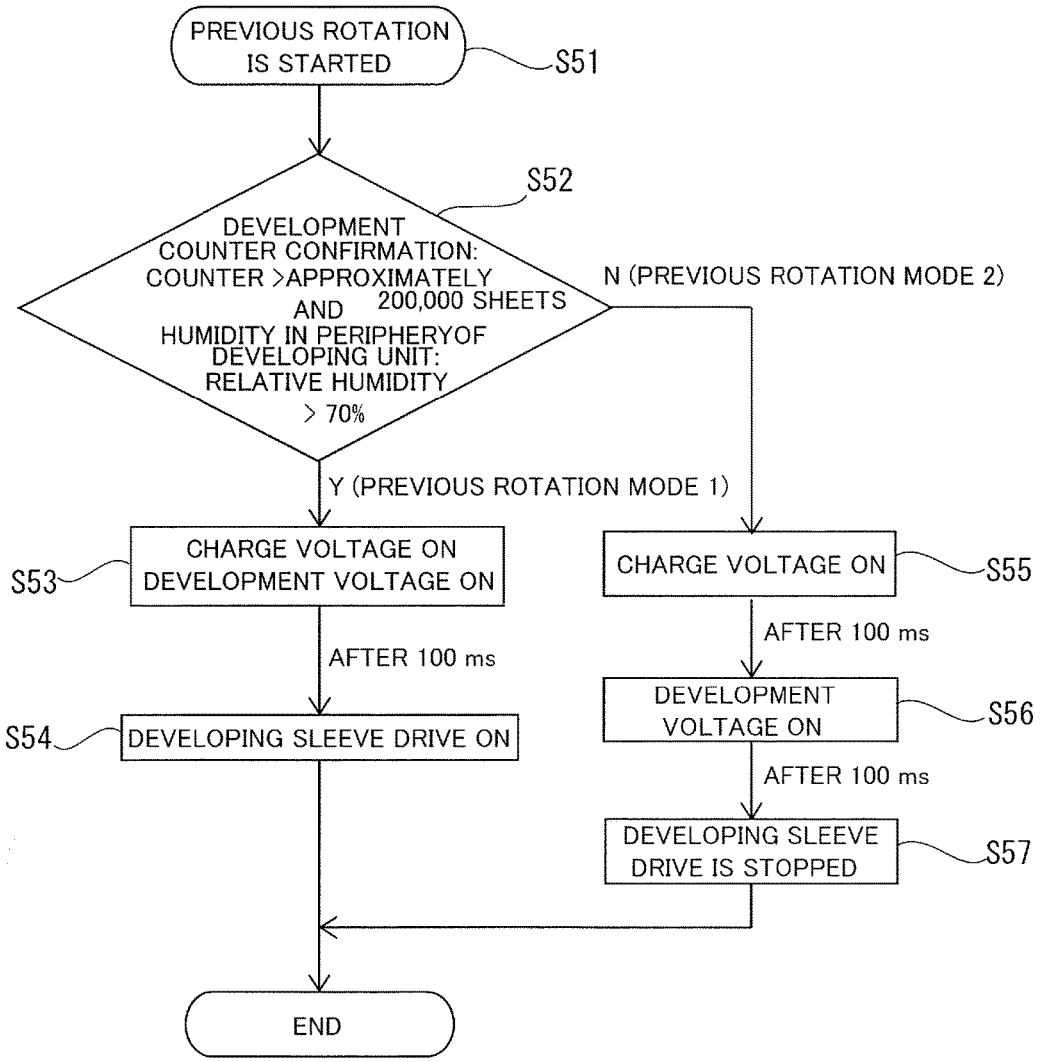
FIG. 12 is a flowchart of voltage rising control according to a fifth embodiment.

Hereinafter, the voltage rising control in the embodiment will be specifically described. As illustrated in FIG. 12, when the operation of the pre-rotation is started according to the image formation start (S51), the control portion 101 obtains the total number of rotations (counter) of the developing sleeve 41 from the storage portion 103 (development counter confirmation). In addition, the control portion 101 detects the relative humidity in the periphery of the developing unit 4Y by the temperature and humidity sensor 50. In addition, it is determined whether or not the counter (rotation amount) is greater than the predetermined upper limit number of rotations (predetermined upper limit rotation amount) stored in the storage portion 103 in advance. In addition, at the same time, it is determined whether or not the detected relative humidity (humidity or moisture content) is higher than the predetermined upper limit relative humidity (predetermined upper limit humidity or moisture content), and the mode of the pre-rotation is determined (S52). In the embodiment, for example, the predetermined upper limit number of rotations is also set to be a case where the image formation is performed on approximately 200,000 sheets on a paper sheet having a longitudinal size of A4. In addition, the predetermined upper limit relative humidity is set to be 70%.

Next, in a case (Y in S52) where the counter is greater than the predetermined upper limit number of rotations (greater than approximately 200,000 sheets), and the detected relative humidity is higher than the predetermined upper limit relative humidity (higher than 70%), the process moves to S53 (pre-rotation mode 1). In the case where any one of the conditions is not satisfied (N in S52), the process moves to S55 (pre-rotation mode 2).

Next, a setting method of the electric field in the pre-rotation after S53 and S55 will be described. In the embodiment, in accordance with the state of the toner identified in S52 as described above, after S53 and S55, the timing when the development voltage and the charge voltage rise in the pre-rotation is changed.

Pre-Rotation Mode 1

Figure 13A:
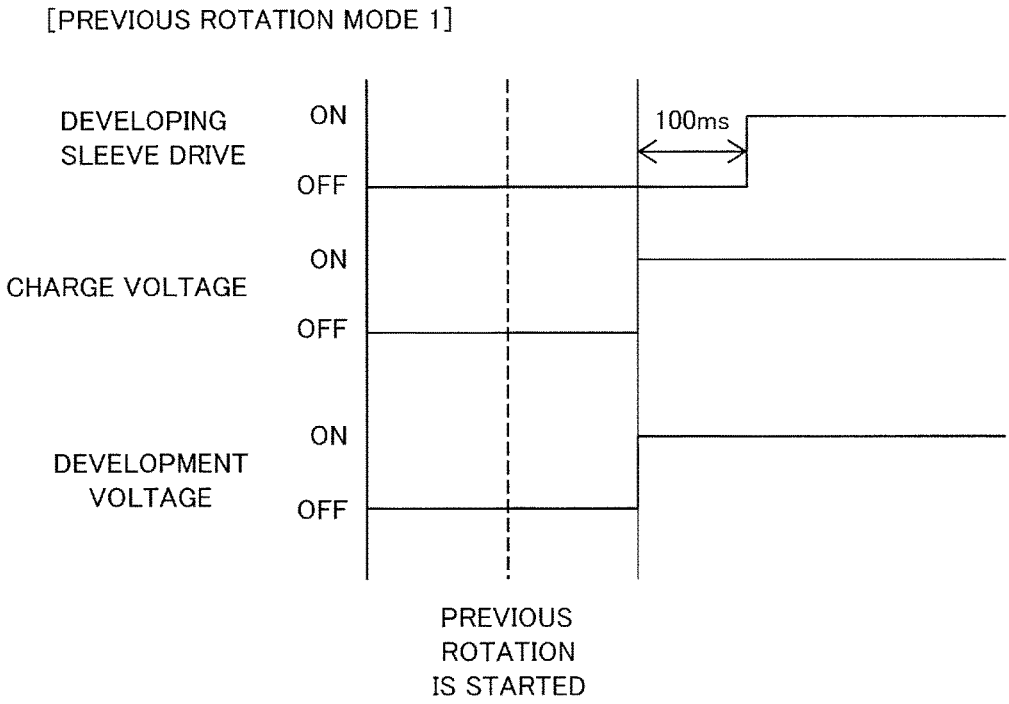
FIG. 13A is a timing chart of a pre-rotation mode 1 in the voltage rising control according to the fifth embodiment.
Figure 13B:
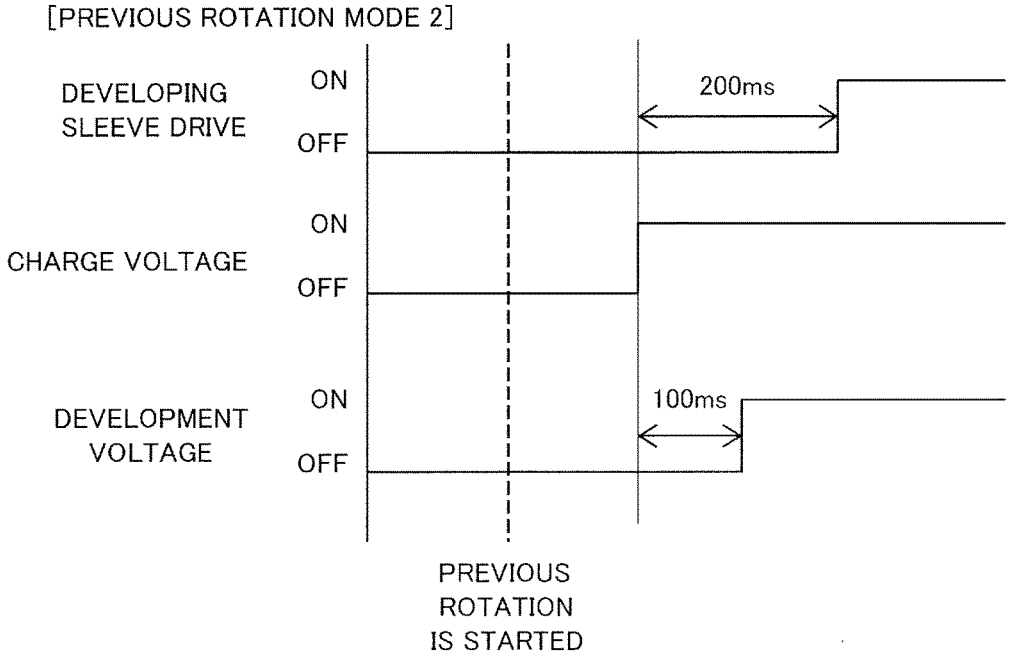
FIG. 13B is a timing chart of a pre-rotation mode 2 in the voltage rising control according to the fifth embodiment.
Figure 14A:
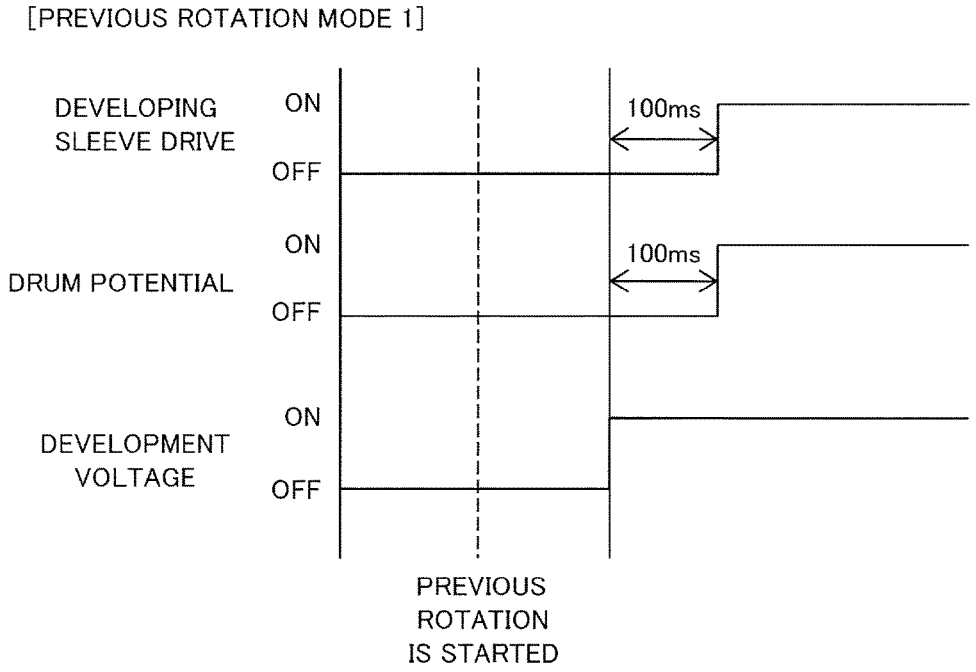
FIG. 14A is a timing chart of the pre-rotation mode 1 at the development position in the voltage rising control according to the fifth embodiment.
Figure 14B:
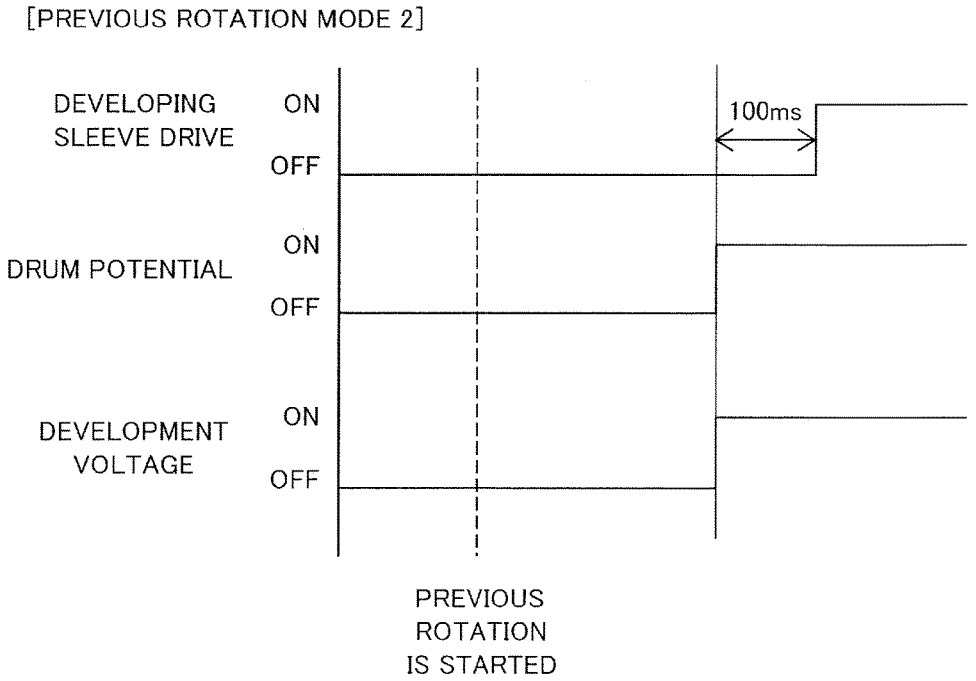
FIG. 14B is a timing chart of the pre-rotation mode 2 at the development position in the voltage rising control according to the fifth embodiment.

First, the pre-rotation mode 1 (after S53) which is the first mode will be described with reference to FIGS. 13A and 14A. It is noted that FIGS. 13A and 13B are timing charts of the start of the rotation drive of the developing sleeve 41 (developing sleeve drive ON), the application start of the charge voltage by a charging roller 2 (charge voltage ON), and the application start of the development voltage by the developing unit 4 (development voltage ON). In other words, FIGS. 14A and 14B are timing charts of rising of each portion. In addition, FIGS. 14A and 14B are timing charts illustrating that the timing of rising of each portion is at the development position (c) (FIG. 2). It is noted that since FIGS. 14A and 14B illustrate the state at the development position, the charge voltages of FIGS. 13A and 13B are replaced to the drum potential (charge potential). In other words, a state of the charge potential of the photoconductive drum 1 at the development position is illustrated.

In the pre-rotation mode 1, the application of the development voltage is started before a charging start portion (a leading end of a charging area) on the photoconductive drum 1Y (on the image bearing member) at which the charging by the charging roller 2 is started, i.e., a portion on the image bearing member which is located at the charging position when the charging by the charging unit is started in a state where rotation of the developer bearing member is stopped, reaches the development position (c) that opposes the developing sleeve 41. In addition, the rotation of the developing sleeve 41 is started at the same time when or after the charging start portion reaches the development position (c). That is, it is preferable in the pre-rotation mode 1 that the driving input to the developer bearing member 41 is started in response to image formation after a leading end of a charging area of the image bearing member 1Y charged by the charging unit 2 reaches the development position, and an application of the development voltage is started before the leading end of the charged area reaches the development position (c). In the embodiment, as illustrated in FIGS. 12 and 13A, first, the application of the charge voltage and the development voltage is started (S53), and the drive of the developing sleeve 41 is started after 100 msec (S54).

Here, since the time until the charge position (a) on the photoconductive drum 1Y moves to the development position (c) becomes 100 msec, a case where the timing of FIG. 13A is at the development position is illustrated in FIG. 14A. In other words, at the development position, after 100 msec after the development voltage becomes ON, the charging start portion (position of charge voltage ON) at which the application of the charge voltage is started reaches the development position (drum potential ON), and the drive of the developing sleeve 41 is started, at the same time.

In this manner, in the pre-rotation model, the development voltage at the development position becomes ON at the timing of the rotation drive start of the developing sleeve 41, and the drum potential after this becomes ON. Therefore, during the time period of 100 msec from the development voltage ON to the drum potential ON, the electric field (that is, voltage on the fogging side) is applied to move the toner on the developing sleeve 41 to the photoconductive drum 1Y. Then, as illustrated in FIG. 4B, the toner 48 does not adhere to the surface of the developing sleeve 41 when the developing sleeve is stopped, a state where the toner 48 is uniformly adhered to the carrier 49 can be held, and occurrence of the toner adhesion onto the developing sleeve 41 can be suppressed.

It is noted that, in the embodiment, an example in which the timing when the drum potential becomes ON and the timing when the rotation drive of the developing sleeve 41 is started become the same as each other at the development position, is illustrated. However, it is not necessary that the timings are the same as each other, and the timing when the rotation drive of the developing sleeve 41 is started may be after the drum potential ON. In other words, the rotation of the developing sleeve 41 may be started after the charging start portion reaches the development position. In addition, the developing sleeve 41 may start the rotation so that the rotation of the developing sleeve 41 is stabilized until the image formation is started and the electrostatic latent image reaches the development position. Therefore, the rotation start timing of the developing sleeve 41 may be within a time period from the drum potential ON until the electrostatic latent image reaches the development position considering the stability of the rotation.

Pre-Rotation Mode 2

Next, the pre-rotation mode 2 (after S55) which is the second mode will be described with reference to FIGS. 13B and 14B. In the pre-rotation mode 2, the application of the development voltage is started at substantially the same time when the charging start portion on the photoconductive drum 1 (on the image bearing member) at which the charging by the charging roller 2 is started reaches the development position (c) that opposes the developing sleeve 41. In addition, the rotation of the developing sleeve 41 is started at the same time when or after the charging start portion reaches the development position (c). That is, it is preferable in the pre-rotation mode 2 that the driving input to the developer bearing member 41 is started in response to image formation after the leading end of the charging area reaches the development position (c), and the application of the development voltage is started at a timing before the leading end of the charging area reaches the development position (c) and later than that in the pre-rotation mode 1, or at the same time when the leading end of the charging area reaches the development position. In the embodiment, as illustrated in FIGS. 12 and 13B, first, the application of the charge voltage is started (S55), the application of the development voltage is started after 100 msec (S56), and further, the rotation of the developing sleeve 41 is started after 100 msec (S57). A case where the timing of FIG. 13B is at the development position is illustrated in FIG. 14B. In other words, at the development position, the drum potential and the development voltage become ON at substantially the same time, and the rotation of the developing sleeve 41 is started after 100 msec.

In this manner, in the pre-rotation mode 2, from the time when the drum potential and the development voltage become ON to the time when the rotation drive of the developing sleeve 41 is started, the electric field is applied to move the toner on the developing sleeve 41 to the developing sleeve 41 side by Vback. Therefore, it is possible to suppress consumption of the toner.

It is noted that, at the development position (c), preferably, the timings when the drum potential and the development voltage become ON become completely the same as each other in order to avoid the carrier adhesion or the fogging. However, when considering irregularity of the control signal or irregularity of characteristics of high voltage output of the high voltage power source, it is preferable that the timing is set so that the development voltage becomes ON slightly (for example, approximately equal to or less than 50 msec) early. Accordingly, it is possible to avoid the carrier adhesion which largely influences transferring or cleaning. In this case, slight fogging occurs, but since the extent of the fogging occurred is extremely slight when the time is extremely short, there is not a problem when the timings are set to be substantially the same as each other. However, in the pre-rotation mode 2, the application of the development voltage is started at the timing when the charging start portion reaches the development position, or at the timing which is later than that in the pre-rotation mode 1 before the charging start portion reaches the development position, and the toner consumption is suppressed compared to the pre-rotation mode 1.

In addition, in the description above, at the development position (c), the rotation drive of the developing sleeve 41 is started after the drum potential ON, but the rotation start of the developing sleeve 41 may be performed at the same time as the drum potential ON. Furthermore, the timing of the rotation drive start of the developing sleeve 41 may be the timing before the drum potential and the development voltage become ON at substantially the same time at the development position (c). This is because the fogging does not occur even when the developing sleeve 41 is rotated since the electric field does not act between the developing sleeve 41 and the photoconductive drum 1 in a state where the drum potential and the development voltage are OFF. However, in the case where the timing when the development voltage becomes ON is controlled to be slightly later than the timing when the drum potential becomes ON at the development position (c), it is preferable that the drive of the developing sleeve 41 is started after the development voltage and the drum potential become ON.

In addition, in the above-described description, as the information which influences the toner charging amount, similar to the fourth embodiment, both the rotation amount of the developing sleeve 41 and the humidity or the moisture content in the periphery of the developing unit 4Y are used. However, even when the rising method in the pre-rotation is switched as described in the embodiment, the mode of the pre-rotation may be switched in accordance with the information similar to the first to the third embodiments. In other words, the mode of the pre-rotation may be switched in accordance with the charging amount of the toner as described in the first embodiment, the rotation amount of the developing sleeve 41 as described in the second embodiment, and the humidity or the moisture content in the periphery of the developing unit 4Y as described in the third embodiment, respectively.

In addition, the detection by the temperature and humidity sensor 50 may be performed when the previous image formation is completed. In this case, the detection result is stored in the storage portion 103 (refer to FIG. 3), and the control portion 101 performs the control in the pre-rotation described above based on the detection result stored by the storage portion 103 of the temperature and humidity sensor 50 when the previous image formation is completed, and based on the rotation amount (rotation time) stored in the storage portion 103. In addition, the control portion 101 may perform the detection both when the previous image formation is completed and when the current image formation is started, perform the pre-rotation mode 1 in the case where the detection result of at least any one of the cases is higher than the predetermined upper limit relative humidity, and the counter is greater than the predetermined upper limit number of rotations, and perform the pre-rotation mode 2 in other cases.

Furthermore, as described in the third embodiment, in the case where the modes of the pre-rotation are switched in accordance with the humidity or the moisture content in the periphery of the developing unit 4Y, the detection by the temperature and humidity sensor 50 may also be performed when the previous image formation is completed. In this case, the storage portion 103 (refer to FIG. 3) stores the detection result, and the control portion 101 performs the control in the pre-rotation described above based on the detection result stored by the storage portion 103 of the temperature and humidity sensor 50 when the previous image formation is completed. In addition, the control portion 101 may perform the detection both when the previous image formation is completed and when the current image formation is started, perform the pre-rotation mode 1 in the case where the detection result of at least any one of the cases is higher than the predetermined upper limit relative humidity, and perform the pre-rotation mode 2 in other cases.

In the embodiment, the pre-rotation mode 1 in which the toner adhesion to the developing sleeve 41 is unlikely to occur, and the pre-rotation mode 2 in which unnecessary consumption of the toner due to the fogging can be suppressed, are switched based on the information which influences the toner charging amount. Therefore, similar to the first to the fourth embodiments, both the suppression of generation of the belt-like image due to the toner adhesion to the developing sleeve 41, and the suppression of unnecessary consumption of the toner, can be achieved. Other configurations and operations are similar to those in the first to the fourth embodiments.

Sixth Embodiment

A sixth embodiment will be described. In each of the above-described embodiments, a case where the apparatus is used for a long period of time, that is, a case where the predetermined time elapses after the use of the developer in the developing unit is started (for example, a case where the image formation is performed on 100,000 sheets to 200,000 sheets or more), is described. In other words, in the case where the apparatus is used for a long period of time, the charging amount of the toner is likely to deteriorate due to deterioration of the carrier, and in the case where the rotation amount of the developing sleeve is large, or in the case where the humidity of the environment is high, the charging amount of the toner particularly decreases, and the sleeve adhesion of the toner is likely to occur. However, the sleeve adhesion of the toner can also occur in an initial state (for example, a case where the image formation is performed on 100,000 sheets or more and less than 200,000 sheets) of the developer where the use of the developer in the developing unit is started. The sleeve adhesion of the toner will be described.

As described above, the developer of a two-component developing system is configured of the toner and the carrier, and the toner and the carrier can obtain the charging amount by frictional charging. Here, in the case where the charging amount of the toner is likely to be increased due to the condition, such as the humidity of the environment, the toner is unlikely to be developed to the photoconductive drum, and it is not possible to obtain a desired image concentration. Therefore, the control for suppressing the charging amount of the toner is performed. Due to this, in the embodiment, by increasing the toner concentration, the contact ratio of the toner with respect to the carrier is lowered, and the charging amount of the toner is suppressed. Specifically, as described above, the toner concentration in the developer is detected by using the concentration sensor 45. In addition, the rotation of the replenishing screw 51 is controlled to achieve a target toner concentration (refer to FIG. 2).

It is noted that the target toner concentration is determined by investigating the toner mounting amount by forming a test pattern as described in an eighth embodiment which will be described later, or the target toner concentration is determined by the environment in the apparatus as described in a ninth embodiment. Furthermore, the target toner concentration is determined by the use time of the apparatus as described in a tenth embodiment, or the target toner concentration is determined by various methods known hitherto, by appropriately combining the methods.

However, since the contact ratio of the toner with respect to the carrier is extremely low when the toner concentration in the developer is extremely high, unevenness occurs in the charging amount in the toner in the developer, and the toner having a high charging amount and the carrier having a low charging amount are generated. Among these, since the toner having a low charging amount has a small electrostatic force which attracts the carrier, the toner is likely to be separated from the surface of the carrier, and to be moved by the electric field between the developing sleeve and the photoconductive drum. Therefore, when the electric field, that is, Vback, which attracts the toner to the sleeve side is applied, a phenomenon in which the toner having a low charging amount adheres to the surface of the sleeve, is likely to occur.

Here, in the embodiment, even in the initial state of the developer where the use of the developer in the developing unit is started, based on the information which influences the toner charging amount, the first mode and the second mode are switched. The first mode is the same as the post rotation mode 1 of the first to the fourth embodiments and the pre-rotation mode 1 of the fifth embodiment, and the second mode is the same as the post rotation mode 2 of the first to the fourth embodiments and the pre-rotation mode 2 of the fifth embodiment, respectively. However, in the initial state, a standard for performing the switching of the modes is different from that in the case where the apparatus is used for a long period of time similar to the first to the fifth embodiments.

In other words, in the initial state, as described above, the toner is replenished and the toner concentration increases in the case where the charging amount of the toner is high, unevenness occurs in the charging amount of the toner in the developer, and the sleeve adhesion occurs due to the toner having a low charging amount. Therefore, in the initial state, by detecting the toner concentration, the first mode is performed in the case where the detected toner concentration is higher than the predetermined concentration, and the second mode is performed in the case where the detected toner concentration is equal to or lower than the predetermined concentration. The predetermined concentration is, for example, set to be 10%. This will be more specifically described in the following embodiments.

In addition, the first mode in which the developer is in the initial state may be performed in the case where the rotation amount of the developing sleeve is integrated and stored, and the stored rotation amount is smaller than the predetermined lower limit rotation amount, and the second mode may be performed in the case where the stored rotation amount is equal to or greater than the predetermined lower limit rotation amount. Furthermore, by detecting the humidity or the moisture content in the periphery of the developing unit, the first mode in which the charging amount of the toner is high and the sleeve adhesion is likely to occur, is performed in the case where the detected humidity or moisture content is lower than the predetermined lower limit humidity or moisture content, and the second mode is performed when the detected humidity or moisture content is equal to or higher than the predetermined lower limit humidity or moisture content. In addition, the determination may be performed by appropriately combining the conditions. It is noted that the predetermined lower limit rotation amount in the initial state is smaller than the predetermined upper limit rotation amount of the second embodiment, and for example, is set to be a case where the image formation is performed on approximately 100,000 sheets on a paper sheet having a longitudinal size of A4. In addition, the predetermined lower limit humidity or moisture content in the initial state is smaller than the predetermined upper limit humidity or moisture content in the third embodiment, and for example, is set to be a case where the relative humidity is 40%. These will be more specifically described in the following embodiments.

In addition, in the embodiment, similar to the first to the fifth embodiments, even in a state where the apparatus is used for a long period of time, based on the information which influences the toner charging amount, the first mode and the second mode are switched.

In the embodiment, in addition to the state where the apparatus is used for a long period of time, even in the initial state of the developer, based on the information which influences the toner charging amount, the first mode and the second mode are switched. Therefore, even in any of the states, both the suppression of generation of the belt-like image due to the toner adhesion to the developing sleeve 41, and the suppression of unnecessary consumption of the toner, can be achieved.

The voltage falling method in the post rotation in the above-described first to the fourth embodiments, and the rising method in the pre-rotation in the fifth embodiment, are respectively switched based on the information which influences the toner charging amount. Both the operation of the post rotation and the operation of the pre-rotation may be performed. Even in the above-described sixth embodiment, both operations may be similarly realized. For example, the control illustrated in FIG. 11 is performed in the post rotation, and the control illustrated in FIG. 12 is performed in the pre-rotation. Accordingly, it is possible to perform the control of the sleeve adhesion in a more linear state, and the control of toner consumption due to the discharge.

It is noted that, in the above-described fourth and fifth embodiments, the modes are switched in accordance with both the rotation amount of the developing sleeve 41 and the humidity or the moisture content in the periphery of the developing unit 4. However, according to the condition of the toner concentration described in the first embodiment, it is possible to select the voltage falling operation of the post rotation and the rising operation of the pre-rotation. Furthermore, each embodiment may be realized by being appropriately combined with each other.

Seventh Embodiment

A seventh embodiment will be described by using FIG. 15 with reference to FIGS. 1 to 3. As described above, the toner adhesion to the developing sleeve can occur even in the initial state of the developer where the use of the developer in the developing unit is started. Therefore, in the initial state of the developer, the embodiment provides a configuration in which both the suppression of generation of the belt-like image due to the toner adhesion to the developing sleeve, and the suppression of unnecessary consumption of the toner, can be achieved.

Hereinafter, this will be specifically described. In the embodiment, the toner concentration is detected as the information which influences the toner charging amount, and in accordance with this, the control of the charging and the falling of the development voltage is switched. In addition, while suppressing the toner adhesion to the developing sleeve 41, unnecessary consumption of the toner is suppressed. In other words, under a condition that the toner concentration is high and the toner adhesion to the developing sleeve 41 is likely to generate, at the timing when the developing sleeve 41 is stopped, the charge voltage falls first, and then, the development voltage falls. Accordingly, the potential relationship between Vd and Vdc is reversed to that in the image formation, and the potential on the fogging side is set between the developing sleeve 41 and the photoconductive drum 1Y. By performing the voltage falling control, as illustrated in FIG. 4B, the toner 48 does not adhere to the surface of the developing sleeve 41 when the developing sleeve 41 is stopped, and a state where the toner 48 is uniformly adhered to the carrier 49 can be maintained. Meanwhile, under a condition that the toner concentration is low and the toner adhesion to the developing sleeve 41 is unlikely to occur, the charge voltage (drum potential) and the development voltage at the development position (c) fall at substantially the same time, at the timing when the developing sleeve 41 is stopped. By performing the voltage falling control, it is possible to suppress generation of fogging toner, to suppress unnecessary consumption of the toner, and to avoid a phenomenon, such as toner scattering.

Hereinafter, the voltage falling control in the embodiment will be described in detail. In the embodiment, by detecting the toner concentration in the development container 40 as described above, and in accordance with this, the method of stopping (voltage falling) the application of the development voltage and the charge voltage in the operation (post rotation) from the time when the image forming operation is completed to the time when the main body is stopped (operations of each portion are stopped) is changed.

Figure 15:
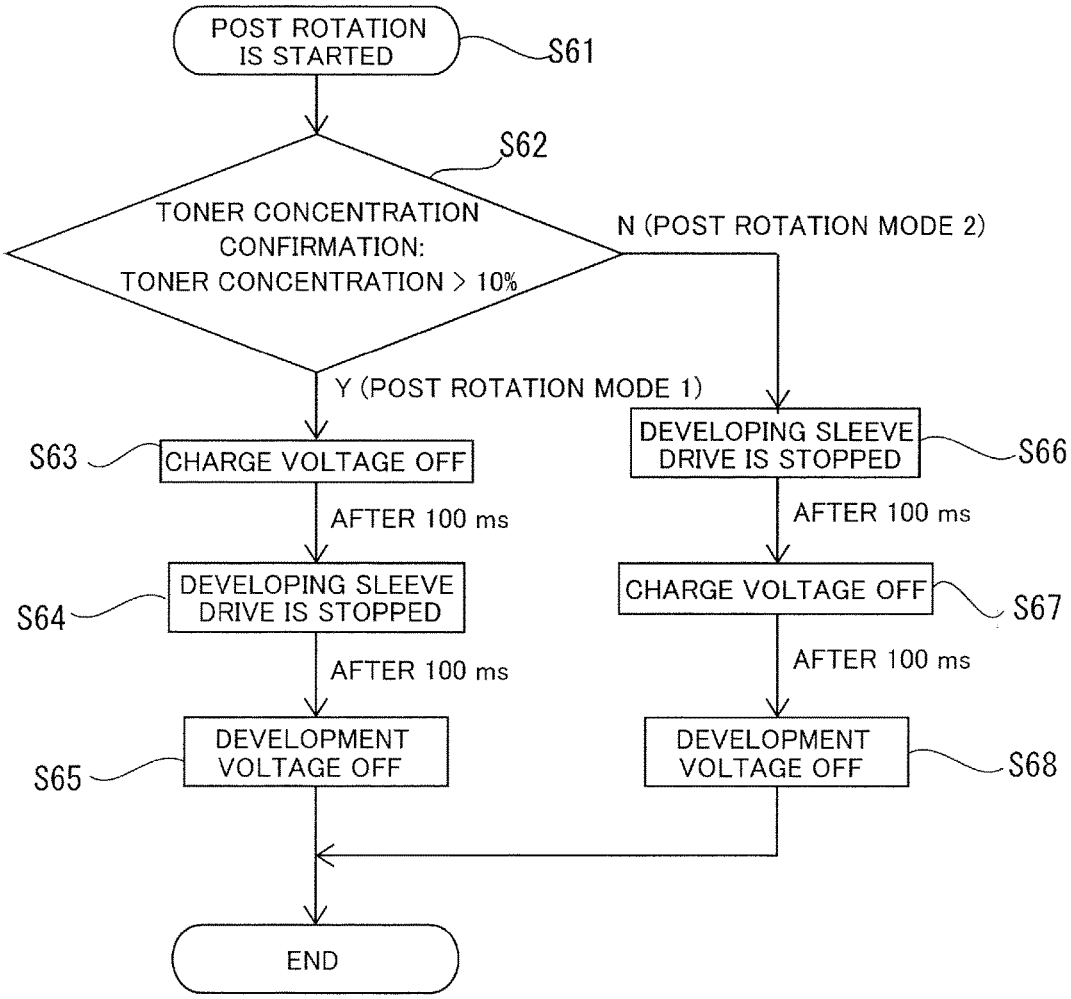
FIG. 15 is a flow chart of voltage falling control according to a seventh embodiment.

As illustrated in FIG. 15, when the operation of the post rotation is started according to the image formation completion (S61), the control portion 101 detects the toner concentration by the concentration sensor 45. In addition, it is determined whether or not the detected toner concentration is higher than the predetermined concentration (10% in the embodiment) stored in the storage portion 103, and the mode of the post rotation is determined. In other words, the control portion 101 can perform the post rotation mode 1 which is the first mode, and the post rotation mode 2 which is the second mode. In addition, the post rotation mode 1 and the post rotation mode 2 are switched in accordance with the toner concentration.

In the embodiment, in a case (Y in S62) where the detected toner amount is higher than the predetermined concentration (higher than 100), it is determined that the sleeve adhesion of the toner is likely to occur, and the process moves to S63 (post rotation mode 1). On the contrary, in the case where the detected toner amount is equal to or lower than the predetermined concentration (equal to or lower than 10%) (N in S62), it is determined that the sleeve adhesion of the toner is unlikely to occur, and the process moves to S66 (post rotation mode 2).

It is noted that since the above-described predetermined concentration is a value which is determined by the used developer, the value itself changes in accordance with a performing machine. In addition, the description of the control after S63 and S66 will be omitted since the processes after S63 and S66 are respectively similar to those after S3 and S6 illustrated in FIG. 5 of the first embodiment.

In the embodiment, in the initial state of the developer, the post rotation mode 1 in which the toner adhesion to the developing sleeve 41 is unlikely to occur, and the post rotation mode 2 in which unnecessary consumption of the toner due to the fogging can be suppressed, are switched based on the information which influences the toner charging amount. Specifically, the operation of the post rotation is changed in accordance with the toner concentration in the development container 40. Therefore, in the initial state of the developer, both the suppression of generation of the belt-like image due to the toner adhesion to the developing sleeve 41, and the suppression of unnecessary consumption of the toner, can be achieved. Other configuration elements and effects are similar to those in the first embodiment.

Eighth Embodiment

An eighth embodiment will be described by using FIG. 16 with reference to FIGS. 1 to 3. In the above-described seventh embodiment, the post rotation mode 1 and the post rotation mode 2 are switched in accordance with the toner concentration, but in the embodiment, the switching is performed in accordance with the rotation amount of the developing sleeve 41 as the information which influences the toner charging amount. In particular, in the embodiment, the switching is performed in accordance with the number of rotations of the developing sleeve 41. It is noted that other than the number of rotations, for example, rotation time may be employed as the rotation amount of the developing sleeve 41. In addition, since any factor may be employed if the deterioration situation of the carrier can be determined, the switching may be performed in accordance with the rotation amount (the number of rotations, rotation time) of the screws 43 and 44 in the developing unit 4. In any cases, a method of stopping (voltage falling) the development voltage and the charge voltage by the operation (post rotation) from the time when the image forming operation is completed to the time when the main body is stopped, is changed in accordance with the rotation amount of the developing sleeve 41.

Here, as described above, in the case where the apparatus is used for a long period of time, the charging performance of the carrier deteriorates, and the charging amount of the toner is likely to decrease. Therefore, also in the embodiment, the predetermined toner image (test pattern) is formed on the intermediate transfer belt 91 at a predetermined interval (for example, every predetermined number sheet of image formation) by the command of the control portion 101. In addition, by detecting the toner mounting amount of the test pattern, the charging amount of the toner is detected. Specifically, the charging amount of the toner is small in the case where a large amount of toner is mounted on the intermediate transfer belt 91, and on the contrary, the charging amount of the toner is large in the case where a small amount of toner is mounted on the intermediate transfer belt 91.

Therefore, when a large amount of the toner is mounted on the intermediate transfer belt 91, it is determined that the charging amount of the toner is small, and the toner concentration in the developer is controlled to be low. On the contrary, when a small amount of the toner is mounted on the intermediate transfer belt 91, it is determined that the charging amount of the toner is high, and the toner concentration in the developer is controlled to be high. The adjustment of decreasing or increasing the toner concentration is performed by increasing or decreasing a replenishing amount of the toner to the development container 40. In other words, the rotation of the replenishing screw 51 is controlled to achieve the target toner concentration (refer to FIG. 2). In this manner, the concentration sensor 45 which is illustrated in FIG. 2 and detects the toner concentration may be omitted, and it is possible to stabilize the charging amount of the toner by increasing and decreasing the replenishing amount of the toner in accordance with the toner mounting amount by the toner mounting amount detection sensor 97.

In the image forming apparatus which uses the method, when the developer has not been used that much and the charging performance of the carrier is high, the toner concentration is controlled to be high. Meanwhile, when the developer has been used for a long period of time and the charging performance of the carrier deteriorates, the toner concentration is controlled to be low.

Here, in the case where the toner concentration is controlled to be high in the initial state where the developer has not been used that much, as described above, the contact ratio of the toner with respect to the carrier becomes extremely low. Therefore, unevenness occurs in the charging amount of the toner in the developer, and the toner having a high charging amount and the toner having a low charging amount are generated. Among these, since the toner having a low charging amount has a small electrostatic force which attracts the carrier, the toner is likely to be separated from the surface of the carrier, and to be moved by the electric field between the developing sleeve and the photoconductive drum. Therefore, when the electric field, that is, Vback, which attracts the toner to the developing sleeve side is applied, a phenomenon in which the toner having a low charging amount adheres to the surface of the sleeve, is likely to occur. Meanwhile, when the developer is used for a long period of time and the toner concentration is controlled to be low, since the contact ratio of the toner with respect to the carrier is high, and a weakly charged toner is unlikely to be generated, the toner adhesion to the developing sleeve is unlikely to occur.

Here, in the embodiment, the timing when the development voltage and the charge voltage fall is changed in accordance with the use state of the developer. The deterioration situation of the carrier due to the use can be ascertained from the rotation amount (here, the total number of rotations) of the developing sleeve 41. In other words, in the case where the rotation amount (total number of rotations) of the developing sleeve 41 is smaller than a predetermined lower limit rotation amount (predetermined lower limit number of rotations), since the charging amount of the toner is also large without deterioration of the carrier, the toner concentration is easily controlled to be high. Therefore, in this case, it is determined that the toner adhesion to the developing sleeve 41 is likely to occur. Meanwhile, in the case where the rotation amount (total number of rotations) of the developing sleeve 41 is equal to or greater than the predetermined rotation amount (equal to or greater than the predetermined number of rotations), since the charging amount of the toner is small with deterioration of the carrier, the toner concentration is easily controlled to be low. Therefore, in this case, it is determined that the toner adhesion to the developing sleeve 41 is unlikely to occur.

Therefore, in the embodiment, as illustrated in FIG. 3, the storage portion 103 integrally stores the rotation amount (the total number of rotations) of the developing sleeve 41. In addition, the control portion 101 switches the post rotation mode 1 and the post rotation mode 2 in accordance with the total number of rotations stored in the storage portion 103. In other words, the post rotation mode 1 is performed in the case where the total number of rotations of the developing sleeve 41 is smaller than the predetermined lower limit number of rotations, and the post rotation mode 2 is performed in the case where the total number of rotations of the developing sleeve 41 is equal to or greater than the predetermined lower limit number of rotations.

Hereinafter, the voltage falling control in the embodiment will be specifically described. In the embodiment, the deterioration situation of the developer in the development container 40 is assumed from the rotation amount of the developing sleeve 41, and in accordance with this, the voltage falling method of the development voltage and the charge voltage by the operation (post rotation) from the time when the image forming operation is completed to the time when the main body is stopped, is changed.

Figure 16:
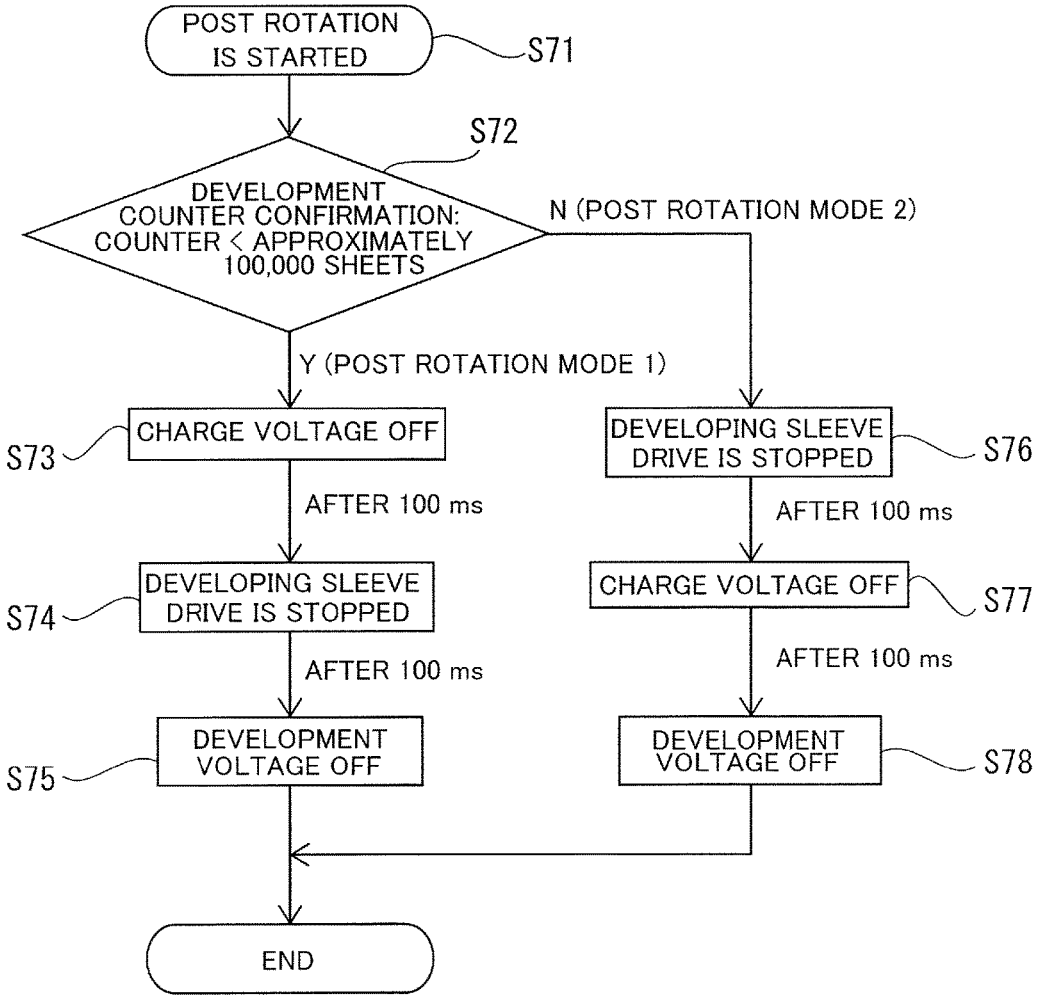
FIG. 16 is a flow chart of voltage falling control according to an eighth embodiment.

As illustrated in FIG. 16, when the operation of the post rotation is started according to the image formation completion (S71), the control portion 101 obtains the total number (counter) of rotations of the developing sleeve 41 from the storage portion 103 (development counter confirmation). In addition, it is determined whether or not the counter is less than the predetermined lower limit number of rotations stored in the storage portion 103, and the mode of the post rotation is determined (S72). In the embodiment, for example, the predetermined lower limit number of rotations is set to be a case where the image formation is performed on approximately 100,000 sheets on a paper sheet having a longitudinal size of A4. Next, in a case (Y in S72) where the counter is less than the predetermined lower limit number of rotations (less than approximately 100,000 sheets), it is determined that the sleeve adhesion of the toner is likely to occur, and the process moves to S73 (post rotation mode 1). On the contrary, in the case (N in S72) where the counter is equal to or greater than the predetermined lower limit rotation amount (equal to or greater than approximately 100,000 sheets), it is determined that the sleeve adhesion of the toner is unlikely to occur, and the process moves to S76 (post rotation mode 2).

It is noted that since a value which corresponds to 100,000 which is a developer deterioration standard used here, is a value which is determined by the used developer, the value itself changes in accordance with a performing machine. In addition, the description of the control after S73 and S76 will be omitted since the processes after S73 and S76 are respectively similar to those after S3 and S6 illustrated in FIG. 5 of the first embodiment.

In the embodiment, the post rotation mode 1 and the post rotation mode 2 are switched in accordance with the total number of rotations of the developing sleeve 41. Therefore, similar to the seventh embodiment, in the initial state of the developer, both the suppression of generation of the belt-like image due to the toner adhesion to the developing sleeve 41, and the suppression of unnecessary consumption of the toner, can be achieved. Other configurations and operations are similar to those in the seventh embodiment.

Ninth Embodiment

A ninth embodiment will be described by using FIG. 17 with reference to FIGS. 1 to 3. In the above-described seventh embodiment, the post rotation mode 1 and the post rotation mode 2 are switched in accordance with the toner concentration, but in the embodiment, the switching is performed in accordance with the humidity and the moisture content in the periphery of the developing unit 4Y as the information which influences the toner charging amount. In particular, in the embodiment, the switching is performed in accordance with relative humidity in the periphery of the developing unit 4Y.

In the embodiment, the post rotation mode 1 is performed in the case where the relative humidity (humidity or moisture content) detected by the temperature and humidity sensor 50 (FIG. 1) is lower than the predetermined lower limit relative humidity (predetermined lower limit humidity or moisture content), and the post rotation mode 2 is performed in the case where the relative humidity is equal to or higher than the predetermined lower limit relative humidity (equal to or higher than the predetermined lower limit humidity or moisture content).

Hereinafter, the voltage falling control in the embodiment will be specifically described. In the embodiment, the charging amount of the toner in the developing unit 4Y is assumed by detecting the relative humidity in the periphery of the developing unit 4Y, and in accordance with this, the voltage falling method of the development voltage and the charge voltage by the operation (post rotation) from the time when the image forming operation is completed to the time when the main body is stopped, is changed.

Figure 17:
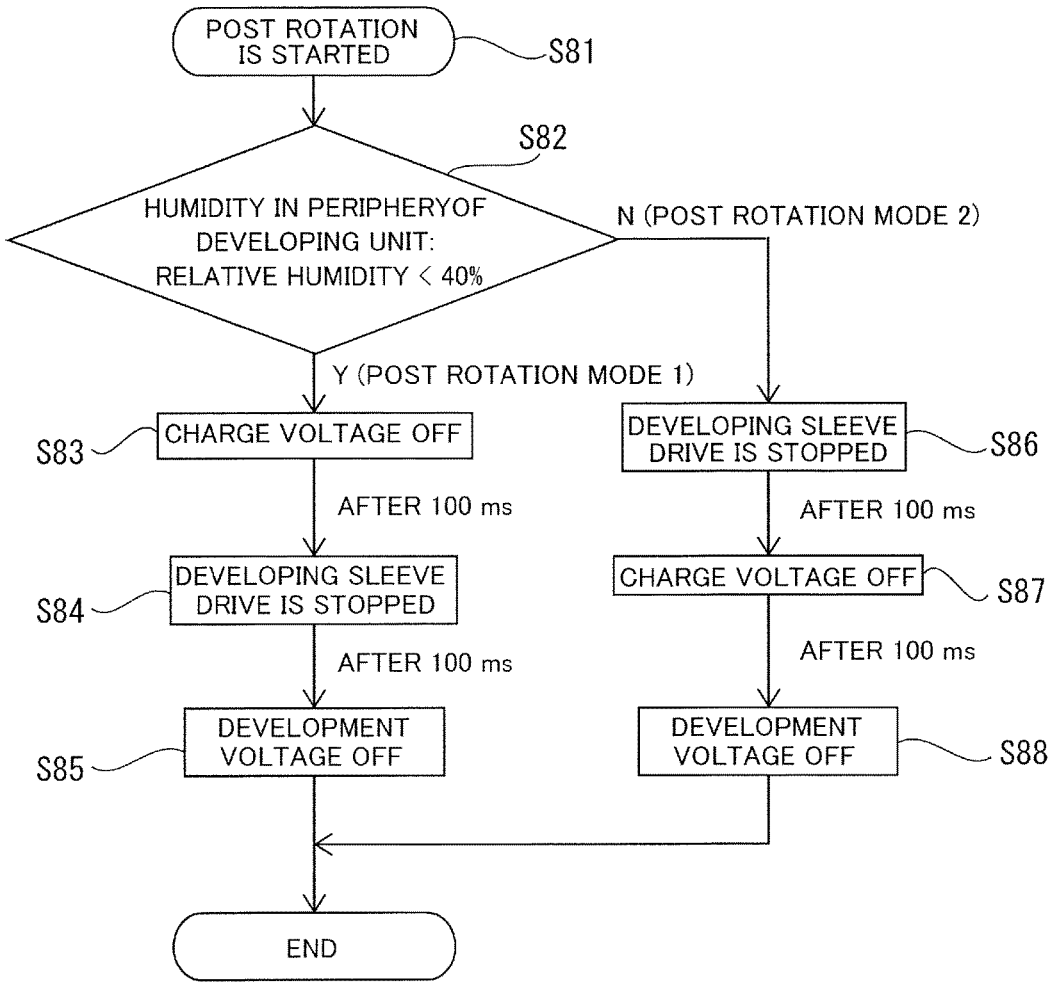
FIG. 17 is a flow chart of voltage falling control according to a ninth embodiment.

As illustrated in FIG. 17, when the operation of the post rotation is started according to the image formation completion (S81), the control portion 101 detects the relative humidity in the periphery of the developing unit 4Y by the temperature and humidity sensor 50. In addition, it is determined whether or not the detected relative humidity is lower than the predetermined lower limit relative humidity (40% in the embodiment), and the mode of the post rotation is determined (S82). Next, in a case (Y in S82) where the detected relative humidity is lower than the predetermined lower limit relative humidity (lower than 40%), it is determined that the sleeve adhesion of the toner is likely to occur, and the process moves to S83 (post rotation mode 1). On the contrary, in the case (N in S82) where the detected relative humidity is equal to or higher than the predetermined lower limit relative humidity (equal to or higher than 40%), it is determined that the sleeve adhesion of the toner is unlikely to occur, and the process moves to S86 (post rotation mode 2).

It is noted that, in the embodiment, the operation of the post rotation is switched by using the relative humidity (40%) as a boundary, but since the value of the humidity of switching changes according to the used developer, the most appropriate value changes in accordance with the developer. In addition, there is a developer in which the charging amount changes in accordance with not the relative humidity but the moisture content in the environment, and at this time, it is possible to obtain similar effects by the switching in accordance with not the relative humidity but the moisture content. In addition, the description of the control after S83 and S86 will be omitted since the processes after S83 and S86 are respectively similar to those after S3 and S6 illustrated in FIG. 5 of the first embodiment.

In the embodiment, the post rotation mode 1 and the post rotation mode 2 are switched in accordance with the environment in the periphery of the developing unit 4Y. Therefore, similar to the seventh embodiment, in the initial state of the developer, both the suppression of generation of the belt-like image due to the toner adhesion to the developing sleeve 41, and the suppression of unnecessary consumption of the toner, can be achieved. Other configurations and operations are similar to those in the seventh embodiment.

Tenth Embodiment

Figure 18:
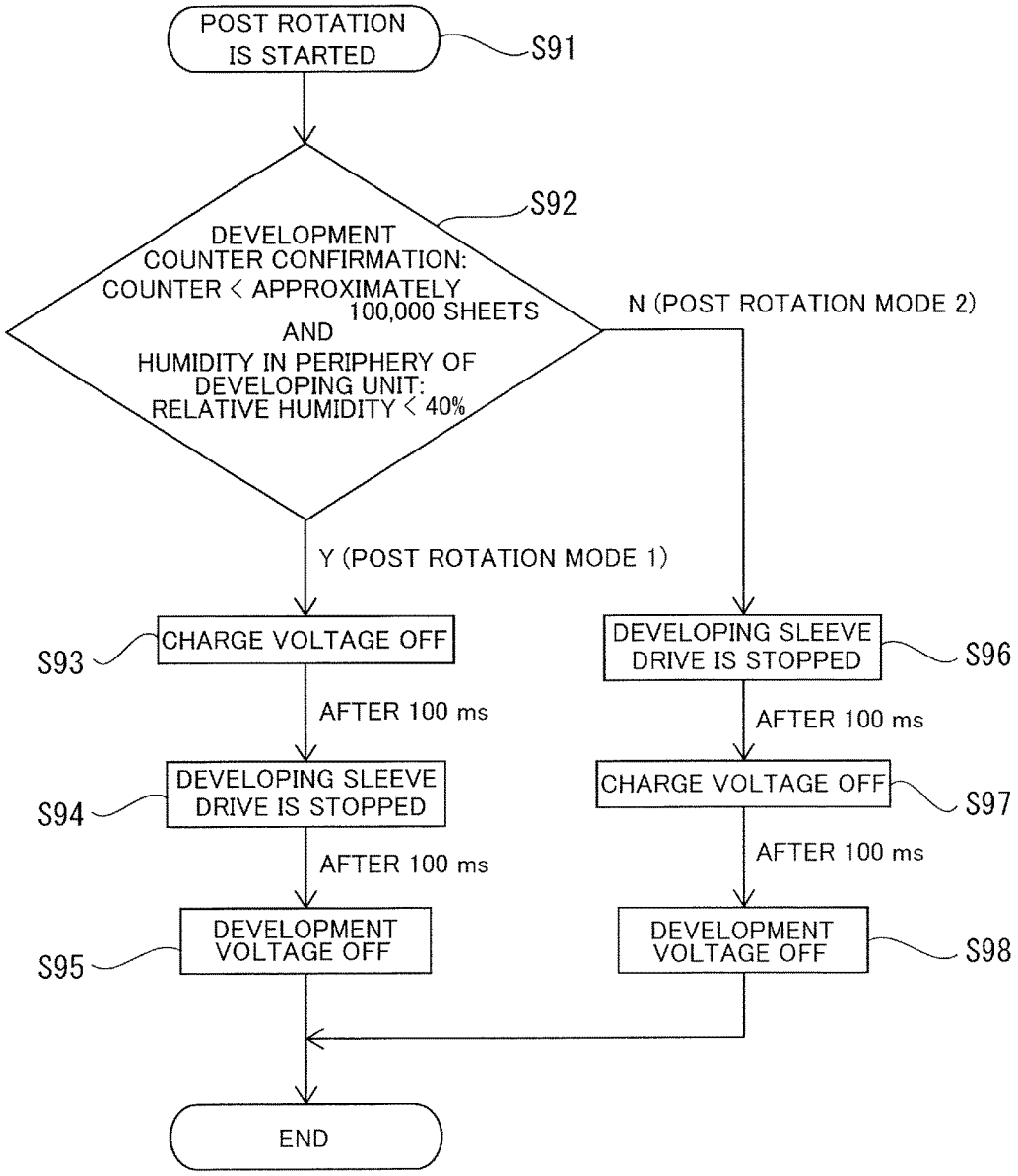
FIG. 18 is a flow chart of voltage falling control according to a tenth embodiment.

A tenth embodiment will be described by using FIG. 18 with reference to FIGS. 1 to 3. An example in which the post rotation mode 1 and the post rotation mode 2 are switched in accordance with the rotation amount of the developing sleeve 41 is illustrated in the above-described eighth embodiment, and an example in which the post rotation mode 1 and the post rotation mode 2 are switched in accordance with the humidity or the moisture content in the periphery of the developing unit 4Y is illustrated in the above-described ninth embodiment, respectively. Meanwhile, in the embodiment, the switching is performed in accordance with both the rotation amount of the developing sleeve 41 and the humidity or the moisture content in the periphery of the developing unit 4Y.

Therefore, in the embodiment, similar to the eighth embodiment, the storage portion 103 integrally stores the rotation amount (the number of rotation times) of the developing sleeve 41. In addition, similar to the ninth embodiment, the temperature and humidity sensor 50 is disposed in the apparatus body of the image forming apparatus 100. In addition, the control portion 101 switches the post rotation mode 1 and the post rotation mode 2 in accordance with the rotation amount (total number of rotations) stored in the storage portion 103, and the humidity or the moisture content (relative humidity) detected by the temperature and humidity sensor 50. In other words, the post rotation mode 1 is performed in the case where the rotation amount stored in the storage portion 103 is smaller than the predetermined lower limit rotation amount, and the humidity or the moisture content detected by the temperature and humidity sensor 50 is lower than the predetermined lower limit humidity or moisture content. Meanwhile, the post rotation mode 2 is performed in other cases.

Hereinafter, the voltage falling control in the embodiment will be specifically described. As illustrated in FIG. 18, when the operation of the post rotation is started according to the image formation completion (S91), the control portion 101 obtains the total number of rotations (counter) of the developing sleeve 41 from the storage portion 103 (development counter confirmation). In addition, the control portion 101 detects the relative humidity in the periphery of the developing unit 4Y by the temperature and humidity sensor 50. In addition, it is determined whether or not the counter (rotation amount) is smaller than the predetermined lower limit number of rotations (predetermined lower limit rotation amount) stored in the storage portion 103 in advance. In addition, at the same time, it is determined whether or not the detected relative humidity (humidity or moisture content) is lower than the predetermined lower limit relative humidity (predetermined lower limit humidity or moisture content), and the mode of the post rotation is determined (S92). In the embodiment, for example, the predetermined lower limit number of rotations is also set to be a case where the image formation is performed approximately 100,000 sheets on a paper sheet having a longitudinal size of A4. In addition, the predetermined lower limit relative humidity is set to be 40%.

Next, in the case (Y in S92) where the counter is smaller than the predetermined lower limit number of rotations (smaller than approximately 100,000 sheets), and the detected relative humidity is lower than the predetermined lower limit relative humidity (lower than 40%), the process moves to S93 (post rotation mode 1). In the case where any one of the conditions is not satisfied (N in S92), the process moves to S96 (post rotation mode 2). It is noted that the description of the control after S93 and S96 will be omitted since the processes after S93 and S96 are respectively similar to those after S3 and S6 illustrated in FIG. 5 of the first embodiment.

In the embodiment, it is possible to further limit a state where the sleeve adhesion of the toner occurs by the total number of rotations of the developing sleeve 41 and the environment in the periphery of the developing unit 4Y. As a result, since frequency of performing the post rotation mode 1 in which the toner is discharged is decreased, it is possible to further suppress consumption of the toner. Other configuration elements and effects are similar to those in the eighth and ninth embodiments.

Eleventh Embodiment

Figure 19:
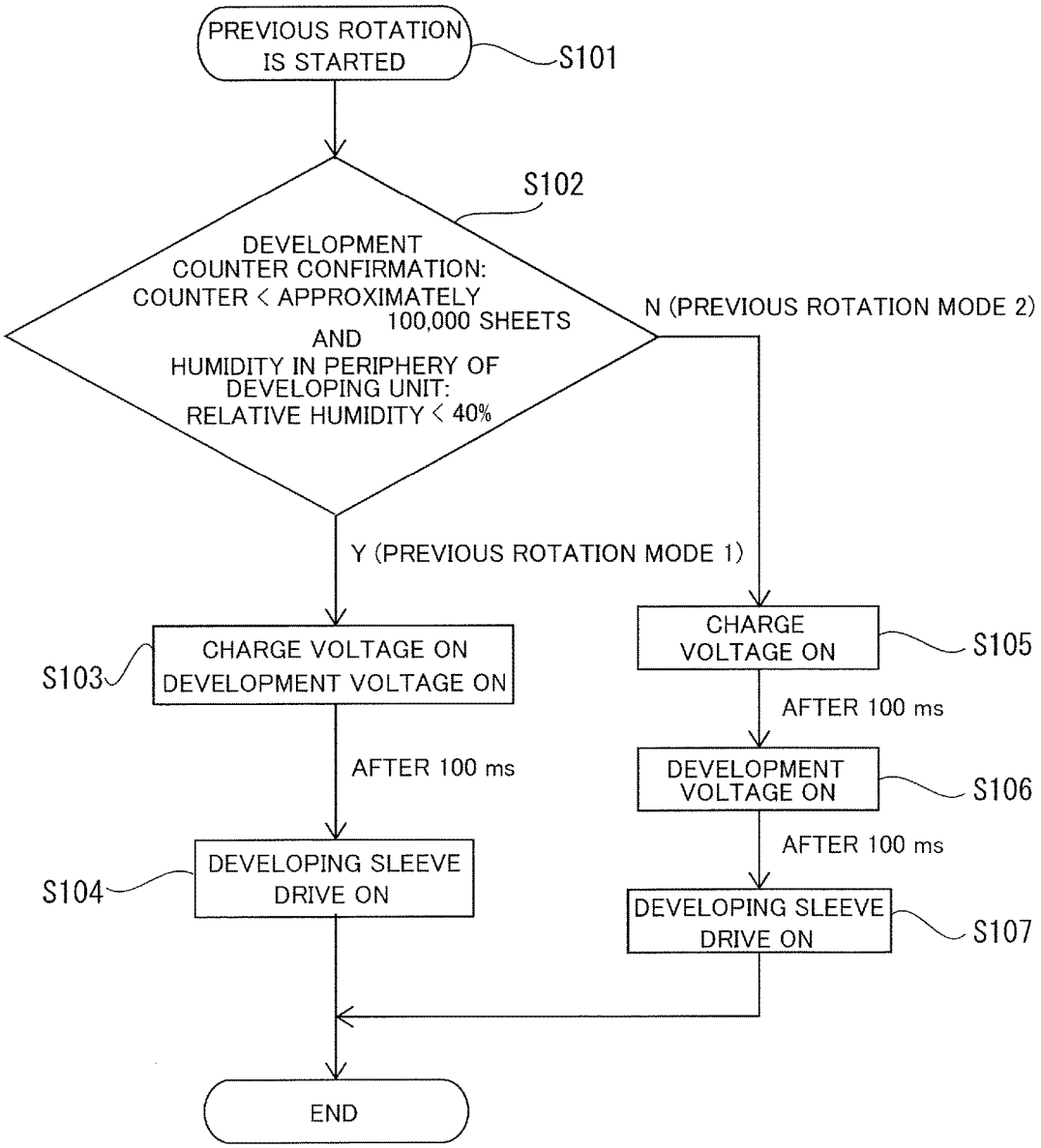
FIG. 19 is a flowchart of voltage rising control according to an eleventh embodiment.

An eleventh embodiment will be described by using FIG. 19 with reference to FIGS. 1 to 3. In the above-described seventh to tenth embodiments, by changing the voltage falling method in the post rotation, both the suppression of the sleeve adhesion of the toner and the suppression of unnecessary consumption of the toner, can be achieved. Meanwhile, in the embodiment, it is possible to obtain effects similar to those in the fifth embodiment by changing the rising method of the charge voltage and the development voltage in the pre-rotation.

The voltage rising control in the embodiment will be specifically described. In the embodiment, in accordance with both the rotation amount of the developing sleeve 41 and the humidity or the moisture content in the periphery of the developing unit 4Y, a method of starting (rising) the application of the development voltage and the charge voltage by the operation (pre-rotation) from the operation start of each portion to the image formation start, is changed.

Also in the embodiment, the storage portion 103 also integrally stores the rotation amount (the total number of rotations) of the developing sleeve 41. In addition, the temperature and humidity sensor 50 is disposed in the apparatus body of the image forming apparatus 100. In addition, the control portion 101 switches the pre-rotation mode 1 and the pre-rotation mode 2 in accordance with the rotation amount (total number of rotations) stored in the storage portion 103, and the humidity or the moisture content (relative humidity) detected by the temperature and humidity sensor 50. In other words, the pre-rotation mode 1 is performed in the case where the rotation amount stored in the storage portion 103 is smaller than the predetermined lower limit rotation amount, and the humidity or the moisture content detected by the temperature and humidity sensor 50 is lower than the predetermined lower limit humidity or moisture content. Meanwhile, the pre-rotation mode 2 is performed in other cases.

Hereinafter, the voltage rising control in the embodiment will be specifically described. As illustrated in FIG. 19, when the operation of the pre-rotation is started according to the image formation start (S101), the control portion 101 obtains the total number of rotations (counter) of the developing sleeve 41 from the storage portion 103 (development counter confirmation). In addition, the control portion 101 detects the relative humidity in the periphery of the developing unit 4Y by the temperature and humidity sensor 50. In addition, it is determined whether or not the counter (rotation amount) is smaller than the predetermined lower limit number of rotations (predetermined lower limit rotation amount) stored in the storage portion 103 in advance. In addition, at the same time, it is determined whether or not the detected relative humidity (humidity or moisture content) is lower than the predetermined lower limit relative humidity (predetermined lower limit humidity or moisture content), and the mode of the pre-rotation is determined (S102). In the embodiment, for example, the predetermined lower limit number of rotations is also set to be a case where the image formation is performed on approximately 100,000 sheets on a paper sheet having a longitudinal size of A4. In addition, the predetermined lower limit relative humidity is set to be 40%.

Next, in a case (Y in S102) where the counter is smaller than the predetermined lower limit number of rotations (smaller than approximately 100,000 sheets), and the detected relative humidity is lower than the predetermined lower limit relative humidity (lower than 40%), the process moves to S103 (pre-rotation mode 1). In the case where any one of the conditions is not satisfied (N in S102), the process moves to S105 (pre-rotation mode 2). It is noted that the description of the control after S103 and S105 will be omitted since the processes after S103 and S105 are respectively similar to those after S53 and S55 illustrated in FIG. 12 of the fifth embodiment.

It is noted that, in the above-described description, as the information which influences the toner charging amount, similar to the tenth embodiment, both the rotation amount of the developing sleeve 41 and the humidity or the moisture content in the periphery of the developing unit 4Y are used. However, even when the rising method in the pre-rotation is switched as described in the embodiment, the mode of the pre-rotation may be switched in accordance with the information similar to that in the seventh to the ninth embodiments. In other words, the mode of the pre-rotation may be switched in accordance with the toner concentration as described in the seventh embodiment, the rotation amount of the developing sleeve 41 as described in the eighth embodiment, and the humidity or the moisture content in the periphery of the developing unit 4Y as described in the ninth embodiment, respectively.

In addition, the detection by the temperature and humidity sensor 50 may be performed when the previous image formation is completed. In this case, the detection result is stored in the storage portion 103 (refer to FIG. 3), and the control portion 101 performs the control in the pre-rotation described above based on the detection result stored by the storage portion 103 of the temperature and humidity sensor 50 when the previous image formation is completed, and based on the rotation amount (rotation time) stored in the storage portion 103. In addition, the control portion 101 may perform the detection both when the previous image formation is completed and when the current image formation is started, perform the pre-rotation mode 1 in the case where the detection result of at least any one of the cases is lower than the predetermined lower limit relative humidity, and the counter is smaller than the predetermined lower limit number of rotations, and perform the pre-rotation mode 2 in other cases.

Furthermore, as described in the ninth embodiment, in the case where the modes of the pre-rotation are switched in accordance with the humidity or the moisture content in the periphery of the developing unit 4Y, the detection by the temperature and humidity sensor 50 may also be performed when the previous image formation is completed. In this case, the storage portion 103 (refer to FIG. 3) stores the detection result, and the control portion 101 performs the control in the pre-rotation described above based on the detection result stored by the storage portion 103 of the temperature and humidity sensor 50 when the previous image formation is completed. In addition, the control portion 101 may perform the detection both when the previous image formation is completed and when the current image formation is started, perform the pre-rotation mode 1 in the case where the detection result of at least any one of the cases is lower than the predetermined lower limit relative humidity, and perform the pre-rotation mode 2 in other cases.

In the embodiment, the pre-rotation mode 1 in which the toner adhesion to the developing sleeve 41 is unlikely to occur, and the pre-rotation mode 2 in which unnecessary consumption of the toner due to the fogging can be suppressed, are switched based on the information which influences the toner charging amount. Therefore, similar to the seventh to the tenth embodiments, in the initial state of the developer, both the suppression of generation of the belt-like image due to the toner adhesion to the developing sleeve 41, and the suppression of unnecessary consumption of the toner, can be achieved. Other configurations and operations are similar to those in the seventh to the tenth embodiments.

The voltage falling method in the post rotation in the above-described seventh to tenth embodiments, and the rising method in the pre-rotation in the eleventh embodiment, are respectively switched based on the information which influences the toner charging amount. Both the operation of the post rotation and the operation of the pre-rotation may be performed. For example, the control illustrated in FIG. 18 is performed in the post rotation, and the control illustrated in FIG. 19 is used in the pre-rotation. Accordingly, it is possible to perform the control of the sleeve adhesion in a more linear state, and the control of toner consumption due to the discharge.

It is noted that, in the above-described tenth and eleventh embodiments, the modes are switched in accordance with both the rotation amount of the developing sleeve 41 and the humidity or the moisture content in the periphery of the developing unit 4Y. However, according to the condition of the toner concentration described in the seventh embodiment, it is possible to select the voltage falling operation of the post rotation and the rising operation of the pre-rotation. Furthermore, each embodiment may be realized by being appropriately combined with each other.

Twelfth Embodiment

A twelfth embodiment will be described by using FIGS. 20 to 23 with reference to FIGS. 1 to 3. In each of the above-described embodiments, a configuration in which a charging method of applying an oscillation voltage which is made by superposing an AC voltage on a DC voltage, is employed as a method of charging the surface of the photoconductive drum. Meanwhile, in the embodiment, a DC charging method of applying only the DC voltage to the charging roller is employed as the method of charging the surface of the photoconductive drum.

Figure 20:
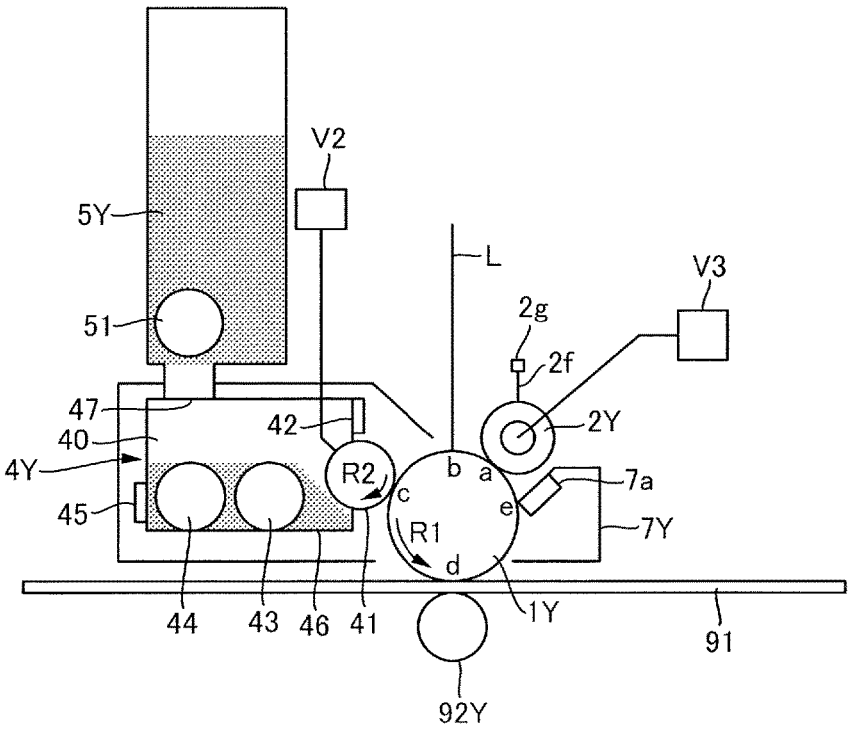
FIG. 20 is a schematic configuration sectional view illustrating an image forming portion according to a twelfth embodiment.

Specifically, as illustrated in FIG. 20, the DC voltage (Vdc) is applied to the charging roller 2Y from a charge power source (high voltage power source) V3 via a core metal. Accordingly, a circumferential surface of the rotating photoconductive drum 1Y is charged to a predetermined potential (charge potential). A contact portion of the charging roller 2Y and the photoconductive drum 1Y is a charge position (a). In the embodiment, when forming an image, the voltage (charge bias) applied to the charging roller 2 is a DC voltage of −1000 V. By any DC charge voltage, the circumferential surface of the photoconductive drum 1 is uniformly contact-charged to −500 V (charge voltage, dark potential Vd). It is noted that FIG. 20 is the same as FIG. 2 described in the first embodiment except that the charge power source is different.

However, in the DC charging method, since the toner adhesion to the developing sleeve is reduced, at the timing when the developing sleeve is stopped, by the falling of the development voltage after the charge voltage falls, there is a case where the toner adhesion to the developing sleeve cannot be suppressed even when the positional relationship between the developing sleeve and the photoconductive drum is set to be on the "fogging" side. In other words, in the DC charging method, a phenomenon occurs in which the falling of the drum potential takes time due to the influence of electrostatic capacity of the DC charge power source (high voltage power source) even when the application of the voltage is stopped. In this case, the relationship between the development potential and the drum potential is temporarily set to be on the "fogging" side since the drum potential gradually decreases, but after this, the relationship is set to be a relationship in which the toner on the developing sleeve is moved to the sleeve according to the decrease in the drum potential. In other words, the drum potential cannot be sufficiently reduced before the development voltage falls, and the toner adhesion to the developing sleeve cannot be suppressed. In addition, when the "fogging" occurs every time when the voltage falls, the toner is consumed more than necessary.

When describing more specifically, in the DC charging method, since the potential is likely to remain on the photoconductive drum 1Y when the charge voltage falls, it takes time for the falling of the potential on the photoconductive drum 1Y without following the output of the charge power source V3. In other words, in a case of controlling the charging or the falling of the development voltage, it is difficult to ensure the potential relationship between the drum potential and the development potential. In this case, the electric field is temporarily applied to move the toner on the developing sleeve 41 to the photoconductive drum 1 between the developing sleeve 41 and the photoconductive drum 1, but after this, the electric field is applied to move the toner on the developing sleeve 41 to the sleeve. Therefore, the toner adhesion onto the developing sleeve 41 cannot be suppressed.

Therefore, the embodiment provides a configuration in which both the suppression of generation of the toner adhesion to the developing sleeve, and the suppression of unnecessary consumption of the toner, are achieved, in particular, in the DC charging method. Specifically, by forcibly making the drum potential fall by neutralizing the surface of the photoconductive drum 1Y in the post rotation, generation of the toner adhesion onto the developing sleeve 41 is reduced.

Hereinafter, this will be specifically described. In the embodiment, the exposing unit 3Y is used as a neutralizing unit which can perform neutralization by exposing the surface of the photoconductive drum 1Y. The exposed zone potential, when neutralization and exposure are performed, is different from that when the image formation is performed, and for example, 0 V. In other words, when the image formation is performed and when the neutralization and exposure are performed, an exposing unit 3 emits laser light having different intensities, the charged surface of the photoconductive drum 1 is exposed, and an absolute value of the charge potential is reduced to each of predetermined potentials.

Voltage Falling Control

In the voltage falling control in the embodiment, the charging amount of the toner in the development container 40 is detected, and in accordance with this, a timing when the neutralization exposure is started with respect to the photoconductive drum 1 in the operation (post rotation) from the time when the image forming operation is completed to the time when the main body is stopped (operations of each portion are stopped), is changed.

Figure 21:
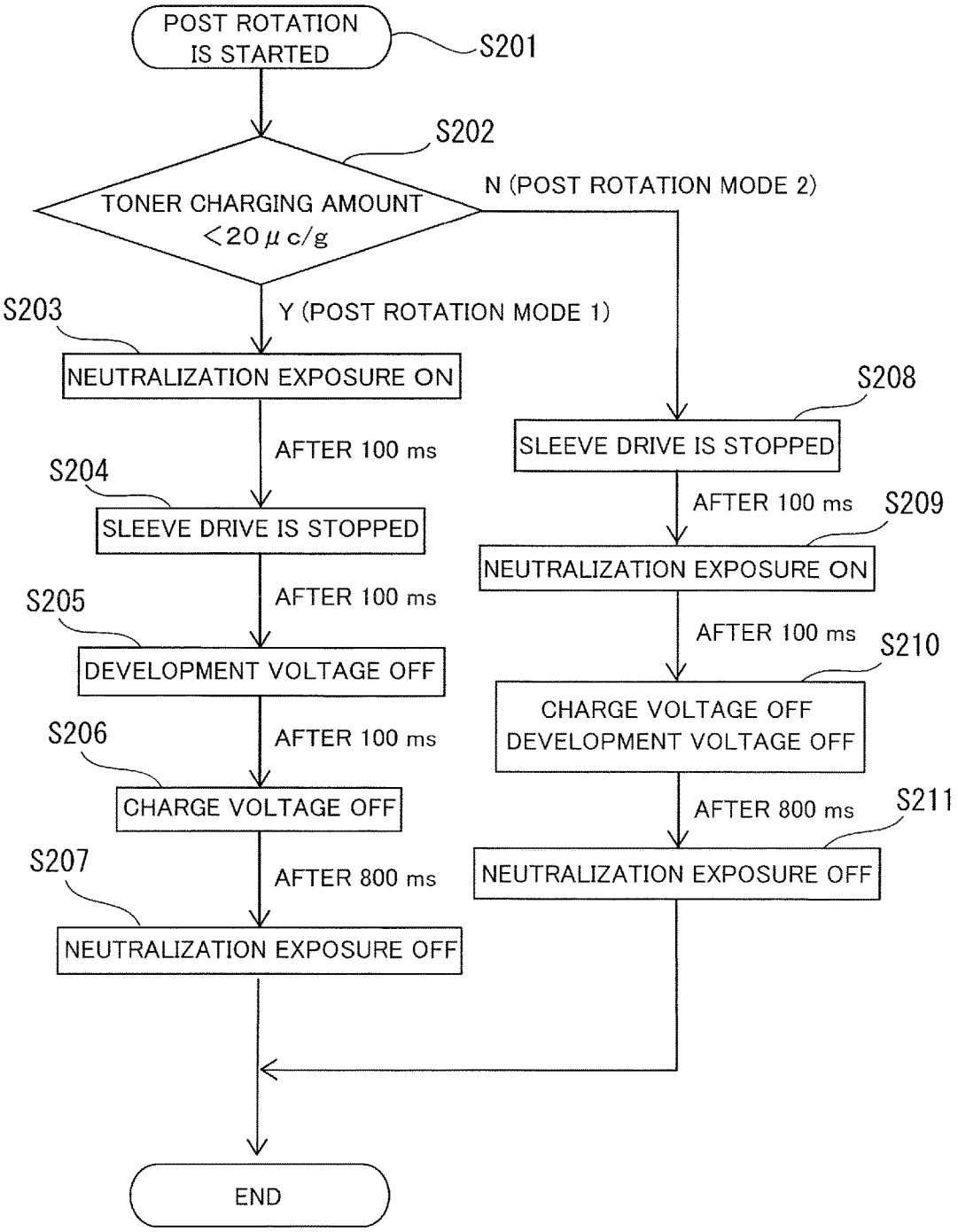
FIG. 21 is a flow chart of voltage falling control according to the twelfth embodiment.

As illustrated in FIG. 21, when the operation of the post rotation is started according to the image formation completion (S201), the control portion 101 determines whether or not the charging amount of the toner is smaller than a predetermined charging amount (in the embodiment, 20 μc/g) (S202). The charging amount of the toner is, for example, the charging amount which is most recently detected. In addition, the post rotation mode is determined by comparing the detected charging amount of the toner and the predetermined charging amount which is stored in the storage portion 103 in advance. In other words, the control portion 101 can perform the post rotation mode 1 which is the first mode, and the post rotation mode 2 which is the second mode. In addition, the post rotation mode 1 and the post rotation mode 2 are switched in accordance with the charging amount of the toner.

In the embodiment, in a case (Y in S202) where the detected charging amount of the toner is smaller than the predetermined charging amount (smaller than 20 μc/g), it is determined that the sleeve adhesion of the toner is likely to occur, and the process moves to S203 (post rotation mode 1). On the contrary, in the case (N in S202) where the detected charging amount of the toner is equal to or greater than the predetermined charging amount (equal to or greater than 20 μc/g), it is determined that the sleeve adhesion of the toner is unlikely to occur, and the process moves to S208 (post rotation mode 2). It is noted that since the above-described predetermined charging amount is a value which is determined by the used developer, the value itself changes in accordance with a performing machine.

Next, a setting method of the electric field in the post rotation after S203 and S208 will be described. In the embodiment, in accordance with the state of the toner identified in S202 as described above, after S203 and S208, the timing when the development voltage and the charge voltage fall in the post rotation, and the timing when the neutralization exposure is started, change.

Post Rotation Mode 1

Figure 22A:
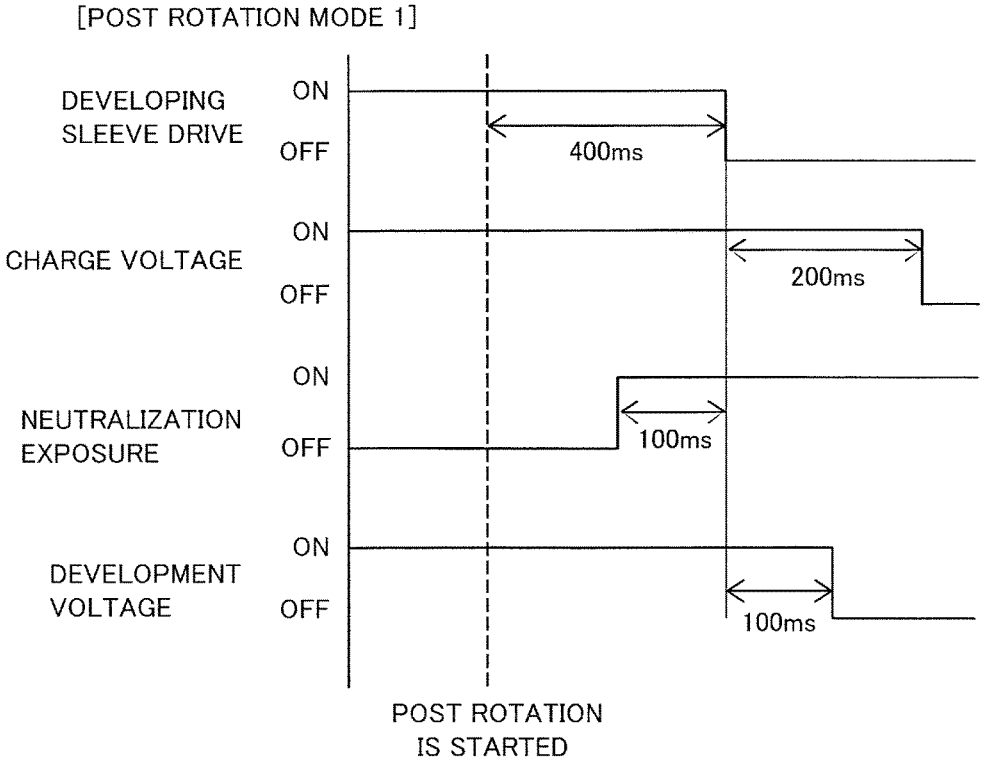
FIG. 22A is a timing chart of the post rotation mode 1 in the voltage falling control according to the twelfth embodiment.
Figure 22B:
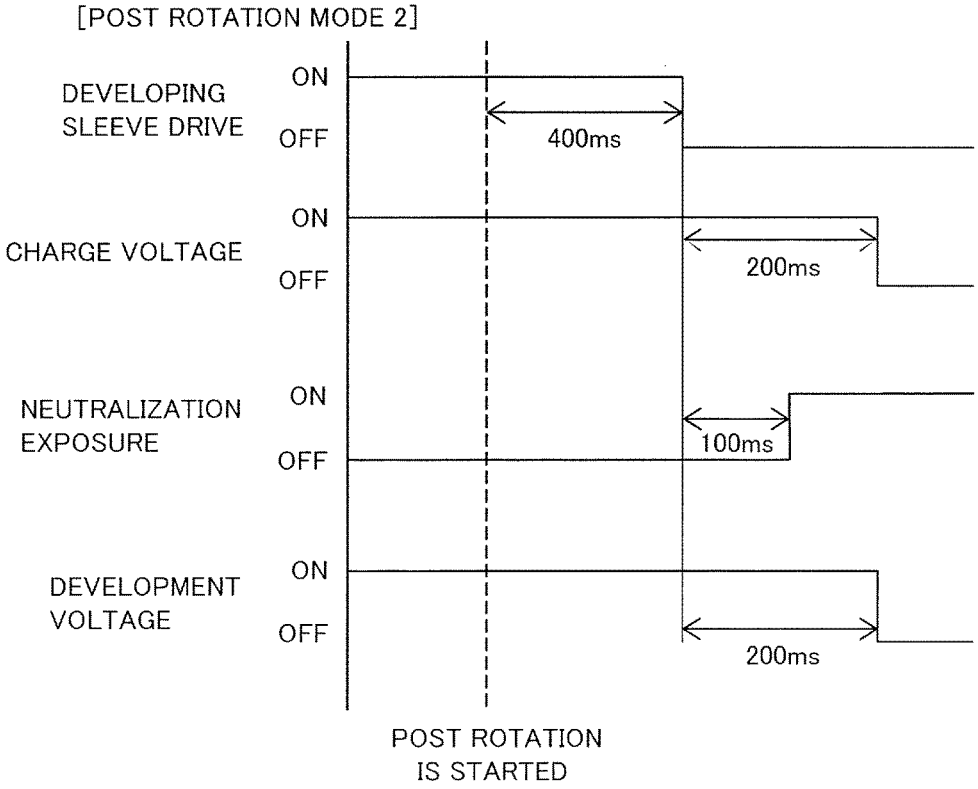
FIG. 22B is a timing chart of the post rotation mode 2 in the voltage falling control according to the twelfth embodiment.
Figure 23A:
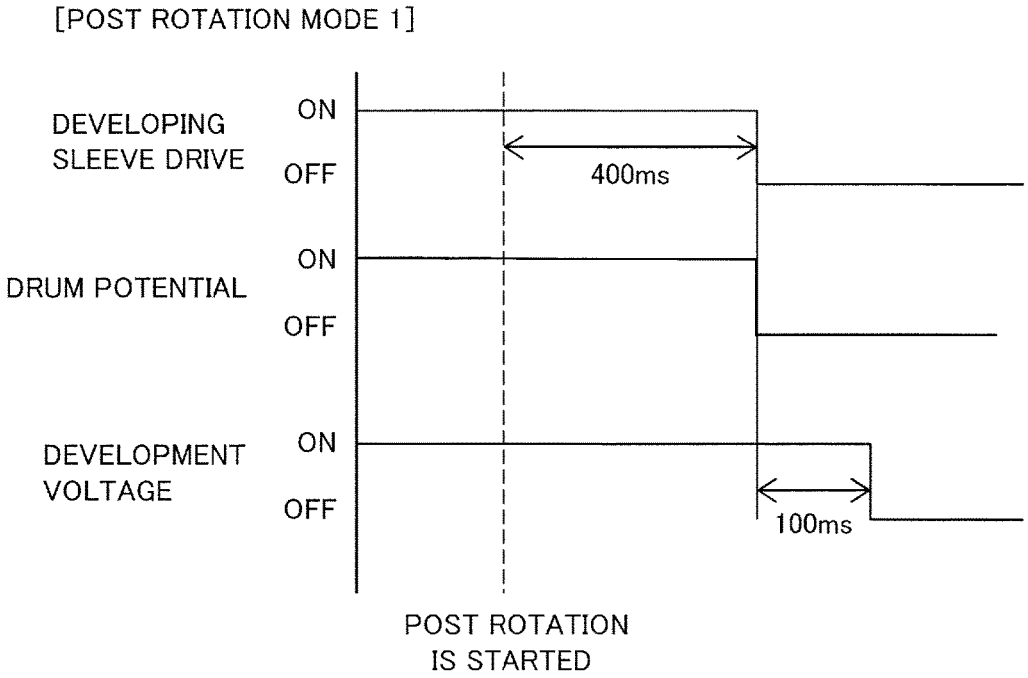
FIG. 23A is a timing chart of the post rotation mode 1 at the development position in the voltage falling control according to the twelfth embodiment.
Figure 23B:
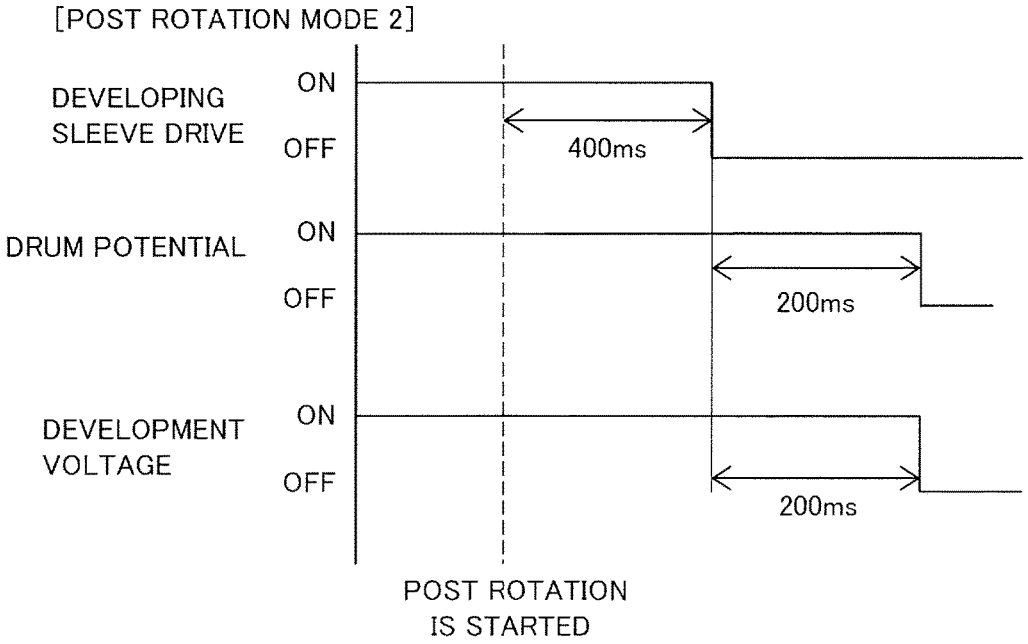
FIG. 23B is a timing chart of the post rotation mode 2 at the development position in the voltage falling control according to the twelfth embodiment.

First, the post rotation mode 1 (after S203) which is the first mode will be described with reference to FIGS. 22A and 23A. FIGS. 22A and 22B are timing charts of the stop of the rotation drive of the developing sleeve 41 (developing sleeve drive OFF), the application stop of the charge voltage by the charging roller 2Y (charge voltage OFF), the application stop of the development voltage by the developing unit 4Y (development voltage OFF), and the irradiation start of the laser light by the exposing unit 3 (neutralization exposure ON). FIGS. 23A and 23B are timing charts illustrating that the timing of voltage falling of each portion is at the development position (c) (FIG. 2). It is noted that since FIGS. 23A and 23B illustrate the state at the development position, the charge voltages of FIGS. 22A and 22B are replaced to the drum potential (charge potential). In other words, the states of the charge potential of the photoconductive drum 1Y at the development position are illustrated in FIGS. 7A and 7B.

In the post rotation mode 1, the rotation of the developing sleeve 41 is stopped (driving input is stopped) before or at the same time when a neutralization start portion (a leading end of a neutralization area or exposure start portion) on the photoconductive drum 1Y (on the image bearing member) neutralized by the exposing unit 3Y, i.e., a portion on the image bearing member which is located at the neutralization position (b) when neutralization by the neutralizing unit is started, reaches the development position (c) that opposes the developing sleeve 41. In other words, in the post rotation mode 1, the driving input to the developer bearing member 41 is stopped in response to image formation completion before or at the same time when a leading end of a neutralization area of the image bearing member which is neutralized by the neutralizing unit 3Y reaches the development position, and an application of the development voltage is stopped after the leading end of a neutralization area reaches the development position (c). More specifically, in the post rotation mode 1, the driving input to the developer bearing member 41 is stopped in response to image formation completion before or at the same time a leading end of an exposed area of the photoconductive member 1Y which is exposed by the exposing unit 3Y reaches the development position, and an application of the development voltage is stopped after the leading end of the exposed area reaches the development position (c). In addition, after this, the application of the development voltage is stopped. In addition, from the time when the neutralization by the exposing unit 3Y is started to the time when the neutralization is stopped, the charging by the charging roller 2Y is stopped. In the embodiment, as illustrated in FIGS. 21 and 22A, first, the neutralization exposure is started by the laser light (S203), the drive of the developing sleeve 41 is stopped after 100 msec (S204), and finally, the application of the development voltage is stopped (S205), and the application of the charge voltage is stopped (S206). In addition, the neutralization exposure is finally stopped (S207). The irradiation of the laser light for the neutralization exposure is stopped after the application of the charge voltage is stopped, for example, after 800 msec. It is noted that, as illustrated in FIG. 22A, the drive of the developing sleeve 41 is stopped after 400 msec after the post rotation operation is started.

Here, since the distance from the charge position (a) to the development position (c) illustrated in FIG. 20 is 48 mm, and the rotational speed of the photoconductive drum 1Y is 240 mm/sec, the time lag corresponds to 200 msec. In other words, the time for moving from the charge position (a) on the photoconductive drum 1Y to the development position (c) becomes 200 msec. In addition, the distance from the exposure position (b) to the development position (c) illustrated in FIG. 20 is 24 mm, and the time lag thereof corresponds to 100 msec. In other words, the time for moving from the exposure position (b) (neutralization position) on the photoconductive drum 1Y to the development position (c) becomes 100 msec. Therefore, a case where the timing of FIG. 22A is illustrated at the development position is illustrated in FIG. 23A. In other words, at the development position, the timing when the neutralization start portion (position of neutralization exposure ON) at which the neutralization exposure is started reaches the development position (drum potential OFF), and the timing when the developing sleeve 41 is stopped, become the same as each other. In addition, the development voltage after a predetermined time (here, 100 msec) of the timing becomes OFF. In other words, in the post rotation mode 1, the application of the development voltage is stopped at the timing when the predetermined time elapses after the neutralization start portion reaches the development position.

In this manner, in the post rotation mode 1, the drum potential at the development position becomes OFF at the timing when the rotation drive of the developing sleeve 41 is stopped, and the development voltage after this becomes OFF. Therefore, during the predetermined time (100 msec) from the drum potential OFF until the development voltage becomes OFF, the electric field (that is, voltage on the fogging side) is applied to move the toner on the developing sleeve 41 to the photoconductive drum 1. Then, as illustrated in FIG. 4B, the toner 48 does not adhere to the surface of the developing sleeve 41 when the developing sleeve is stopped, a state where the toner 48 is uniformly adhered to the carrier 49 can be held, and occurrence of the toner adhesion onto the developing sleeve 41 can be suppressed.

It is noted that, in the embodiment, an example in which the timing when the drum potential becomes OFF and the timing when the developing sleeve 41 is stopped become substantially the same as each other at the development position, is illustrated. However, it is not necessary that the timings are the same as each other, and the timing when the developing sleeve 41 is stopped can be set before the drum potential becomes OFF. In other words, the rotation of the developing sleeve 41 may be stopped before the neutralization start portion reaches the development position. In addition, the timing when the developing sleeve 41 is stopped may be the time when the image formation is completed (time when the post rotation is started). Therefore, the stop timing of the developing sleeve 41 may be within a time period from the time when the image formation is completed to the time when the drum potential becomes OFF.

In this case, from the time when the developing sleeve 41 is stopped to the time when the drum potential becomes OFF, Vback is applied to a certain position of the developing sleeve 41. Therefore, the toner adhesion slightly occurs in the developing sleeve 41. However, after this, as the positional relationship between the drum potential and the development voltage is reversed (potential is applied to the fogging side), the toner adhesion to the developing sleeve 41 is eliminated. On the contrary, a case where the developing sleeve 41 is also rotated after the drum potential becomes OFF is not preferable since the potential is applied to the fogging side while the developing sleeve 41 rotates, and a large amount of toner is consumed.

Post Rotation Mode 2

Next, the post rotation mode 2 (after S208) which is the second mode will be described with reference to FIGS. 22B and 23B. In the post rotation mode 2, the application of the development voltage is stopped at substantially the same time when the neutralization start portion on the photoconductive drum 1Y (on the image bearing member) neutralized by the exposing unit 3Y reaches the development position (c) that opposes the developing sleeve 41. In addition, the rotation of the developing sleeve 41 is stopped before or at the same time when the neutralization start portion reaches the development position (c) (driving input is stopped). In other words, in the post rotation mode 2, the driving input to the developer bearing member 41 is stopped in response to image formation completion before or at the same time when the leading end of a neutralization area reaches the development position (c), and the application of the development voltage is stopped at a timing after the leading end of a neutralization area reaches the development position (c) and earlier than that in the first mode, or at the same time when the leading end of the neutralization area reaches the development position (c). More specifically, in the post rotation mode 2, the driving input to the developer bearing member 41 is stopped in response to image formation completion before or at the same time when the leading end of the exposed area reaches the development position (c), and the application of the development voltage is stopped at a timing after the leading end of the exposed area reaches the development position and earlier than that in the post rotation mode 1, or at the same time when the leading end of the exposed area reaches the development position. In the embodiment, from the time when the neutralization is started by the exposing unit 3Y to the time when the neutralization is stopped, the charging by the charging roller 2 is stopped. In the embodiment, as illustrated in FIGS. 21 and 22B, the drive of the developing sleeve 41 is stopped after 400 msec after the post rotation operation is started (S208), and the neutralization exposure is started after 100 msec by the laser light (S209). In addition, after this, the application of the charge voltage is stopped and the application of the development voltage is stopped at substantially the same time (S210). After this, the neutralization exposure is stopped after 800 msec (S211). A case where the timing of FIG. 22B is illustrated at the development position is illustrated in FIG. 23B. In other words, at the development position, after 600 msec after the drive of the developing sleeve 41 is stopped, the drum potential and the development voltage become OFF at substantially the same time.

In the post rotation mode 2, from the time when the rotation drive of the developing sleeve 41 is stopped to the time when the development voltage becomes OFF, the electric field is applied to move the toner on the developing sleeve 41 to the developing sleeve 41 side by Vback. Therefore, it is possible to suppress consumption of the toner.

It is noted that preferably, the timings when the drum potential and the development voltage become OFF become completely the same as each other at the development position (c) in order to avoid the carrier adhesion or the fogging. However, when considering irregularity of the control signal or irregularity of output characteristics of the laser light, it is preferable that the control timing is set to slightly (for example, approximately equal to or less than 50 msec) delay setting the development voltage to be OFF. Accordingly, it is possible to avoid the carrier adhesion which largely influences transferring or cleaning. In this case, slight fogging occurs, but since the extent of the fogging occurred is extremely slight when the time is extremely short, there is not a problem when the timings are set to be substantially the same as each other. However, in the post rotation mode 2, the application of the development voltage is stopped at the timing (within a predetermined time) which is earlier than that in the post rotation mode 1 after the neutralization start portion reaches the development position, and the toner consumption is suppressed compared to the post rotation mode 1.

In the description above, a case where the drum potential and the development voltage become OFF at the same time after the rotation drive of the developing sleeve 41 is stopped at the development position (c), is illustrated. However, at the development position (c), the rotation drive of the developing sleeve 41 may be stopped and the drum potential and the development voltage may become OFF at the same time. Furthermore, the timing when the rotation drive of the developing sleeve 41 is stopped may be a timing after the drum potential and the development voltage become OFF at substantially the same time at the development position (c). This is because the fogging does not occur even when the developing sleeve 41 is rotated since the electric field does not act between the developing sleeve 41 and the photoconductive drum 1 in a state where the drum potential and the development voltage are OFF. However, in the case where the timing when the development voltage becomes OFF is controlled to be slightly later than the timing when the drum potential becomes OFF at the development position (c), it is preferable that the drive of the developing sleeve 41 is stopped before the development voltage and the drum potential become OFF.

As described above, in the embodiment, as the control in the post rotation, the post rotation mode 1 in which the toner adhesion to the developing sleeve 41 is unlikely to occur, and the post rotation mode 2 in which unnecessary consumption of the toner due to the fogging can be suppressed, are switched based on the information which influences the toner charging amount. Specifically, the timing when the neutralization exposure is started with respect to the photoconductive drum 1 is changed in accordance with the charging amount of the toner in the development container 40. In this manner, both the suppression of generation of the belt-like image due to the toner adhesion to the developing sleeve 41, and the suppression of unnecessary consumption of the toner, can be achieved. Other configuration elements and effects are similar to those in the first embodiment.

Thirteenth Embodiment

A thirteenth embodiment will be described by using FIG. 24 with reference to FIGS. 1, 3, and 20. In the above-described twelfth embodiment, the post rotation mode 1 and the post rotation mode 2 are switched in accordance with the charging amount of the toner, but in the embodiment, the switching is performed in accordance with the rotation amount of the developing sleeve 41 which is the information which influences the toner charging amount. In particular, in the embodiment, the switching is performed in accordance with the number of rotations of the developing sleeve 41. It is noted that other than the number of rotations, for example, rotation time may be employed as the rotation amount of the developing sleeve 41. In addition, since any factor may be employed if the deterioration situation of the carrier can be determined, the switching may be performed in accordance with the rotation amount (the number of rotations, rotation time) of the screws 43 and 44 in the developing unit 4Y. In any cases, in accordance with the rotation amount of the developing sleeve 41, the timing when the neutralization exposure is started with respect to the photoconductive drum 1 in the operation (post rotation) from the time when the image forming operation is completed to the time when the main body is stopped, is changed.

As described above, the charging amount of the toner and the carrier is charged by the frictional charge, but by the use for a long period of time, the charging performance of the carrier deteriorates. Here, in the embodiment, the timing when the neutralization exposure is started with respect to the photoconductive drum 1Y is changed in accordance with the use state of the developer. The deterioration situation of the carrier due to the use for a long period of time can be ascertained from the rotation amount (here, the total number of rotations) of the developing sleeve 41. In other words, since the charging characteristics of the developer deteriorate in the case where the rotation amount (total number of rotations) of the developing sleeve 41 is greater than a predetermined upper limit rotation amount (predetermined upper limit number of rotations), it is determined that the toner adhesion to the developing sleeve 41 is likely to occur. Meanwhile, in the case where the rotation amount (total number of rotations) of the developing sleeve 41 is equal to or smaller than the predetermined upper limit rotation amount (equal to or smaller than the predetermined upper limit number of rotations), the charging characteristics of the developer are maintained, and it is determined that the toner adhesion to the developing sleeve 41 is unlikely to occur.

Therefore, in the embodiment, the storage portion 103 integrally stores the rotation amount (the total number of rotations) of the developing sleeve 41. In addition, the control portion 101 switches the post rotation mode 1 and the post rotation mode 2 in accordance with the total number of rotations stored in the storage portion 103. In other words, the control portion 101 performs the post rotation mode 1 in the case where the total number of rotations of the developing sleeve 41 is greater than the predetermined upper limit number of rotations, and the post rotation mode 2 in the case where the total number of rotations of the developing sleeve 41 is equal to or less than the predetermined upper limit number of rotations.

Hereinafter, the voltage falling control in the embodiment will be specifically described. In the embodiment, the deterioration situation of the developer in the development container 40 is assumed from the rotation amount of the developing sleeve 41, and in accordance with this, the timing when the neutralization exposure is started with respect to the photoconductive drum 1 in the operation (post rotation) from the time when the image forming operation is completed to the time when the main body is stopped, is changed.

Figure 24:
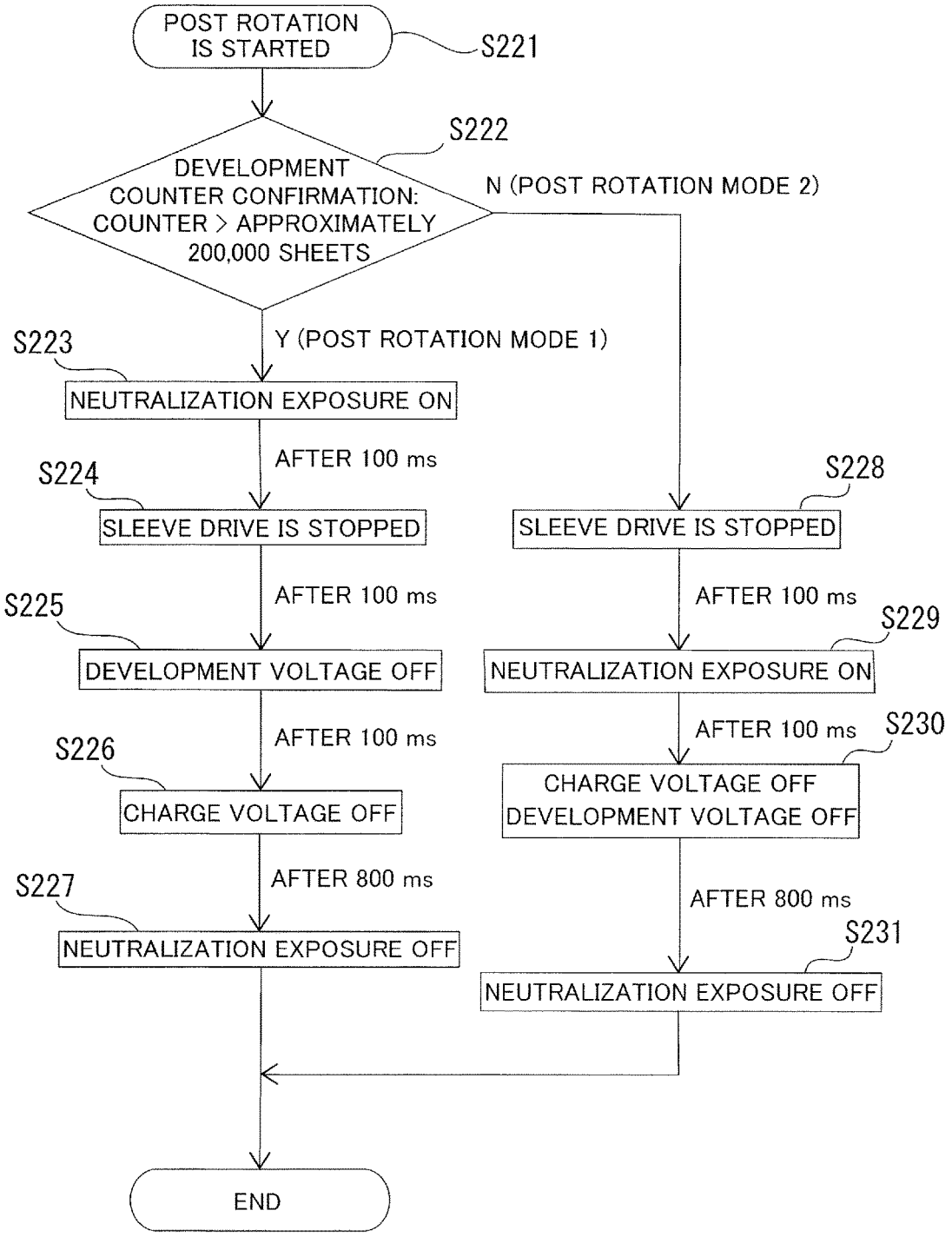
FIG. 24 is a flow chart of voltage falling control according to a thirteenth embodiment.

As illustrated in FIG. 24, when the operation of the post rotation is started according to the image formation completion (S221), the control portion 101 obtains the total number (counter) of rotations of the developing sleeve 41 from the storage portion 103 (development counter confirmation). In addition, it is determined whether or not the counter is smaller than the predetermined upper limit number of rotations stored in the storage portion 103, and the mode of the post rotation is determined (S222). In the embodiment, for example, the predetermined upper limit number of rotations is set to be a case where the image formation is performed on approximately 200,000 sheets on a paper sheet having a longitudinal size of A4. Next, in a case (Y in S222) where the counter is greater than the predetermined upper limit number of rotations (greater than approximately 200,000 sheets), it is determined that the sleeve adhesion of the toner is likely to occur, and the process moves to S223 (post rotation mode 1). On the contrary, in the case (N in S222) where the counter is equal to or less than the predetermined rotation amount (equal to or less than approximately 200,000 sheets), it is determined that the sleeve adhesion of the toner is unlikely to occur, and the process moves to S228 (post rotation mode 2).

It is noted that since a value which corresponds to approximately 200,000 sheets which is a developer deterioration standard used here, is a value which is determined by the used developer, the value itself changes in accordance with a performing machine. In addition, the description of the control after S223 and S228 will be omitted since the processes after S223 and S228 are respectively similar to those after S203 and S208 illustrated in FIG. 21 of the twelfth embodiment.

In the embodiment, the post rotation mode 1 and the post rotation mode 2 are switched in accordance with the total number of rotations of the developing sleeve 41. Therefore, similar to the twelfth embodiment, both the suppression of generation of the belt-like image due to the toner adhesion to the developing sleeve 41, and the suppression of unnecessary consumption of the toner, can be achieved. Other configurations and operations are similar to those in the twelfth embodiment.

Fourteenth Embodiment

A fourteenth embodiment will be described by using FIG. 25 with reference to FIGS. 1, 3, and 20. In the above-described twelfth embodiment, the post rotation mode 1 and the post rotation mode 2 are switched in accordance with the charging amount of the toner, but in the embodiment, the switching is performed in accordance with the humidity or the moisture content in the periphery of the developing unit 4Y as the information which influences the toner charging amount. In particular, in the embodiment, the switching is performed in accordance with relative humidity in the periphery of the developing unit 4Y.

The toner adhesion to the developing sleeve 41 receives the influence on the charging amount of the toner as described above, but the charging amount of the toner receives the influence of the relative humidity of the environment where the developing unit 4 is installed. Since the charging of the toner is performed by the frictional charging of the carrier and the toner, there is a tendency that the charging amount of the toner decreases when the humidity is high. Therefore, in the embodiment, by detecting the relative humidity in the periphery of the developing unit 4Y, in accordance with this, the timing when the neutralization exposure is started with respect to the photoconductive drum 1Y, is changed. In addition, in the environment of high humidity where the sleeve adhesion is likely to occur, the voltage on the fogging side is changed when the voltage falls. On the contrary, in the environment of low humidity where the sleeve adhesion is unlikely to occur, unnecessary consumption of the toner is suppressed by setting the voltage falling condition in which the fogging is unlikely to occur.

In this manner, in the embodiment, the post rotation mode 1 is performed in the case where the relative humidity (humidity or moisture content) detected by the temperature and humidity sensor 50 (FIG. 1) is higher than the predetermined upper limit relative humidity (predetermined upper limit humidity or moisture content), and the post rotation mode 2 is performed in the case where the relative humidity is equal to or lower than the predetermined upper limit relative humidity (equal to or lower than the predetermined upper limit humidity or moisture content).

Hereinafter, the embodiment will be specifically described. In the embodiment, the charging amount of the toner in the developing unit 4Y is assumed by detecting the relative humidity in the periphery of the developing unit 4Y, and in accordance with this, the timing when the neutralization exposure is started with respect to the photoconductive drum 1Y in the operation (post rotation) from the time when the image forming operation is completed to the time when the main body is stopped, is changed.

Figure 25:
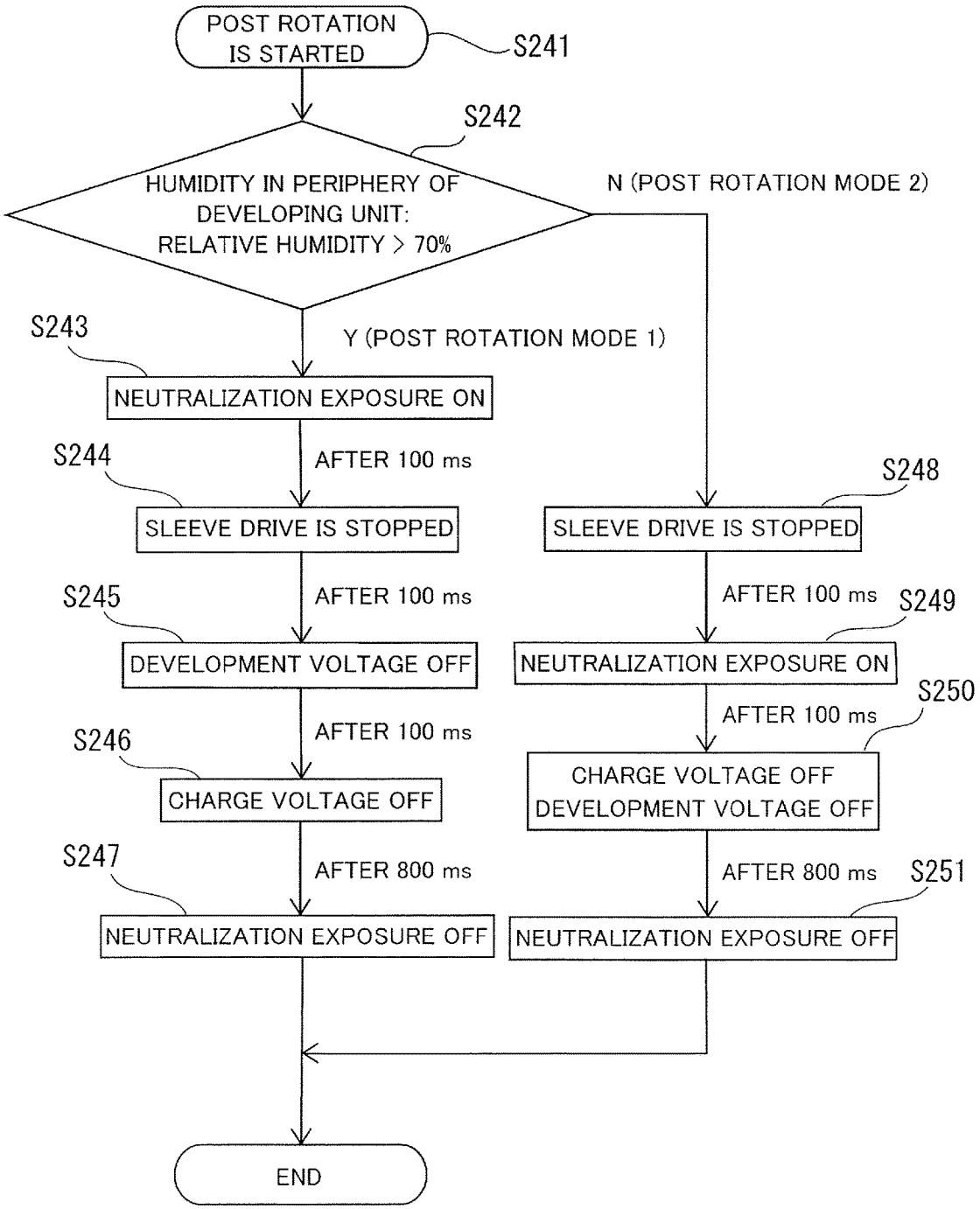
FIG. 25 is a flow chart of voltage falling control according to a fourteenth embodiment.

As illustrated in FIG. 25, when the operation of the post rotation is started according to the image formation completion (S241), the control portion 101 detects the relative humidity in the periphery of the developing unit 4Y by the temperature and humidity sensor 50. In addition, it is determined whether or not the detected relative humidity is higher than the predetermined upper limit relative humidity (70% in the embodiment), and the mode of the post rotation is determined (S242). Next, in a case (Y in S242) where the detected relative humidity is higher than the predetermined upper limit relative humidity (higher than 70%), it is determined that the sleeve adhesion of the toner is likely to occur, and the process moves to S243 (post rotation mode 1). On the contrary, in the case (N in S242) where the detected relative humidity is equal to or lower than the predetermined upper limit relative humidity (equal to or lower than 70%), it is determined that the sleeve adhesion of the toner is unlikely to occur, and the process moves to S248 (post rotation mode 2).

It is noted that, in the embodiment, the operation of the post rotation is switched by using the relative humidity, which is set to be 70%, as a boundary, but since the value of the humidity of switching changes according to the used developer, the most appropriate value changes in accordance with the developer. In addition, there is a developer in which the charging amount changes in accordance with not the relative humidity but the moisture content in the environment, and at this time, it is possible to obtain similar effects by the switching in accordance with not the relative humidity but the moisture content. In addition, the description of the control after S243 and S248 will be omitted since the processes after S243 and S248 are respectively similar to those after S203 and S208 illustrated in FIG. 21 of the twelfth embodiment.

In the embodiment, the post rotation mode 1 and the post rotation mode 2 are switched in accordance with the environment in the periphery of the developing unit 4Y. Therefore, similar to the twelfth embodiment, both the suppression of generation of the belt-like image due to the toner adhesion to the developing sleeve 41, and the suppression of unnecessary consumption of the toner, can be achieved. Other configurations and operations are similar to those in the twelfth embodiment.

Fifteenth Embodiment

Figure 26:
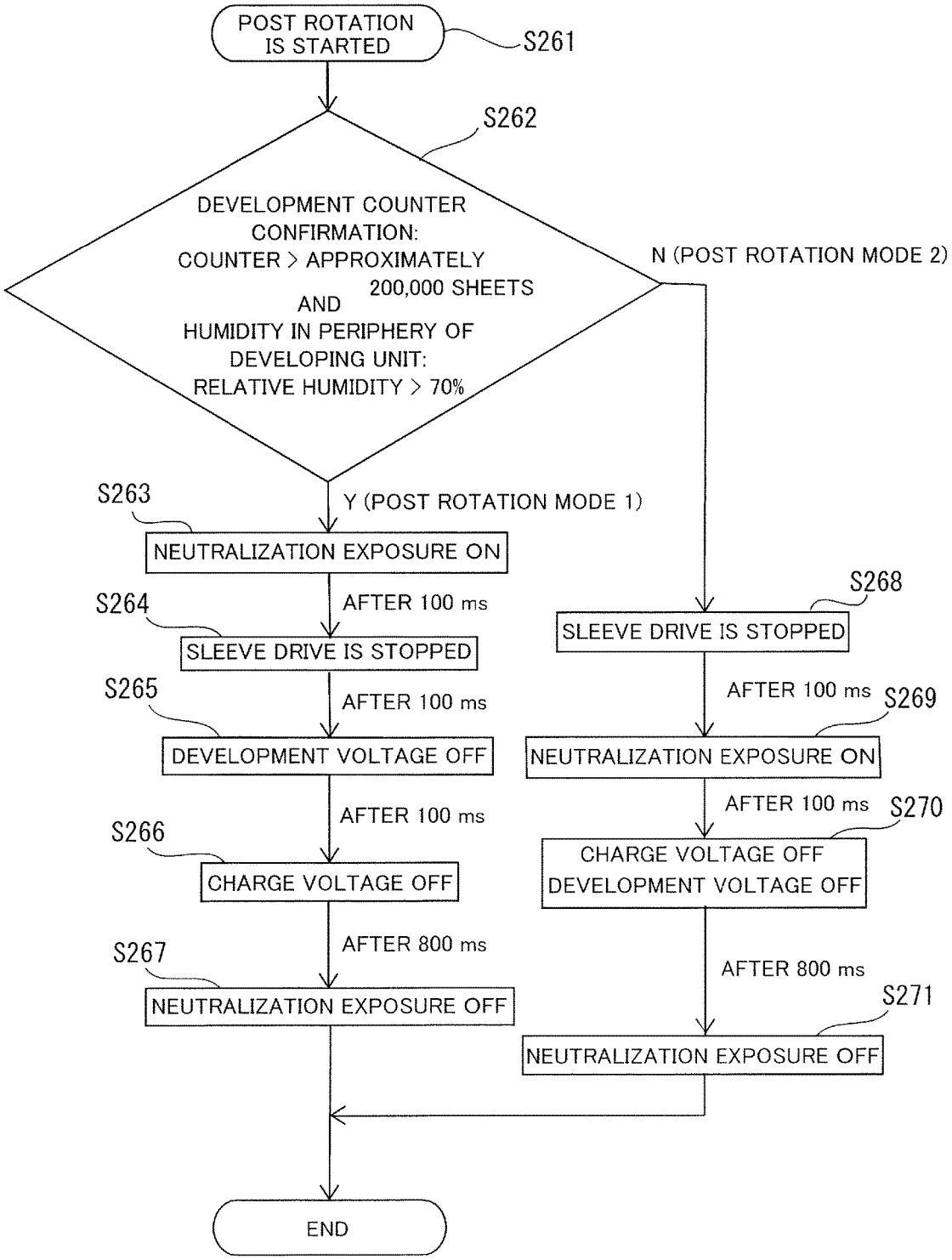
FIG. 26 is a flow chart of voltage falling control according to a fifteenth embodiment.

A fifteenth embodiment will be described by using FIG. 26 with reference to FIGS. 1, 3, and 20. An example in which the post rotation mode 1 and the post rotation mode 2 are switched in accordance with the rotation amount of the developing sleeve 41 is illustrated in the above-described thirteenth embodiment, and an example in which the post rotation mode 1 and the post rotation mode 2 are switched in accordance with the humidity or the moisture content in the periphery of the developing unit 4Y is illustrated in the above-described fourteenth embodiment, respectively. Meanwhile, in the embodiment, the switching is performed in accordance with both the rotation amount of the developing sleeve 41 and the humidity or the moisture content in the periphery of the developing unit 4Y.

Therefore, also in the embodiment, similar to the thirteenth embodiment, the storage portion 103 integrally stores the rotation amount (the total number of rotations) of the developing sleeve 41. In addition, similar to the fourteenth embodiment, the temperature and humidity sensor 50 is disposed in the apparatus body of the image forming apparatus 100. In addition, the control portion 101 switches the post rotation mode 1 and the post rotation mode 2 in accordance with the rotation amount (total number of rotations) stored in the storage portion 103, and the humidity or the moisture content (relative humidity) detected by the temperature and humidity sensor 50. In other words, the post rotation mode 1 is performed in the case where the rotation amount stored in the storage portion 103 is greater than the predetermined upper limit rotation amount, and the humidity or the moisture content detected by the temperature and humidity sensor 50 is higher than the predetermined upper limit humidity or moisture content. Meanwhile, the post rotation mode 2 is performed in other cases.

Hereinafter, the voltage falling control in the embodiment will be specifically described. As illustrated in FIG. 26, when the operation of the post rotation is started according to the image formation completion (S261), the control portion 101 obtains the total number of rotations (counter) of the developing sleeve 41 from the storage portion 103 (development counter confirmation). In addition, the control portion 101 detects the relative humidity in the periphery of the developing unit 4Y by the temperature and humidity sensor 50. In addition, it is determined whether or not the counter (rotation amount) is greater than the predetermined upper limit number of rotations (predetermined upper limit rotation amount) stored in the storage portion 103 in advance. In addition, at the same time, it is determined whether or not the detected relative humidity (humidity or moisture content) is higher than the predetermined upper limit relative humidity (the predetermined upper limit humidity or moisture content), and the mode of the post rotation is determined (S262). In the embodiment, for example, the predetermined upper limit number of rotations is also set to be a case where the image formation is performed on approximately 200,000 sheets on a paper sheet having a longitudinal size of A4. In addition, the predetermined upper limit relative humidity is set to be 70%.

Next, in a case (Y in S262) where the counter is greater than the predetermined upper limit number of rotations (greater than approximately 200,000 sheets), and the detected relative humidity is higher than the predetermined upper limit relative humidity (higher than 700), the process moves to S263 (post rotation mode 1). On the contrary, in the case where any one of the conditions is not satisfied (N in S262), the process moves to S268 (post rotation mode 2). It is noted that the description of the control after S263 and S268 will be omitted since the processes after S263 and S268 are respectively similar to those after S203 and S208 illustrated in FIG. 21 of the twelfth embodiment.

In the embodiment, it is possible to further limit a state where the sleeve adhesion of the toner occurs by the total number of rotations of the developing sleeve 41 and the environment in the periphery of the developing unit 4Y. As a result, since frequency of performing the post rotation mode 1 in which the toner is discharged is decreased, it is possible to further suppress consumption of the toner. Other configuration elements and effects are similar to those in the thirteenth and fourteenth embodiments.

Sixteenth Embodiment

A sixteenth embodiment will be described. As described in the sixth embodiment, the sleeve adhesion of the toner can occur even in the initial state (for example, a case where the image formation is performed on 100,000 sheets or more and less than 200,000 sheets) of the developer where the use of the developer in the developing unit is started.

Here, in the embodiment, even in the initial state of the developer where the use of the developer in the developing unit is started, based on the information which influences the toner charging amount, the first mode and the second mode are switched. The first mode is the same as the post rotation mode 1 of the twelfth to fifteenth embodiments, and the second mode is the same as the post rotation mode 2 of the twelfth to fifteenth embodiments, respectively. However, in the initial state, the standard of switching the modes is different in the case where the apparatus is used for a long period of time as described in the twelfth to fifteenth embodiments.

In other words, in the initial state, as described above, the toner is replenished and the toner concentration increases in the case where the charging amount of the toner is high, unevenness occurs in the charging amount of the toner in the developer, and the sleeve adhesion occurs due to the toner having a low charging amount. Therefore, in the initial state, by detecting the toner concentration, the first mode is performed in the case where the detected toner concentration is higher than the predetermined concentration, and the second mode is performed in the case where the detected toner concentration is equal to or lower than the predetermined concentration. The predetermined concentration is, for example, set to be 10%.

In addition, the first mode in which the developer is in the initial state may be performed in the case where the rotation amount of the developing sleeve is integrated and stored, and the stored rotation amount is smaller than the predetermined lower limit rotation amount, and the second mode may be performed in the case where the stored rotation amount is equal to or greater than the predetermined lower limit rotation amount. Furthermore, by detecting the humidity or the moisture content in the periphery of the developing unit, the first mode in which the charging amount of the toner is high and the sleeve adhesion is likely to occur, is performed in the case where the detected humidity or moisture content is lower than the predetermined lower limit humidity or moisture content, and the second mode is performed when the detected humidity or moisture content is equal to or higher than the predetermined lower limit humidity or moisture content. In addition, the determination may be performed by appropriately combining the conditions. It is noted that the predetermined rotation amount in the initial state is smaller than the predetermined upper limit rotation amount of the thirteenth embodiment, and for example, is set to be a case where the image formation is performed on approximately 100,000 sheets on a paper sheet having a longitudinal size of A4. In addition, the predetermined lower limit humidity or moisture content in the initial state is lower than the predetermined upper limit humidity or moisture content in the fourteenth embodiment, and for example, is set to be a case where the relative humidity is 40%.

In addition, in the embodiment, similar to the twelfth to the fifteenth embodiments, even in a state where the apparatus is used for a long period of time, based on the information which influences the toner charging amount, the first mode and the second mode are switched.

In the embodiment, in addition to the state where the apparatus is used for a long period of time, even in the initial state of the developer, based on the information which influences the toner charging amount, the first mode and the second mode are switched. Therefore, even in any of the states, both the suppression of generation of the belt-like image due to the toner adhesion to the developing sleeve 41, and the suppression of unnecessary consumption of the toner, can be achieved.

It is noted that, in the above-described fifteenth embodiment, the modes are switched in accordance with both the rotation amount of the developing sleeve 41 and the humidity or the moisture content in the periphery of the developing unit 4Y. However, according to the condition of the charging amount of the toner described in the twelfth embodiment, it is possible to select the voltage falling operation of the post rotation. Furthermore, each embodiment may be realized by being appropriately combined with each other.

It is noted that, in the above-described twelfth to sixteenth embodiments, the neutralization exposure is performed with respect to the surface of the photoconductive drum 1Y by the exposing unit 3Y, but the invention is not limited thereto. For example, an additional neutralizing unit may be provided in addition to the exposing unit 3Y further on the downstream side of the photoconductive drum 1Y in the direction of rotation with respect to the charging roller 2Y, and the surface of the photoconductive drum 1Y may be neutralized by using the additional neutralizing unit without using the exposing unit 3Y. Furthermore, each embodiment may be realized by being appropriately combined with each other.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-091670, filed Apr. 28, 2015, Japanese Patent Application No. 2015-091672, filed Apr. 28, 2015 and Japanese Patent Application No. 2015-091669, filed Apr. 28, 2015 which are hereby incorporated by reference herein in their entirety.

What is claimed is:

1. An image forming apparatus comprising:

an image bearing member configured to rotate;

a charging unit configured to charge a surface of the image bearing member at a charging position;

a developing unit configured to develop an electrostatic latent image formed on the image bearing member at a development position, the developing unit comprising a developer bearing member configured to rotate while bearing a developer containing a toner and a carrier thereon and configured to be applied a development voltage; and a control portion configured to perform a first mode and a second mode, the first mode being a mode in which a driving input to the developer bearing member is stopped in response to image formation completion before or at the same time when a trailing end of a charging area of the image bearing member charged by the charging unit reaches the development position, and an application of the development voltage is stopped after the trailing end of the charging area reaches the development position, the second mode being a mode in which the driving input to the developer bearing member is stopped in response to image formation completion before or at the same time when the trailing end of the charging area reaches the development position, and the application of the development voltage is stopped at a timing after the trailing end of the charging area reaches the development position and earlier than that in the first mode, or at the same time when the trailing end of the charging area reaches the development position, wherein the control portion is configured to switch the first mode and the second mode based on information which influences a toner charging amount.

2. The image forming apparatus according to claim 1, wherein the control portion is configured to stop the application of the development voltage at substantially the same time when the trailing end of the charging area reaches the development position in the second mode.

3. The image forming apparatus according to claim 1, wherein the control portion is configured to switch the first mode and the second mode based on a use state of the developer after predetermined time elapses from starting to use the developer in the developing unit.

4. The image forming apparatus according to claim 1, further comprising a charging amount detection portion configured to detect the charging amount of the toner, wherein the control portion is configured to perform the first mode in a case where the charging amount of the toner detected by the charging amount detection portion is smaller than a predetermined charging amount, and to perform the second mode in a case where the charging amount of the toner is equal to or greater than the predetermined charging amount.

5. The image forming apparatus according to claim 1, further comprising a storage portion configured to integrally store a rotation amount of the developer bearing member, wherein the control portion is configured to perform the first mode in a case where the rotation amount stored in the storage portion is greater than a predetermined upper limit rotation amount, and to perform the second mode in a case where the rotation amount is equal to or smaller than the predetermined upper limit rotation amount.

6. The image forming apparatus according to claim 1, further comprising a humidity detection portion configured to detect humidity or moisture content in a periphery of the developing unit, wherein the control portion is configured to perform the first mode in a case where the humidity or the moisture content which is detected by the humidity detection portion is higher than predetermined upper limit humidity or moisture content, and to perform the second mode in a case where the humidity or the moisture content is equal to or lower than the predetermined upper limit humidity or moisture content.

7. The image forming apparatus according to claim 1, further comprising:

a storage portion configured to integrally store a rotation amount of the developer bearing member; and a humidity detection portion configured to detect humidity or moisture content in a periphery of the developing unit, wherein the control portion is configured to perform the first mode in a case where the rotation amount stored in the storage portion is greater than the predetermined upper limit rotation amount, and the humidity or the moisture content which is detected by the humidity detection portion is higher than predetermined upper limit humidity or moisture content, and to perform the second mode in other cases.

8. The image forming apparatus according to claim 1, further comprising a storage portion configured to integrally store a rotation amount of the developer bearing member, wherein the control portion is configured to perform the first mode in a case where the rotation amount stored in the storage portion is smaller than a predetermined lower limit rotation amount, and to perform the second mode in a case where the rotation amount is equal to or greater than the predetermined lower limit rotation amount.

9. The image forming apparatus according to claim 1, further comprising a humidity detection portion configured to detect humidity or moisture content in a periphery of the developing unit, wherein the control portion is configured to perform the first mode in a case where the humidity or the moisture content which is detected by the humidity detection portion is lower than predetermined lower limit humidity or moisture content, and to perform the second mode in a case where the humidity or the moisture content is equal to or higher than the predetermined lower limit humidity or moisture content.

10. The image forming apparatus according to claim 1, further comprising a concentration detection portion configured to detect a toner concentration, wherein the control portion is configured to perform the first mode in a case where the toner concentration detected by the concentration detection portion is higher than a predetermined concentration, and to perform the second mode in a case where the toner concentration is equal to or lower than the predetermined concentration.

* * * * *